US005510678A

United States Patent [19]

Sakai et al.

[11] Patent Number: 5,510,678

[45] Date of Patent: Apr. 23, 1996

[54] DC TYPE GAS-DISCHARGE DISPLAY PANEL AND GAS-DISCHARGE DISPLAY APPARATUS WITH EMPLOYMENT OF THE SAME

[75] Inventors: Tetsuo Sakai; Yasushi Motoyama; Mizumoto Ushirozawa, all of Tokyo, Japan

[73] Assignee: Nippon Hoso Kyokai, Tokyo, Japan

[21] Appl. No.: 379,969

[22] Filed: Jan. 27, 1995

Related U.S. Application Data

[62] Division of Ser. No. 913,903, Jul. 16, 1992.

[30] Foreign Application Priority Data

| | | | |
|---|---|---|---|
| Jul. 18, 1991 | [JP] | Japan | 3-202135 |
| Nov. 18, 1991 | [JP] | Japan | 3-301832 |
| Nov. 21, 1991 | [JP] | Japan | 3-306247 |

[51] Int. Cl.[6] ..... H01J 7/44

[52] U.S. Cl. ..... 315/58; 315/169.4; 315/71

[58] Field of Search ..... 315/169.4, 56, 315/58, 71; 313/637, 572, 568, 486

[56] References Cited

U.S. PATENT DOCUMENTS

| | | | |
|---|---|---|---|
| 4,085,351 | 4/1978 | Takahashi et al. | 313/486 |
| 4,703,229 | 10/1987 | Nighan et al. | 315/169.4 |
| 4,780,644 | 10/1988 | Sakai et al. | 313/582 |
| 5,150,011 | 9/1992 | Fujieda | 315/169.4 |

FOREIGN PATENT DOCUMENTS 279744 8/1988 European Pat. Off. .

OTHER PUBLICATIONS

Murakami et al., "A 20–in Color DC Gas–Discharge Panel for TV Display", IEEE Transactions on Electron Devices, vol. 36, No. 6, pp. 1063–1072, Jun. 1989.

Takano et al., "Plasma Display Panel with a Resistor in each Cell", Annual Convention of Institute of Television Engineers of Japan, Provisional Report 4–3, pp. 77–78, 1990.

(List continued on next page.)

*Primary Examiner*—Robert J. Pascal
*Assistant Examiner*—Michael Shingleton
*Attorney, Agent, or Firm*—Antonelli, Terry, Stout & Kraus

[57] ABSTRACT

A DC type gas-discharge display panel comprises a plurality of discharge cells; discharge current limiting means provided for each of the discharge cells, for limiting a discharge current of each of said discharge cells; and a filling gas filled into each of said discharge cells, and having an inert gas mixture. A partial pressure ratio of said inert gas mixture to total pressure of said filling gas is at least 0.95. The above-described inert gas mixture is selected from the group consisting of (1) a first gas mixture consisting of a He gas and a Xe gas, (2) a second gas mixture consisting of a He gas, a Xe gas, and a Kr gas, (3) a third gas mixture consisting of a Ne gas and a Xe gas, and (4) a fourth gas mixture consisting of a Ne gas, a Xe gas and a Kr gas. Assuming now that the total pressure of said filling gas is "p" Torr, a partial pressure ratio of said Xe gas to the total pressure of said filling gas is "x", and also partial pressure ratio of said Kr gas to the total pressure of said filling gas is "k", when said inert gas mixture corresponds to said first gas mixture, a condition of $0.01 \leqq x \leqq 0.5$, a condition of $p \leqq 600$, and another condition of $xp^5 \geqq 1.4.10^{11}$ are satisfied; when said inert gas mixture corresponds to said second gas mixture, a condition of $0.01 \leqq x \leqq 0.5$, a condition of $0 < k \leqq 0.5$, a condition of $P \leqq 600$, and also another condition of $\{1+700xk^2/(p/200)^4\}xp^5 \geqq 4.10^{11}$ are satisfied; when said inert gas mixture corresponds to said third gas mixture, a condition of $0.01 \leqq x \leqq 0.5$, a condition of $p \leqq 500$, and another condition of $xp^5 \geqq 8.0.10^9$; and also when said inert gas mixture corresponds to said fourth gas mixture, a condition of $0.01 \leqq x \leqq 0.5$, a condition of $0 < k \leqq 0.5$, a condition of $p \leqq 500$, and a condition of max $\{80xk(1-3.3x), 1\}xp^5 \geqq 8.0.10^9$ are satisfied. The discharge current limiting means may be a resistor formed by being terminated by two adjoining lines of second conductive lines and second electrodes.

14 Claims, 55 Drawing Sheets

OTHER PUBLICATIONS

Mikoshiba et al., "Mechanism of Discharge Build-up and High-speed Addressing of a Townsend-discharge Panel TV Using Pre-Discharges", pp. 349-350, Proceedings of the SIC., vol. 31, No. 4, 1990.

Miyake et al., "A New Penning Mixture Gas, Ne+Xe+Kr, for Color Plasma Displays", pp. 208-211, Eurodisplay '90, Proceedings of the Tenth International Display Research Conference, 1990.

Okamoto et al., "A Positive-Column Discharge Memory Panel Without Current-Limiting Resistors for Color TV Display", IEEE Trans. Electron Devices, vol. ED-27, pp. 1778-1783, Sep. 1980.

Chui, "An Introduction to Wavelets", Wavelet Analysis and Its Applications, pp. 231-235. 1992.

Coburn, et al., "Ion- and Electron-Assisted Gas-Surface Chemistry—An Important Effect in Plasma Etching", pp. 3189-3196, J. Appl. Phys. vol. 50, No. 5, May 1979.

Holz, "Pulsed Gas Discharged Display with Memory", Burroughs Corporation, ECD, pp. 36-37. Dated before applicant's invention.

DC TYPE GAS-DISCHARGE DISPLAY PANEL AND GAS-DISCHARGE DISPLAY APPARATUS WITH EMPLOYMENT OF THE SAME

This application is a 37 CFR §1.60 divisional of prior application Ser. No. 07/913,903, filed Jul. 16, 1992 (pending).

BACKGROUND OF THE INVENTION

The present invention relates to a DC type gas-discharge display panel and a gas-discharge display apparatus with employment of the DC type gas-discharge display panel.

First of all, the publications related to the present invention are listed as follows:

(1). "A 17-in High Resolution DC Plasma Display" by Niwa et al., The Journal of the Institute of Television Engineers of Japan, Vol. 44, No. 5 (1990) pp. 571–577.

(2). "A 20-in Color DC Gas-Discharge Panel for TV Display" by Murakami et al., IEEE Transactions on Electron Devices, Vol. 36, No. 6, June 1989, pp. 1063–1072.

(3). "Ultra-Low Reflectivity Color Display Gas-Discharge Panel" by Sakai et al., The Journal of the Institute of Television Engineers of Japan Vol. 42, No. 10 (1988) pp. 1084–1090.

(4). U.S. Pat. No. 4,780,644, "Gas-Discharge Display Panel".

(5). "Plasma Display Panel with a Resistor in each Cell" by Takano et al., Annual Convention of Institute of Television Engineers of Japan, 1990, Provisional Report 4-3, pp. 77–78.

As a first conventional DC type gas-discharge panel, it has been utilized such a structure thereof as shown in FIGS. 1A and 1B. FIG. 1A is a sectional view of this first conventional gas-discharge panel, and FIG. 1B is a plan view thereof, as viewed from a display side. In FIGS. 1A and 1B, symbol "FP" indicates a front plate (glass); symbol "BM" shows a black grid (black matrix); symbol "BA" is a partition; symbol "A" shows an anode (indium tin oxide); symbol "Ph" denotes phosphor; symbol "C" shows a cathode (Ni); symbol "D" indicates a dielectric material; symbol "TH" denotes a third electrode; and symbol "RP" shows a rear plate (glass). A detailed explanation of this gas-display panel is described in the above-described publication (1). In this panel, the display panel of the X-Y matrix is driven by the 1-line at-a-time drive method, and a relatively large current (about 490 μA) is flown therethrough. As a result, the light-emission efficiency is 0.025 lm/w (white), which implies a low efficiency, and therefore this display panel is not utilized as a color television receiver panel except for a TV receiver panel with special purposes. In this display panel, He (partial pressure ratio of 93%)-Kr (5%)-Xe (2%) gas is employed as the filling gas, and total pressure thereof is 400 Torr.

In FIG. 2, there is shown a DC type gas-discharge display panel as a second conventional display panel. It should be noted that the same reference symbols shown in FIGS. 1A and 1B are employed as those for denoting the same constructive elements shown in FIG. 2. There are other reference symbols in which symbol "AA" indicates an auxiliary anode; symbol "R-Ph" shows red phosphor; symbol "G-Ph" indicates green phosphor; symbol "B-Ph" is blue-phosphor; symbol "PS" shows a priming slit; symbol "DC" is a display cell; symbol "W" represents a wall; and symbol "ACE" indicates an auxiliary cell. The operation of this second display panel should be referred to the above-described publication (2).

In FIG. 3, there is shown a DC type gas-discharge panel according to a third conventional display panel. It should be noted that the same reference symbols shown in FIGS. 1A, 1B and 2 are employed as those for denoting the same constructive elements shown in FIG. 3. As other reference symbols, there are provided symbol "F" indicates a filter; symbol "CB" denotes a cathode bus line; symbol "WB" shows a white back; symbol "AAL" is an auxiliary anode life; and also symbol "DAL" denotes a display anode line. A detailed description of this third conventional display panel should be referred to the above-described publication (3).

Furthermore, FIGS. 4A and 4B represent a DC type display panel according to a fourth conventional display panel. FIG. 4A is a plan view of this display panel, as viewed at a display side, and FIG. 4B is a sectional view thereof cut away along a cutting line $X_1$–$X_2$ shown in FIG. 4A. The structure of this fourth display panel is most similar to that of a DC type gas-discharge display panel according to the present invention. It should also be noted that the same reference symbols shown in FIGS. 1A to 3 are employed as those for denoting the same constructive elements shown in FIGS. 4A and 4B. As other reference symbols, there are provided reference symbol "AC" denotes an auxiliary cathode; symbol "DAB" shows a display anode bus line; and symbol "R" indicates a current limiting resistor. A detailed explanation of the fourth conventional display panel should be referred to the above-described publications (4) and (5).

The above-described second to fourth conventional display panels are driven by the pulse memory drive method, the cathodes "C" of which are made of such materials as Ni, A1 and $LaB_6$, and in which He-Xe (1.5 to 5%) gas is employed as the filling gas. The total pressure of the display panel is from 200 to 250 Torr.

As previously described in detail in the above-mentioned publication (1), peak luminance of an image of the first conventional gas-discharge display panel is about 33 cd/m$^2$, namely dark. Moreover, since the light-emission efficiency is not so high, this first display panel is not adequate to a display panel for a large-screen sized television receiver.

Although no description about a lifetime of this first display panel is made in the above publication (1), a relatively long lifetime will be predicted, because the light emission duty which is inversely proportion to the line number of this display panel, is 1/480, namely low, and thus luminance thereof is lowered. Assuming now that a "lifetime" is defined by operation time during which present luminance of a display panel becomes ½ of initial luminance, generally speaking, when light emission duty is lowered to reduce luminance, when a comparison is made between the lifetimes of the display panels, luminance X lifetime should be employed as a comparison basis.

As to the second and third conventional display panels, the practical lifetimes may be predicted as 1,000 hours to 2,000 hours since luminance thereof is increased due to the memory function, and also peak luminance is from 50 to 100 cd/m$^2$. Since when luminance is 100 cd/m$^2$, 10,000 hours are required as the practical predicted lifetimes of the second and third conventional display panels constitute a big problem.

It could become appear that the most important factor to determine a lifetime of a display panel is such that luminance of this display panel is lowered since a sputtered cathode material adhere to an inside of a cell. Also, it could be recognized that since a discharge current should be reduced so as to suppress the sputtering, the sustaining discharge currents of the second and third conventional display panels are suppressed to about 100 μA, but the lifetimes thereof are still short.

To improve the above-described drawback, the current limiting resistor is connected to the fourth conventional display tube, so that the sustaining current thereof is lowered and then the lifetime thereof becomes approximately 2 times longer than that of the second or third conventional display panel. However, this longer lifetime is not a practically sufficient lifetime.

As previously explained, a DC type gas-discharge display panel with high luminance and a sufficiently long lifetime could not be realized from those conventional DC type gas-discharge display panel.

In, for instance, the DC type gas-discharge display panel shown in the above-mentioned publication (5), there are employed the resistors for each of the discharge cells in order to limit the discharge currents flowing through the respective discharge cells. This resistor owns such roles that the discharge current of the discharge cell is limited to the normal glow-discharge region, sputtering is dissipated, and the memory effect is maintained in the DC memory type discharge display panel.

FIGS. 5A and 5B are schematic diagrams of a structure of this discharge display panel. FIG. 5A is a plan view of a portion of this discharge panel, and FIG. 5B is a sectional view thereof, taken along a cutting line $X_3$–$X_4$. Also, there is shown in FIG. 5B a cutting sectional plane $X_5$–$X_6$ in FIG. 5B. It should be noted that the same reference symbols shown in FIG. 1A to 4B are employed as those for denoting the same constructive elements shown in FIGS. 5A and 5B.

In this example, a cathode "C" is formed on a front plate "FP", both of an anode bus line "AB" and an auxiliary anode "AA" are formed on a rear plate "RP" and positioned perpendicular to the cathode "C", and also a discharge cell "DCE" surrounded by walls "W" are formed on the respective cross points between the anode bus line "AB" and the cathode "C". In the discharge cell "DCE", a resistive material "RM" having an L-shaped form is furthermore fabricated between the anode bus line "AB" and the anode "A".

Operation of this discharge display panel will now be summarized. When a predetermined voltage is applied to a specific cathode "C" and the anode bus line "AB", a current is flown via the resistor R to the cells "DCE" at these cross points, so that a discharge occurs between the anode "A" and the cathode "C". The phosphor "Ph" emits light in response to ultraviolet rays produced by this discharge. Thus, the specific discharge cell "DCE" within the panel can emit light. The light is emitted from the specific cell through the front plate FP to an outside. The red, green and blue phosphor are employed for each of the discharge cells "DCE" to display a full-colored television image. The function of the white glass back "WB" is to electrically insulate the electrode and also to derive the emitted light at the high efficiency. A discharge is previously induced between the auxiliary anode "AA" and the cathode "C" so that the commencement of the discharge in the discharge cell is emphasized via the priming slit "PS".

In accordance with the above-described DC type discharge display panel, the higher light-emission efficiency can be achieved under the small drive current, and also deterioration of the display panel caused by the sputtering can be prevented, thereby prolonging the lifetime thereof. To this end, the resistors "R" for limiting the discharge currents are employed in the respective cells "DCE".

In accordance with prior art, the L-shaped resistive materials to constitute the resistors have been separately formed with the respective cells.

A large-sized display panel is manufactured by way of, for instance, the thick-film printing method and the like. The conventional panel manufacturing method has a drawback that large fluctuation happens to occur in the resistance values, depending upon the manufacturing precision, e.g., the dimension and thickness of the resistive materials. Also, the resistance values are fluctuated in accordance with the positions and dimensions of the electrodes for terminating this resistor. If the resistance value is fluctuated, there are problems that the discharge currents of the respective cells are changed, and therefore the light-emitting outputs are fluctuated, and the fluctuated light appears as fixed pattern noise on a displayed image. In other words, there is a problem that a lack of luminous uniformity, or luminous fluctuation happens to occur in the respective discharge cells.

SUMMARY OF THE INVENTION

An object of the present invention is to provide a high luminous DC type gas-discharge display panel having a long lifetime, and a gas-discharge display apparatus with employment of this display panel.

Another object of the present invention is to provide a DC type gas-discharge display panel, with low luminous fluctuation in each of discharge cells.

To achieve such objects, a DC type gas-discharge display panel according to one aspect of the present invention comprises: a plurality of discharge cells; discharge current limiting means provided for each of the discharge cells, for limiting a discharge current of each of said discharge cell; and a filling gas filled into each of said discharge cells, and having an inert gas mixture. A partial pressure ratio of said inert gas mixture to total pressure of said filling gas is at least 0.95. The above-described inert gas mixture is selected from the group consisting of (1) a first gas mixture consisting of a He gas and a Xe gas, (2) a second gas mixture consisting of a He gas, a Xe gas, and a Kr gas, (3) a third gas mixture consisting of a Ne gas and a Xe gas, and (4) a fourth gas mixture consisting of a Ne gas, a Xe gas and a Kr gas. Assuming now that the total pressure of said filling gas is "p" Torr, a partial pressure ratio of said Xe gas to the total pressure of said filling gas is "x", and also a partial pressure ratio of said Kr gas to the total pressure of said filling gas is "k", when said inert gas mixture corresponds to said first gas mixture, a condition of $0.01 \leqq x \leqq 0.5$, a condition of $p \leqq 600$, and another condition of $xp^5 \geqq 1.4.10^{11}$ are satisfied; when said inert gas mixture corresponds to said second gas mixture, a condition of $0.01 \leqq x \leqq 0.5$, a condition of $0 < k \leqq 0.5$, a condition of $p \leqq 600$, and also another condition of $\{1+700xk^2/(p/200)^4\}xp^5 \geqq 1.4.10^{11}$ are satisfied; when said inert gas mixture corresponds to said third gas mixture, a condition of $0.01 \leqq x \leqq 0.5$, a condition of $p \leqq 500$, and another condition of $xp^5 8.0.10^9$; and also when said inert gas mixture corresponds to said fourth gas mixture, a condition of $0.01 \leqq x \leqq 0.5$, a condition of $0 < k \leqq 0.5$, a condition of $p \leqq 500$, and a condition of max $\{80xk(1-3.3x), 1\}xp^5 \geqq 8.0.10^9$ are satisfied. Here, the formula max $\{80xk(1-3.3x),1\}$ implies that any larger one of these numeral values in $80xk(1-3.3x)$ and 1 is employed.

In accordance with this DC type gas-discharge display panel, a long lifetime and high luminance can be achieved.

A gas-discharge display apparatus is according to another aspect of the present invention comprises: a DC type gas-discharge display panel and a drive device for driving the DC type gas-discharge display panel in a memory drive scheme. The DC type gas-discharge display panel includes a plurality of discharge cells; discharge current limiting means provided for each of the discharge cells, for limiting a discharge current of each of said discharge cell; and a filling gas filled into each of said discharge cells (DCE), and having an inert gas mixture. A partial pressure ratio of said inert gas mixture to total pressure of said filling gas is at least 0.95. The above-described said inert gas mixture is selected from the group consisting of (1) a first gas mixture consisting of a He gas and a Xe gas, (2) a second gas mixture consisting of a He gas, a Xe gas, and a Kr gas, (3) a third gas mixture consisting of a Ne gas and a Xe gas, and (4) a fourth gas mixture consisting of a Ne gas, a Xe gas and a Kr gas.

Assuming now that the total pressure of said filling gas is "p" Torr, a partial pressure ratio of said Xe gas to the total pressure of said filling gas is "x", and also a partial pressure ratio of said Kr gas to the total pressure of said filling gas is "k", an active cathode area of each of said discharge cells is S $mm^2$, and also a sustaining discharge current based on the drive of said drive device is I μA; when said inert gas mixture corresponds to said first gas mixture, a condition of $0.01 \leqq x \leqq 0.5$, a condition of $p \leqq 600$, and another condition of $xp^5(S/I)^2 \geqq 6.3.10^4$ are satisfied; when said inert gas mixture corresponds to said second gas mixture, a condition of $0.01 \leqq x \leqq 0.5$, a condition of $0 < k \leqq 0.5$, a condition of $p \leqq 600$, and also another condition of $\{1+700xk^2/(p/200)^4\}xp^5(S/I)^2 \geqq 6.3.10^4$ are satisfied; when said inert gas mixture corresponds to said third gas mixture, a condition of $0.01 \leqq x \leqq 0.5$, a condition of $p \leqq 500$, and another condition of $xp^5(S/I)^3 \geqq 2.4$; and also when said inert gas mixture corresponds to said fourth gas mixture, a condition of $0.01 \leqq x \leqq 0.5$, a condition of $0 < k \leqq 0.5$, a condition of $p \leqq 500$, and a condition of max $\{80xk(1-3.3x),1\}xp^5(S/I)^3 \geqq 2.4$ are satisfied.

In accordance with this gas-discharge display apparatus, a long lifetime and high luminance can be achieved.

A DC type gas-discharge display panel according to another aspect of the present invention comprises: a plurality of discharge cells arranged in a matrix form along a line (row) direction and a column direction; a plurality of resistors provided for each of said discharge cells, for limiting a discharge current of each of said discharge cells; a filling gas filled into each of said discharge cells; a plurality of first conductive lines elongated along the line direction to which one of a desirable discharge controlling potential is applied, each of said first conductive lines being commonly arranged in each of said discharge cells in the respective lines to constitute a first discharge electrode; a plurality of second conductive lines elongated along said column direction, to which the other desirable discharge controlling potential is applied, two adjoining lines of said second conductive lines being commonly arranged with the respective discharge cells; a plurality of second discharge electrodes provided at a substantially central position between each pair of adjoining second conductive lines, which corresponds to each of said discharge cells, for producing a discharge between said first discharge electrodes corresponding to said discharge cells; and a plurality of resistive materials elongated along said column direction, each of said resistive materials being arranged in such a manner that said discharge cells at said column are bridged by each of said resistive materials, and being in contact with both of said two adjoining lines of said second conductive lines and said second electrode corresponding to said discharge cells at each column, and, wherein each of said resistors is formed by being terminated by said two adjoining lines of said second conductive lines and said second electrodes corresponding to said respective discharge cells.

According to this DC type gas-discharge display panel, luminous fluctuation of the respective discharge cells can be lowered without requiring high precision in the manufacturing stage.

A DC type gas-discharge display panel according to a further aspect of the present invention, comprises a plurality of discharge cells arranged in a matrix form along a line (row) direction and a column direction; a plurality of resistors provided at each of said discharge cells, for limiting a discharge current of each of said discharge cells; a filling gas filled in each of said discharge cells; a plurality of first conductive lines elongated along the line direction, to which one of a desirable discharge controlling potential is applied, each of said first conductive lines being commonly arranged in each of said discharge cells in the respective lines to constitute a first discharge electrode; a plurality of second conductive lines elongated along said column direction, to which the other desirable discharge controlling potential is applied, each of said second conductive line being commonly arranged with the respective discharge cells positioned at the respective columns; plural pairs of branch conductive lines branched from each of said second conductive lines along said line direction in a comb shape, each of said pair of branch conductive lines being arranged at a position corresponding to each of said discharge cells; a plurality of second discharge electrodes provided at a substantially central position between said pairs of branch conductive lines for producing a discharge between said first discharge electrodes corresponding to said discharge cells; and a plurality of resistive materials elongated along said column direction, each of said resistive materials being arranged in such a manner that said discharge cells at said column are bridged by each of said resistive materials, and being in contact with both of said pair of branch conductive lines and said second electrode corresponding to said discharge cells at each column; each of said resistors being formed by said resistance materials being terminated by said pair of branch lines of said second conductive lines and said second electrodes corresponding to said respective discharge cells.

In accordance with this DC type gas-discharge display panel, luminous fluctuation of the respective discharge cells can be reduced without requiring high precision in the manufacturing stage.

DESCRIPTION OF THE PREFERRED EMBODIMENTS

Figure 6A:
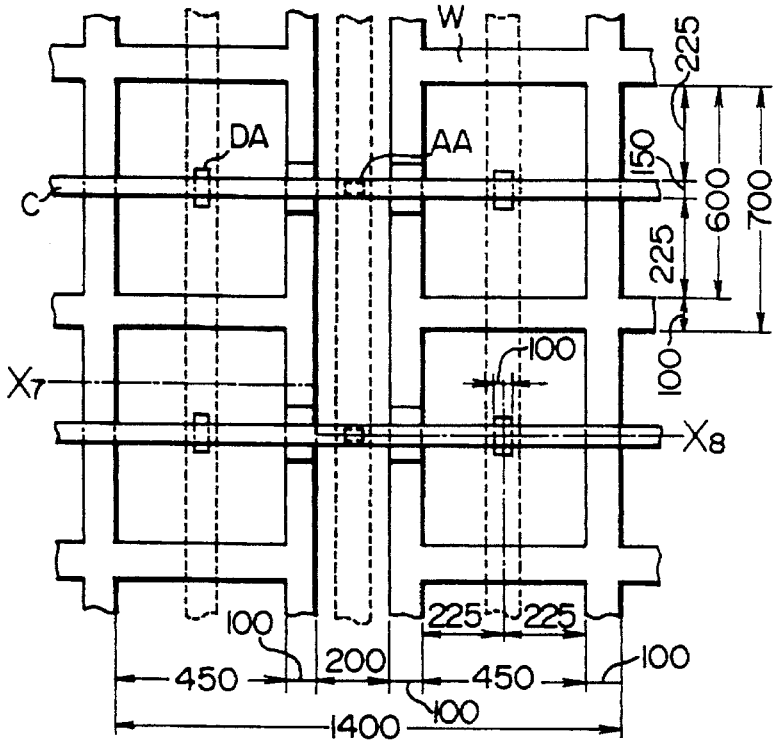
FIG. 6A is a plan view of a DC type gas-discharge display panel employed in an experiment to perform the present invention.
Figure 6B:
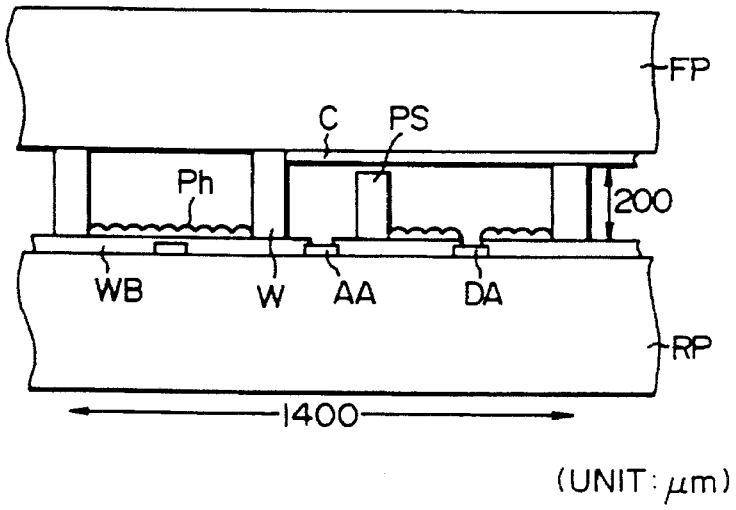
FIG. 6B is a sectional view thereof, taken along a line $X_7$–$X_8$ shown in FIG. 6A.

The present invention will now be described in detail with reference to the accompanying drawings. Before proceeding with such a detailed description, a historical background of the present invention invented by the Applicants will now be explained in detail. That is, considering the factors of the lifetimes when the DC type gas-discharge display panel is driven in the pulse memory drive scheme, the Applicants could confirmed these factors based upon several experiments. It should be noted that these experiments were performed in a DC type gas-discharge display panel shown in FIGS. 6A and 6B. FIG. 6A is a plan View of this DC type gas-discharge display panel, and FIG. 6B is a sectional view thereof, taken along a line $X_7$–$X_8$ of FIG. 6A. The same reference numerals shown in FIGS. 1A to 4B will be employed as those for denoting the same elements shown in FIGS. 6A and 6B.

As the cathode material of this panel, Al, Ni, $BaAl_4$ and the like were employed. The cathodes "C" was formed by directly utilizing a portion of a bus line "CB", or an adhesion of the cathode material on the bus line "CB". A white glass material was employed as a barrier of a cell partition "BA" and a white over-glaze layer "WB". As a red phosphor, $(YGd)BO_3$:Eu was pasted and printed/burned. Similarly, as a green phosphor, $Zn_2SiO_4$:Mn was pasted and printed/burned, whereas as a blue phosphor, $BaMg\ Al_4\ O_{23}$:Eu was pasted and printed/burned. As a result of various experiments, the Applicants could confirm the following facts (1) to (4).

(1) A lifetime of a DC type gas-discharge display panel under a sustain pulse operation in a pulse memory drive scheme is equal to a lifetime of the DC type gas-discharge display panel under a constant current drive, the duty "D" and the current value of which are the same as those of the above-described sustain pulse operation. The above-described constant current drive implies that a discharge cell is driven in such a manner that a constant current is flown only for a predetermined time period defined by a predetermined duty D ($D \leqq 1$). It should be noted that a lifetime of the display panel operated in the constant current drive under $D \neq 1$ is equal to a value calculated by dividing a lifetime thereof operated in the constant current drive under D=1 by the value of D. For instance, a lifetime of the display panel driven under the constant current mode at D=1/60 is equal to a value calculated by multiplying by 60, a lifetime thereof driven under the constant current mode at D=1. As a consequence, if a lifetime of a display panel driven under the constant current mode at D=1 is measured, lifetimes of this panel driven under the constant current mode at an arbitrary duty "D" may be calculated based upon the first-mentioned (measured) lifetime.

Figure 7:
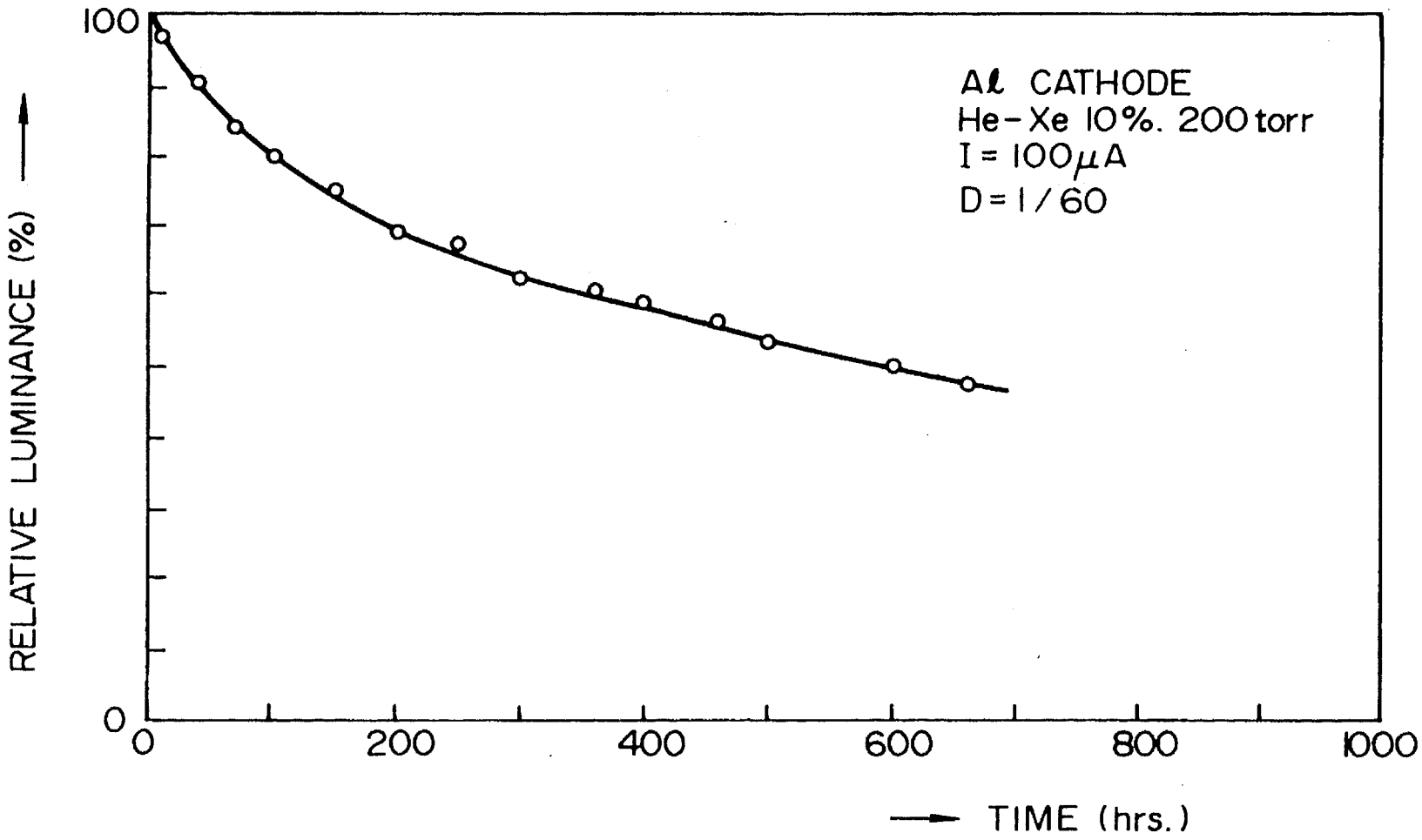
FIG. 7 represents a characteristic curve of luminance deterioration.
Figure 8:
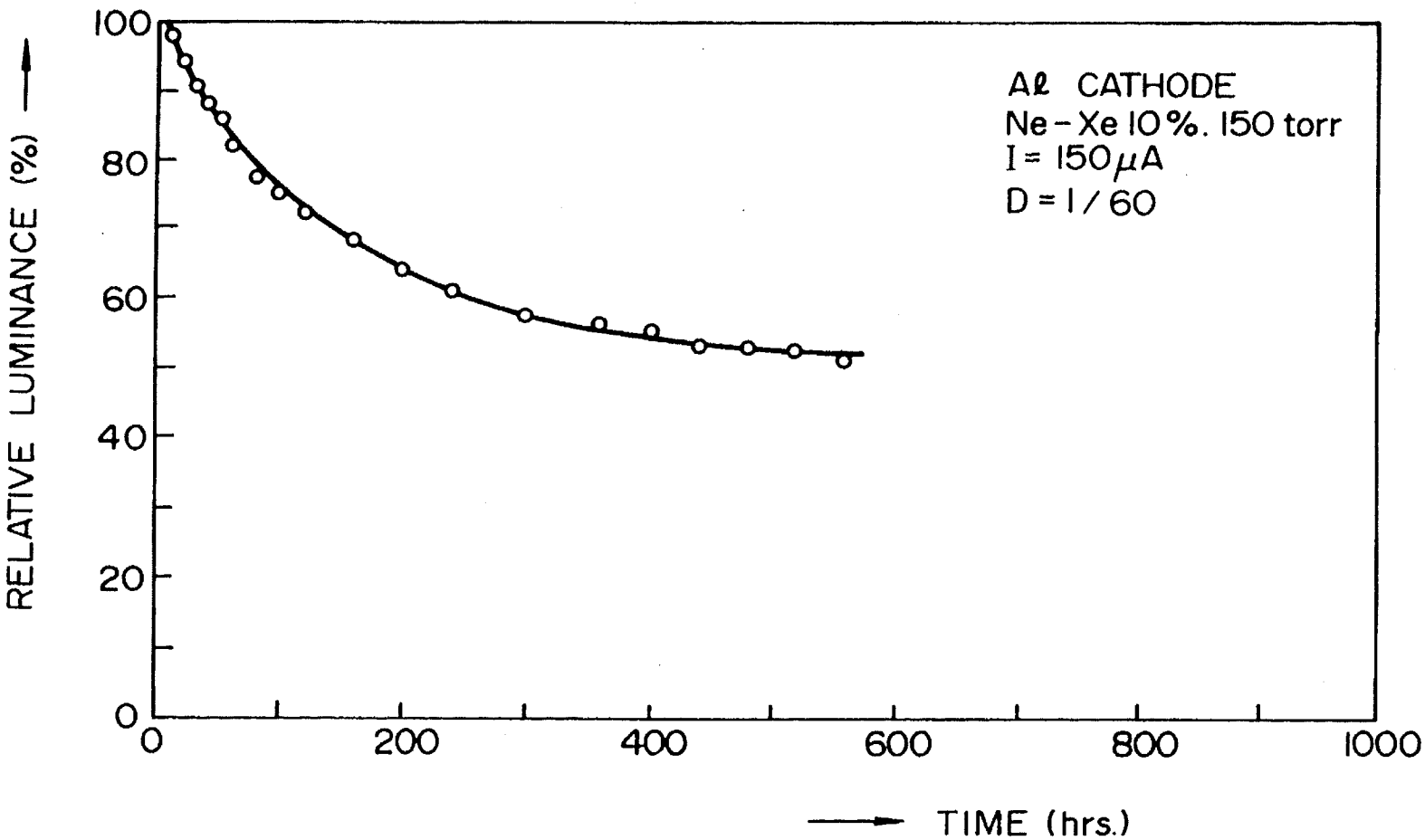
FIG. 8 shows a characteristic curve of luminance deterioration.

(2) As shown in FIGS. 7 and 8, the characteristic curves of luminous deterioration of the DC type gas-discharge display panel (relative luminance-to-operation time (elapse of time) characteristic) may be approximated by formula of [exp (−bt)+c], wherein symbols "b" and "c" indicate constant, and symbol "t" shows operation time. FIG. 7 represents the characteristic curve of luminous deterioration related to the display panel shown in FIGS. 6A and 6B, measured under such condition that aluminum (A1) is used as a cathode material, a filling gas consisting of a He gas with partial pressure of 90% and a Xe gas with partial pressure of 10% is filled into this panel under total pressure of 200 Torr, and this display panel is driven in constant current with D=1 and I=100 μA (symbol "I" denotes a value of current flown during a predetermined time period defined by a duty D). For the sake of simple explanation, such a measuring condition is described as a measurement that the display panel, shown in FIGS. 6A and 6B, with A1 cathode, He - Xe (10%) and P=200 Torr is operated in the constant current drive mode of D=1 and I=100 μA. FIG. 8 indicates the characteristic curve of luminous deterioration measured under such a condition that the display panel shown in FIGS. 6A and 6B with A1 cathode, Ne - Xe (10%) and P=150 Torr is operated in the constant current drive mode of D=1 and I=150 μA. Note that symbol "p" indicates total pressure.

(3) When an operation current "I" is increased, a lifetime "T" of a DC type gas-discharge display panel is rapidly shortened. It was found that for instance, when a light emission duty (luminous duty) is equal to 1 (namely, a duty D=1), if I=100 μA, then T=100 hrs (hours), whereas if I=300 μA, then T=2 hrs.

(4) It could be successfully predicted about lifetimes of a display panel operated under several different currents. That is to say, it could be fund out such a method capable of evaluating the lifetimes of the display panel when values and operation times of write current $I_1$ and a sustain pulse current $I_2$ are different from each other, as in the pulse memory drive scheme. This evaluation method will now be summarized. Assuming now that two characteristic curves of luminous deterioration are analogous to each other, a lifetime at a current value $I_1$ is $T_1$, and a lifetime at a current value $I_2$ is $T_2$, and also duties thereof are $D_l$ and $D_2$, a lifetime T for mixed conditions is given as follows:

$$T=(D_1/T_1+D_2/T_2)^{-1}$$

For instance, in case of the pulse memory drive scheme assuming now that $I_1$=300 μA, $T_1$=2 hr, $D_1$=1/2000, $I_2$=100 μA, $T_2$=100 hr, $D_2$=1/60, a lifetime under only write current becomes $T_1/D_1$=4000 hr, whereas a lifetime under only sustain current becomes $T_2/D_2$=6000 hr. A lifetime T under the mixed condition becomes actually 2400 hr.

Accordingly, it could be unveiled that the lifetime is shortened due to the large write current, although the duty becomes very small.

From these facts, it could be understood that the lifetime of the above-described fourth conventional display panel is prolonged since the write current becomes small. However, the lifetime matter of the fourth conventional display panel could not be sufficiently solved, but the lifetime problem can be firstly solved according to the present invention.

The restriction conditions in accordance with the present invention, namely the conditions such as compositions of filling gases and total pressure thereof, could be confirmed by performing various measurements, while changing the composition of the filling gases and the like in the DC type gas-discharge display panel shown in FIGS. 6A and 6B, which has the substantially same construction as that of the fourth preferred embodiments.

Figure 9:
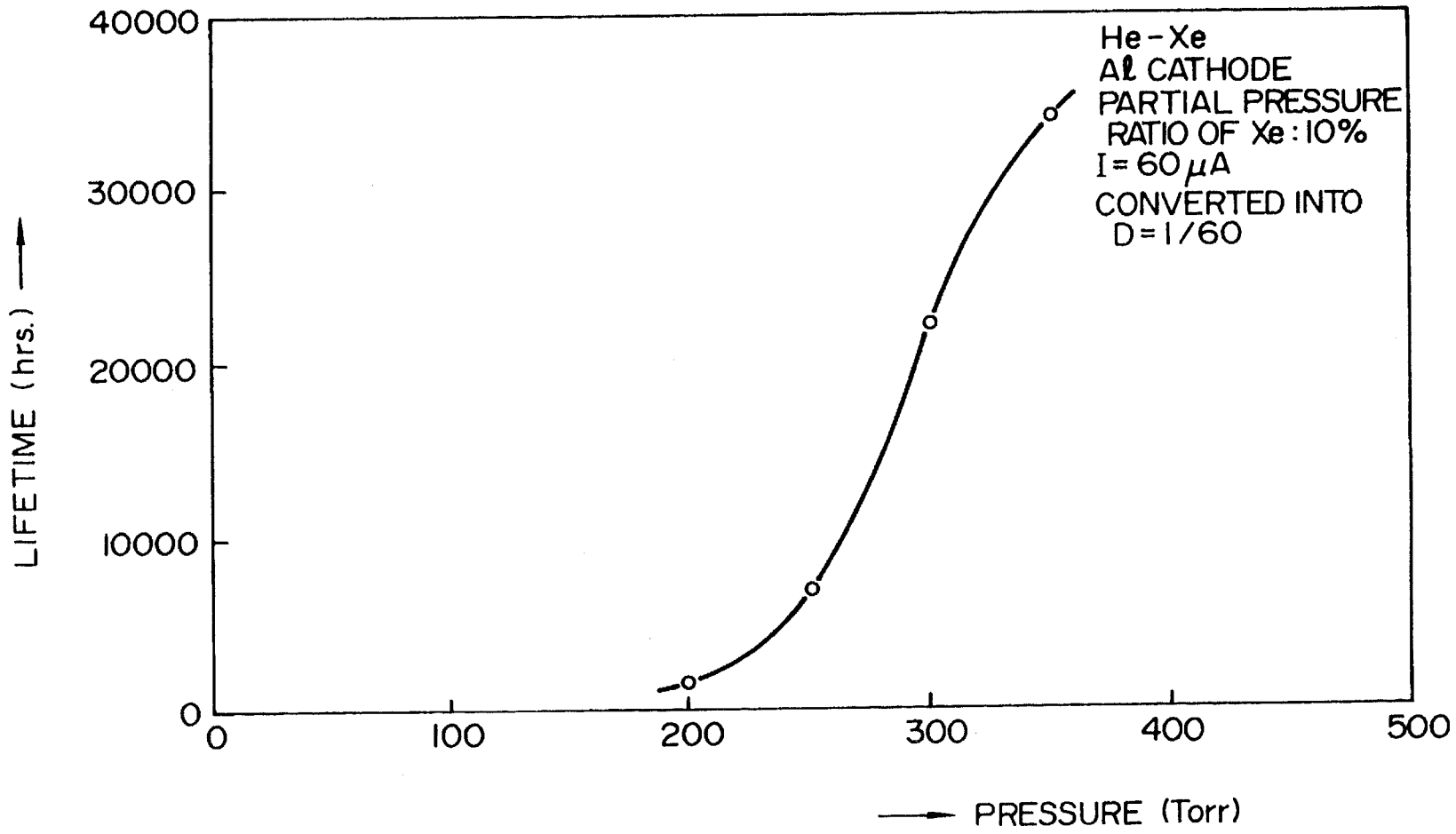
FIG. 9 indicates a lifetime-to-pressure characteristic.

For instance, as shown in FIG. 9, when a He - Xe (10%) filling gas (namely, a filling gas composed by a He gas with partial pressure of 90% and a Xe gas with partial pressure of 10%) is filled at total pressure of 300 Torr, a lifetime of a display panel is considerably prolonged. Also, when the total pressure of 250 Torr of the filling gas is increased only by 10%, the lifetime of the display panel is increased about two times and thus exceeds 10,000 hrs. Thus, within a rage of total pressure between 200 and 350 Torr, in which the lifetime of the display panel is increased or prolonged, luminance of this panel was substantially constant, i.e., approximately 50 cd/$m^2$. It should be noted that FIG. 9 represents a lifetime-to-pressure (total pressure of filling gas) characteristic obtained when the display panel of an A1 cathode (no Ag is contained in the cathode material) and He - Xe (10%), as shown in FIGS. 6A and 6B, is driven in the constant current mode under D=1 and I=60 μA. Note that the lifetime shown in FIG. 9 has been converted into the lifetime in case of D=1/60.

Figure 10:
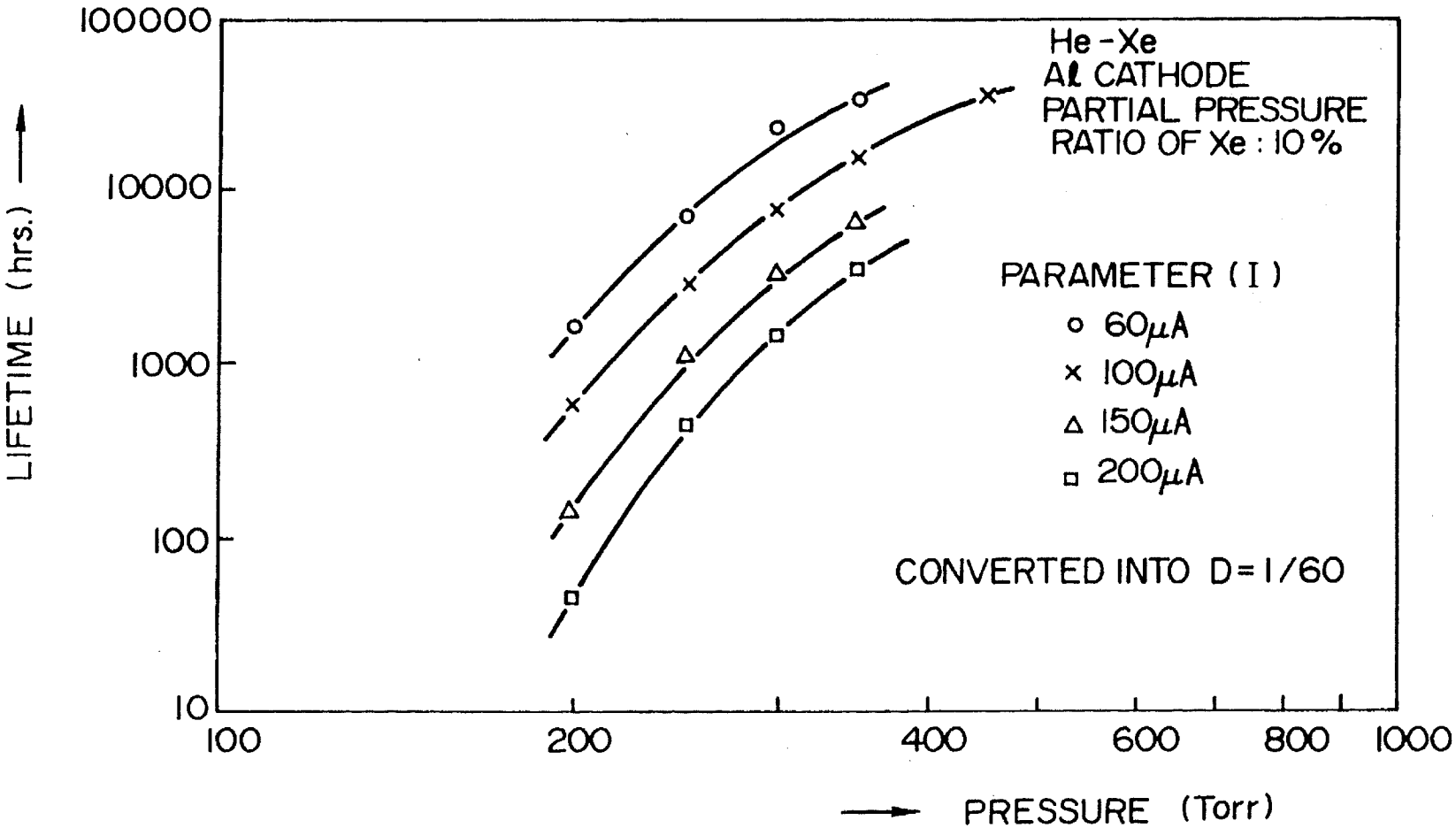
FIG. 10 represents a lifetime-to-pressure characteristic.

Furthermore, when the abscissa and ordinate of the graphic representation of FIG. 9 are changed by the logarithmic scale, a graphic representation as shown in FIG. 10 is obtained. It should be noted that measurement data when the current I is used as a parameter, and the current I is selected to be not only 60 μA, but also 100 μA, 150 μA, and 200 μA, is additionally represented in FIG. 10. It could be recognized from the gradient of the curve shown in FIG. 10 that the lifetime of the panel is substantially proportional to $p^5$ to $p^6$ (symbol "p" indicates total pressure of filling gas).

Figure 11:
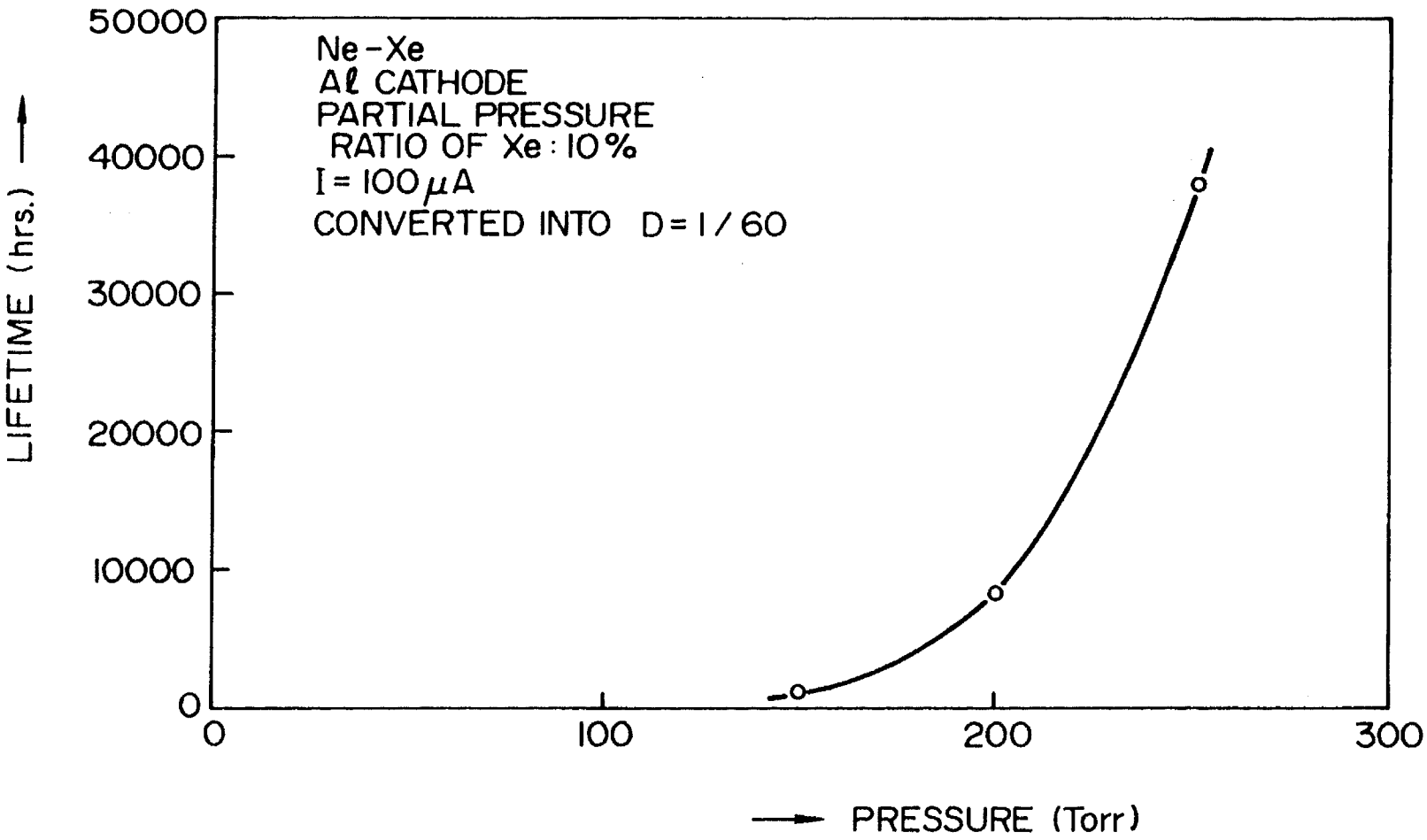
FIG. 11 shows a lifetime-to-pressure characteristic.

Similarly, as shown in FIG. 11, for instance, when the Ne - Xe (10%) filling gas was filled at total pressure of 250 Torr, the lifetime of the display panel was considerably increased, or prolonged. Also, when the total pressure of 200 Torr of the filling gas was increased by only 10% thereof, the lifetime was prolonged about two times, and exceeded 10,000 hrs. As described above, luminance was substantially constant, i.e., 40 cd/$m^2$ within the total pressure range between 150 and 300 Torr, corresponding to such a range in which the lifetime was prolonged. FIG. 11 represents a lifetime-to-pressure characteristic of the display panel, as shown in FIGS. 6A and 6B having the A1 cathode and Ne - Xe (10%) which was driven at the constant current mode under condition of D=1 and I=100 μA. It should be noted that the lifetime shown in FIG. 11 has been converted into the lifetime in case of D=1/60.

Figure 12:
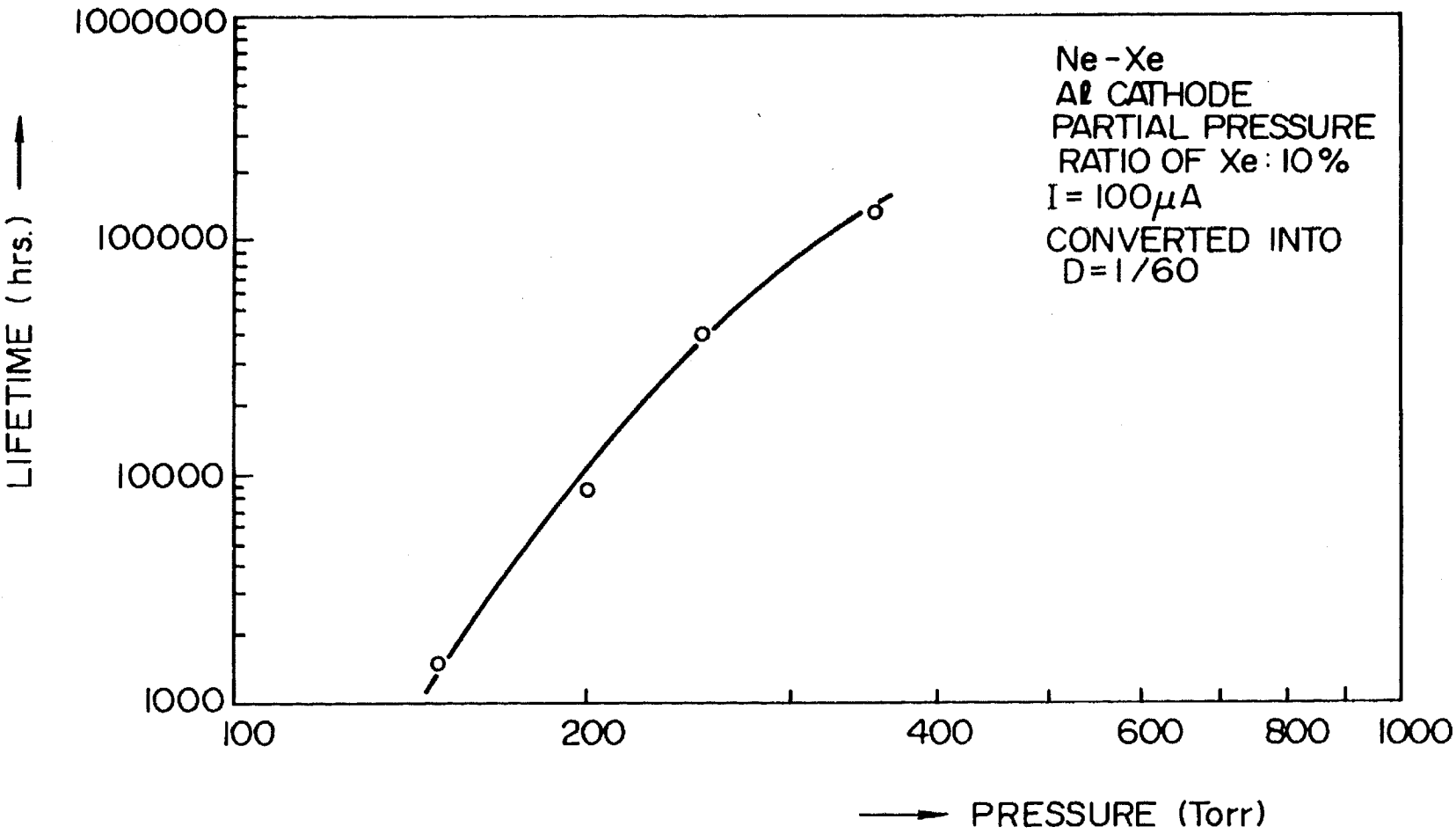
FIG. 12 shows a lifetime-to-pressure characteristic.
Figure 13:
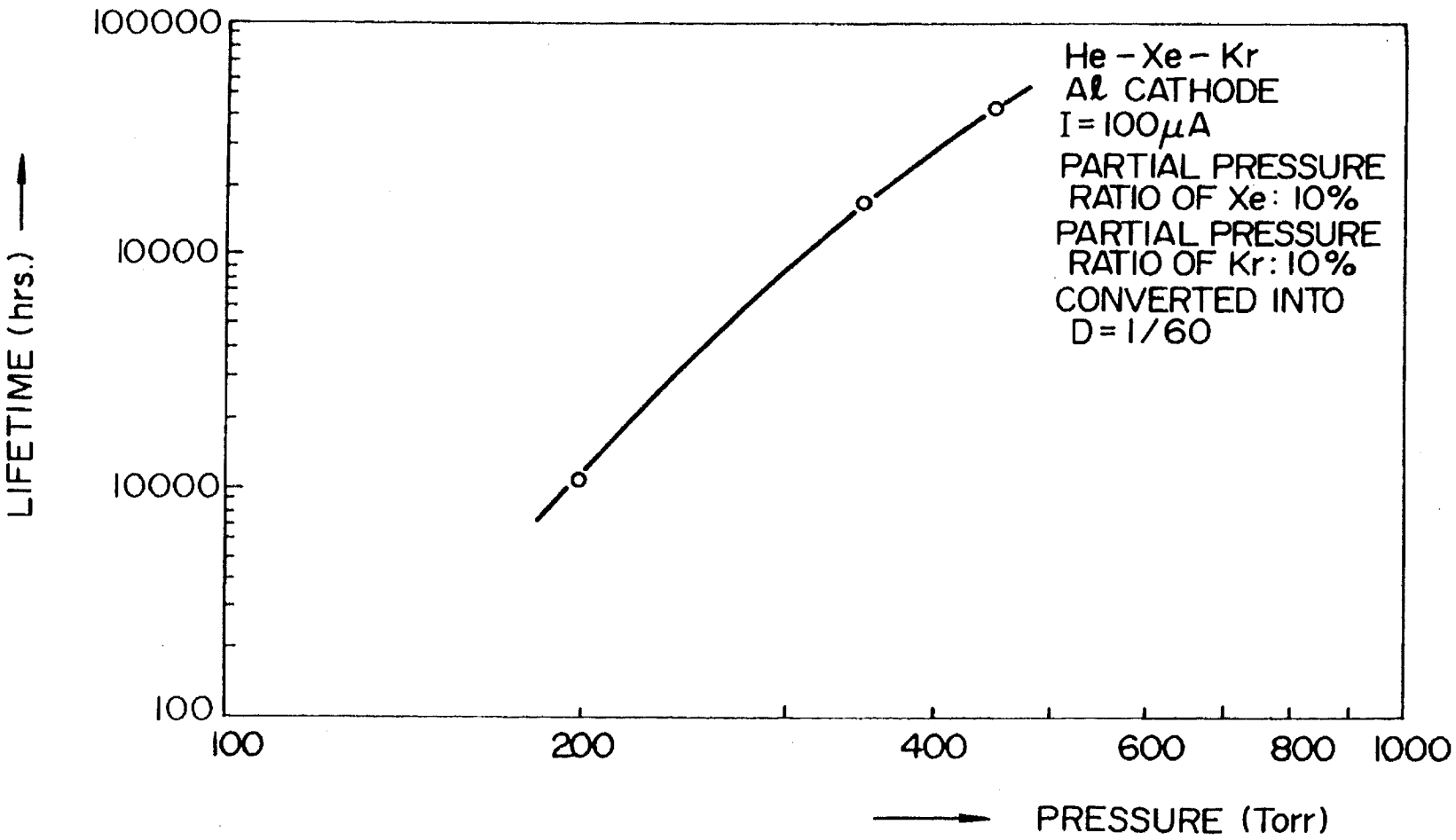
FIG. 13 shows a lifetime-to-pressure characteristic.
Figure 14:
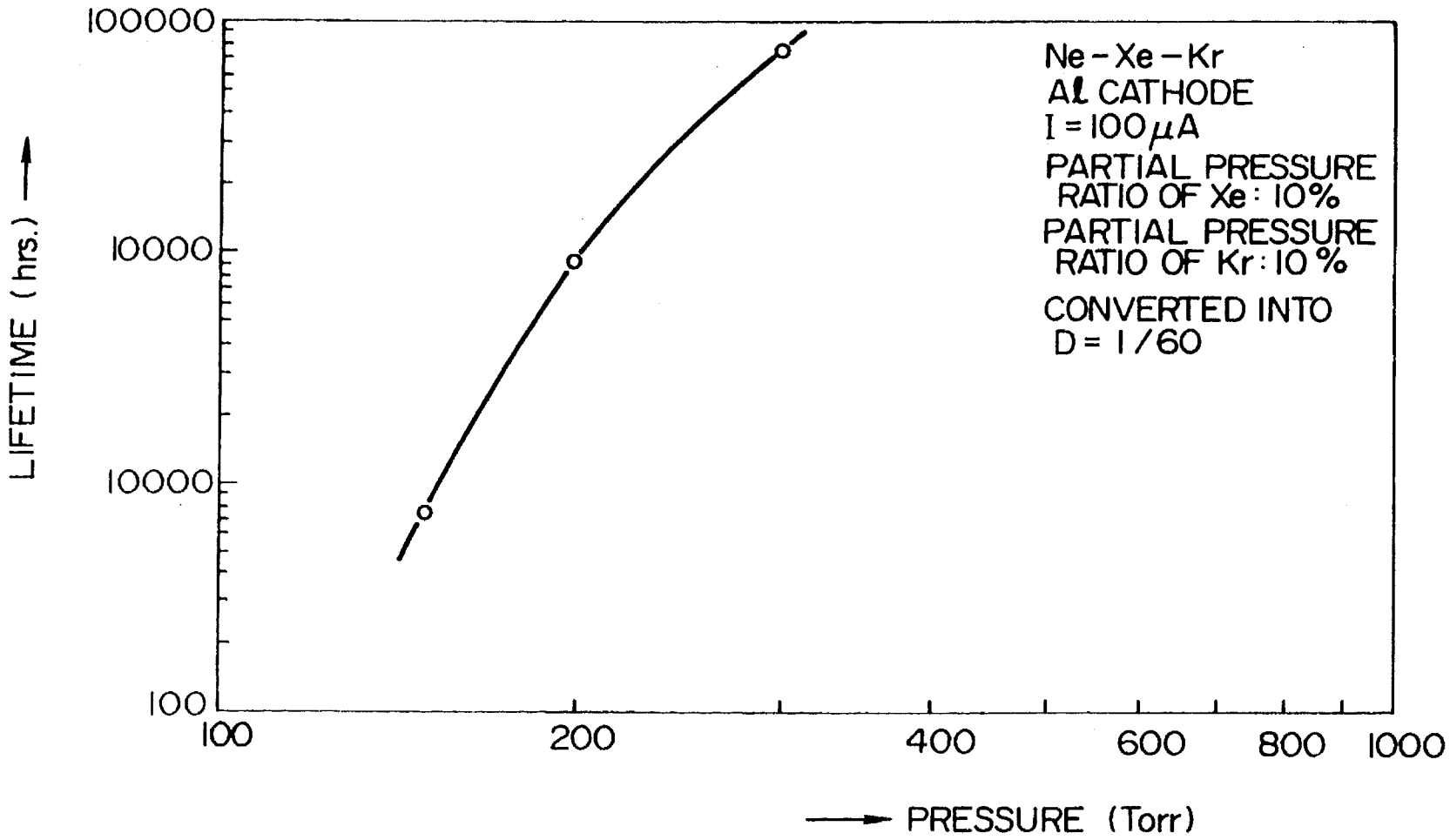
FIG. 14 shows a lifetime-to-pressure characteristic.

Furthermore, when both of the ordinate and abscissa of the graphic representation shown in FIG. 11 were changed into a logarithmic scale, a graphic representation shown in FIG. 12 was obtained. In FIG. 13, there is shown a lifetime-to-pressure characteristic when a He - Xe (10%) - Kr (10%) filling gas (namely, a filling gas composed of a He gas with partial pressure of 80%, a Xe gas with partial pressure of 10%, and a Kr gas with partial pressure of 10%) is filled. Precisely speaking, FIG. 13 represents such a lifetime-to-pressure characteristic that the display panel having the Al cathode and He - Xe (10%) - Kr (10%) filling gas as shown in FIG. 13 is driven in the constant current mode under condition of D=1 and I=100 μA. FIG. 14 indicates a lifetime-to-pressure characteristic of the display panel having the Al cathode and the Ne - Xe (10%) - Kr (10%) filling gas shown in FIGS. 6A and 6B when this panel is driven in the constant current mode under condition of D=1 and I=100 μA. It should be noted that the lifetimes shown in FIGS. 12 to 14 have been converted into those of D=1/60. It could be recognized from the gradients of the curves from FIG. 12 to FIG. 14 that the lifetime of the panel is substantially proportional to $p^5$ to $p^6$ (symbol "p" indicates total pressure of filling gas).

The Applicants of the present invention acquired a large quantity of measurement data as represented from FIGS. 15 to 42.

Figure 15:
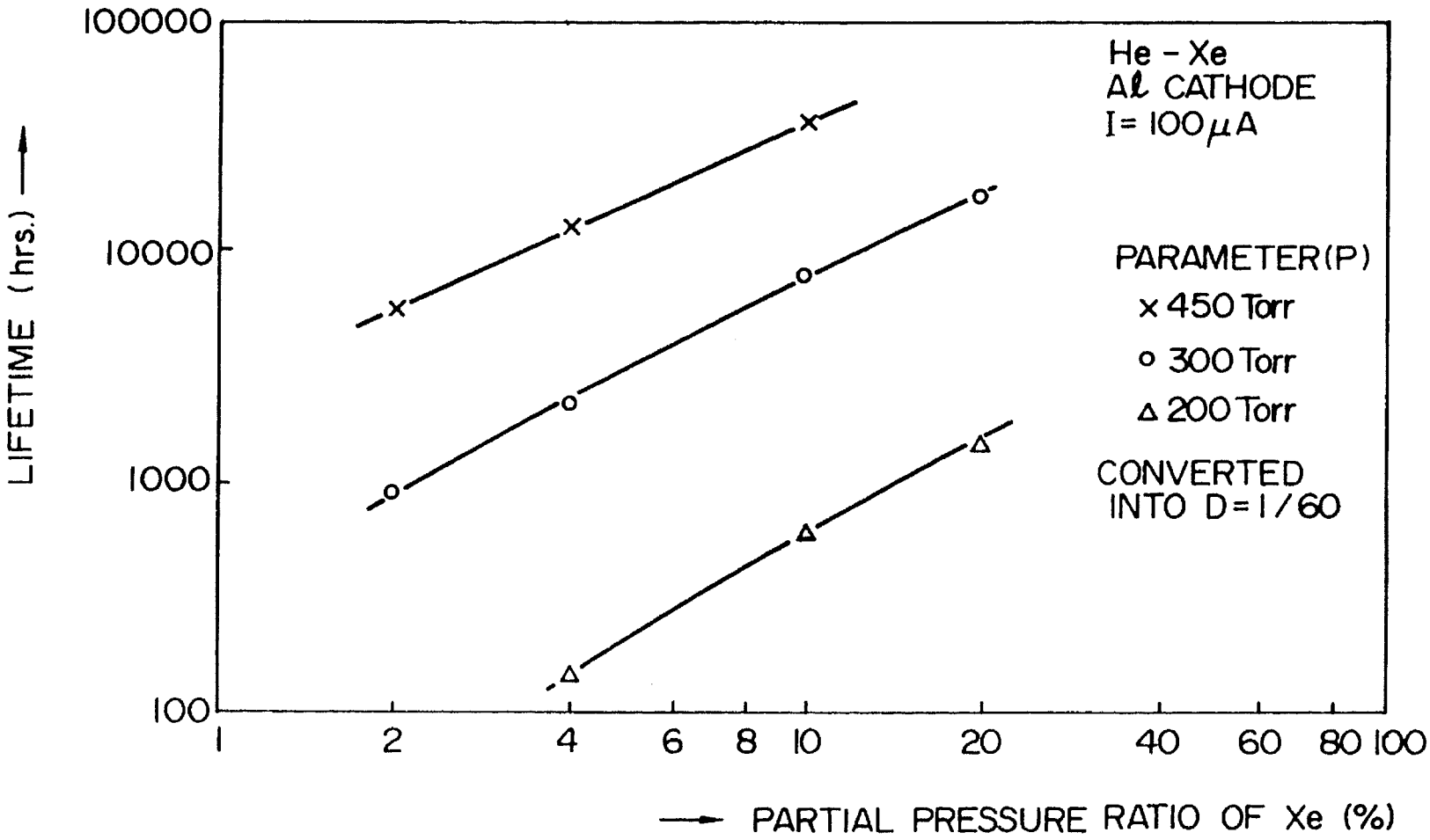
FIG. 15 indicates a lifetime-to-Xe partial pressure ratio characteristic.

FIG. 15 indicates a lifetime-to-Xe-partial pressure ratio characteristic measured when the display panel having the A1 cathode and He-Xe filling gas, as shown in FIGS. 6A and 6B, is driven in the constant current mode under conditions of D=1 and I=100 μA. In FIG. 15, there are shown the characteristics obtained under such conditions that the total pressure "p" of the filling gas is used as the parameter, and the total pressure "P" is selected to be 450 Torr, 300 Torr, and 200 Torr. It should be noted that the lifetimes of the display panel in FIG. 15 have been converted into the lifetimes under D=1/60.

Figure 16:
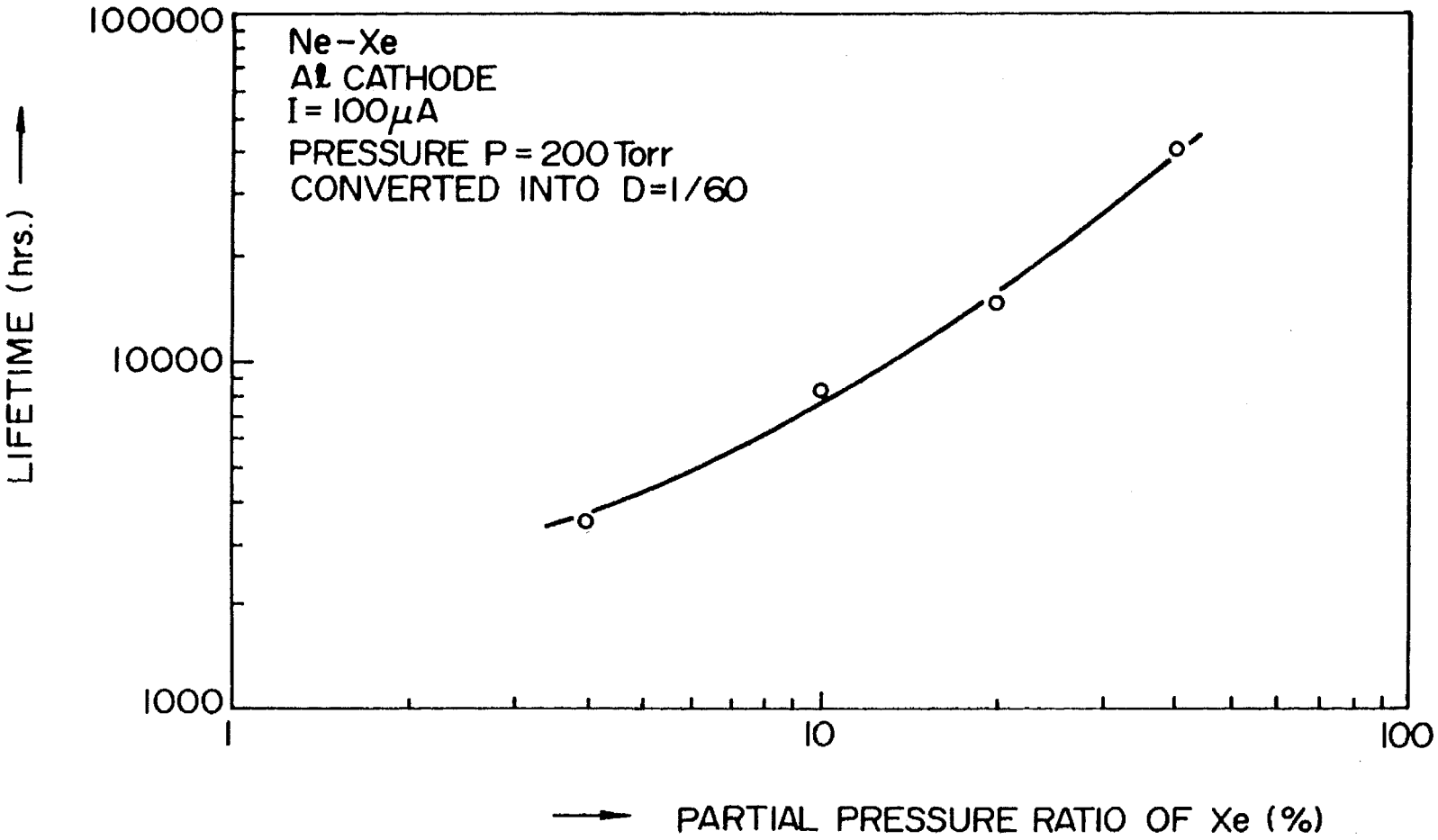
FIG. 16 shows a lifetime-to-Xe partial pressure ratio characteristic.

FIG. 16 shows a lifetime-to-Xe-partial pressure ratio characteristic measured when the display panel having the Al cathode, Ne-Xe filing gas, and total pressure P=200 Torr, as shown in FIGS. 6A and 6B, is driven in the constant current mode under conditions of D=1 and I=100 μA. Note that the lifetimes shown in FIG. 15 have been converted into those of D=1/60.

Figure 17:
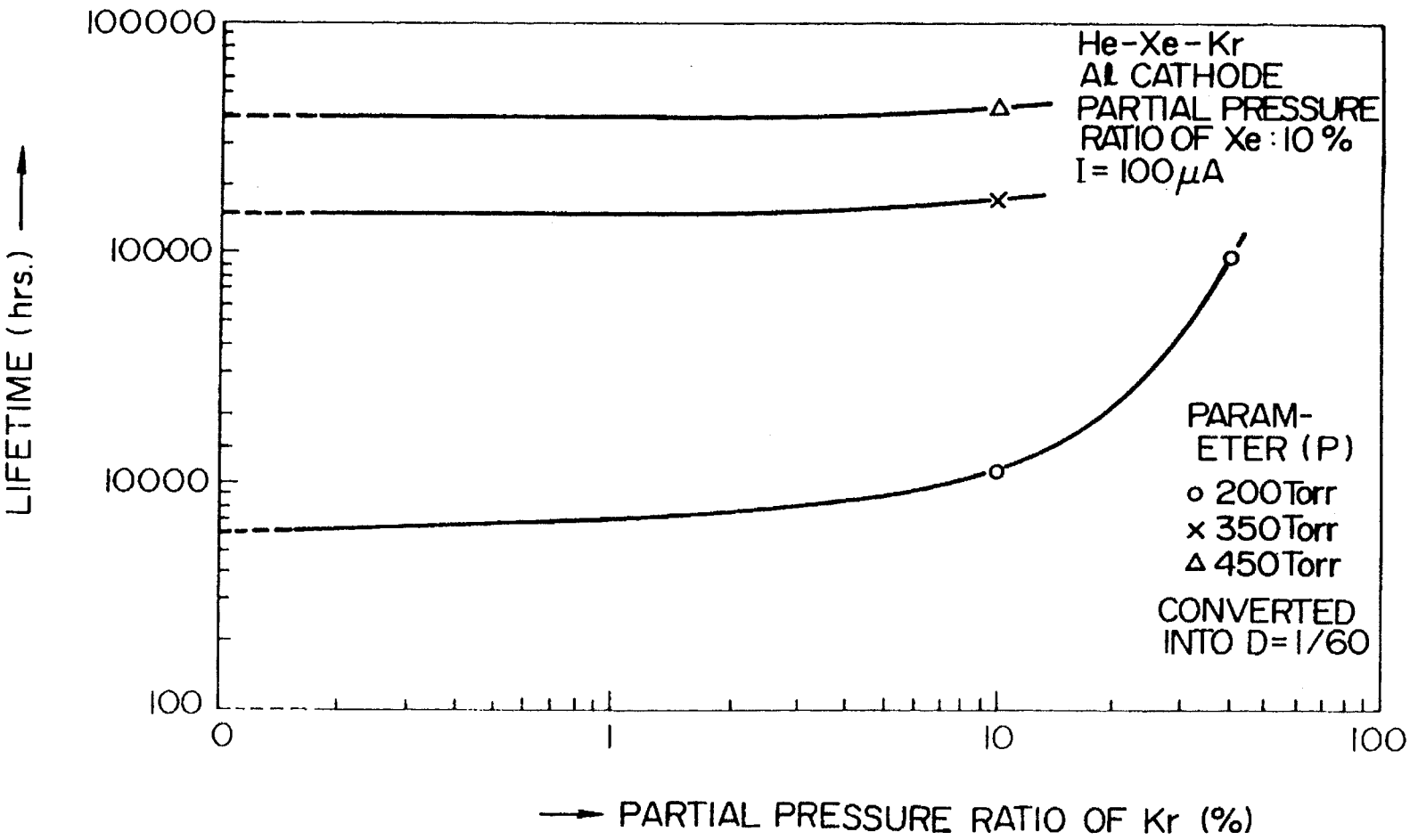
FIG. 17 represents a lifetime-to-Kr partial pressure ratio characteristic.

FIG. 17 indicates a lifetime-to-Kr-partial pressure ratio characteristic measured when the display panel having the A1 cathode and He-Xe (10%) - Kr filling gas, as shown in FIGS. 6A and 6B, is driven in the constant current mode under conditions of D=1 and I=100 μA. In FIG. 17, there are shown the characteristics obtained under such conditions that the total pressure "p" of the filling gas is used as the parameter, and the total pressure "P" is selected to be 200 Torr, 350 Torr, and 450 Torr. It should be noted that the lifetimes of the display panel in FIG. 17 have been converted into the lifetimes under D=1/60.

Figure 18:
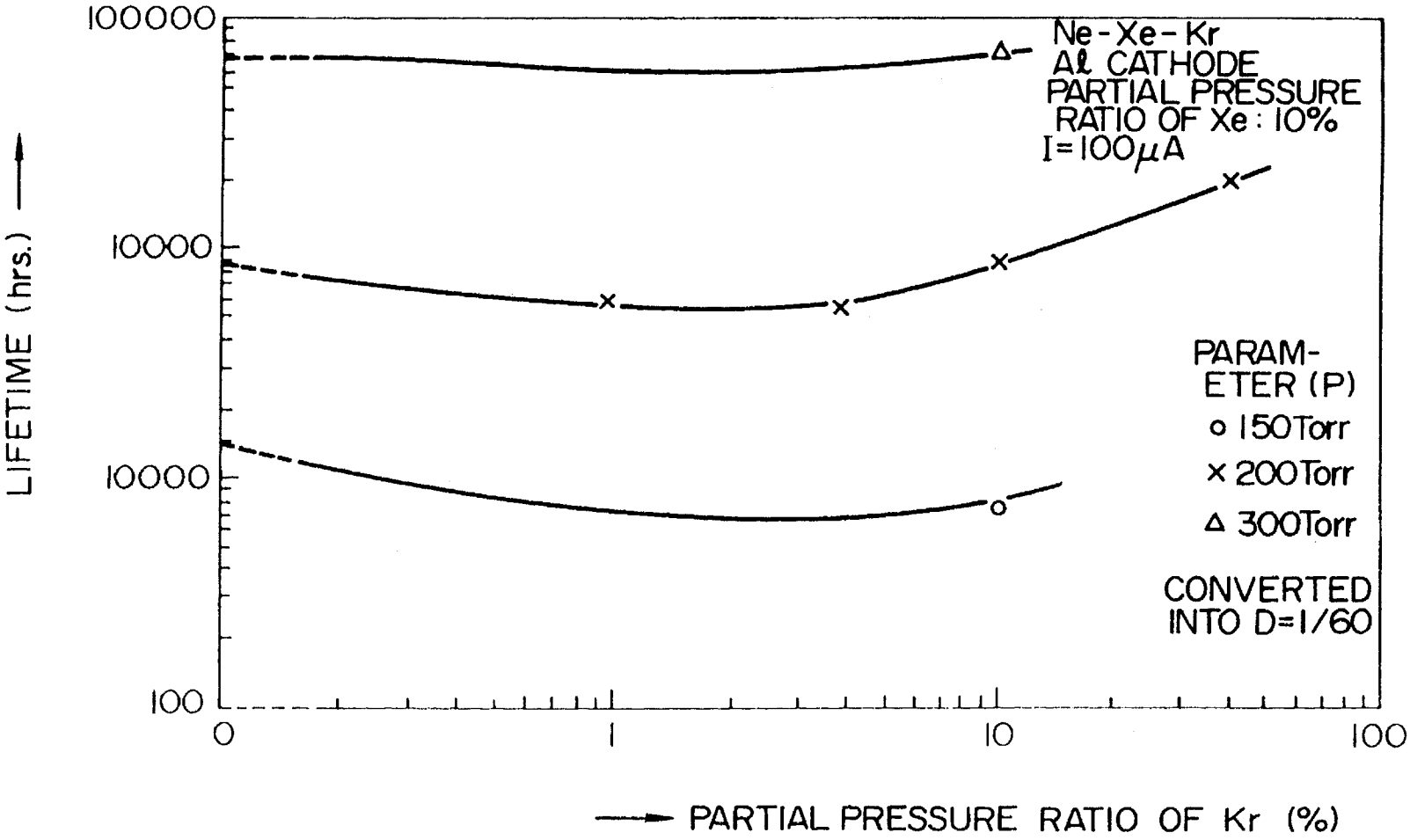
FIG. 18 represents a lifetime-to-Kr partial pressure ratio characteristic.

FIG. 18 indicates a lifetime-to-Kr-partial pressure ratio characteristic measured when the display panel having the A1 cathode and Ne-Xe (10%) - Kr filling gas, as shown in FIGS. 6A and 6B, is driven in the constant current mode under conditions of D=1 and I=100 μA. In FIG. 18, there are shown the characteristics obtained under such conditions that the total pressure "p" of the filling gas is used as the parameter, and the total pressure "P" is selected to be 150 Torr, 200 Torr, and 300 Torr. It should be noted that the lifetimes of the display panel in FIG. 18 have been converted into the lifetimes under D=1/60.

Figure 19:
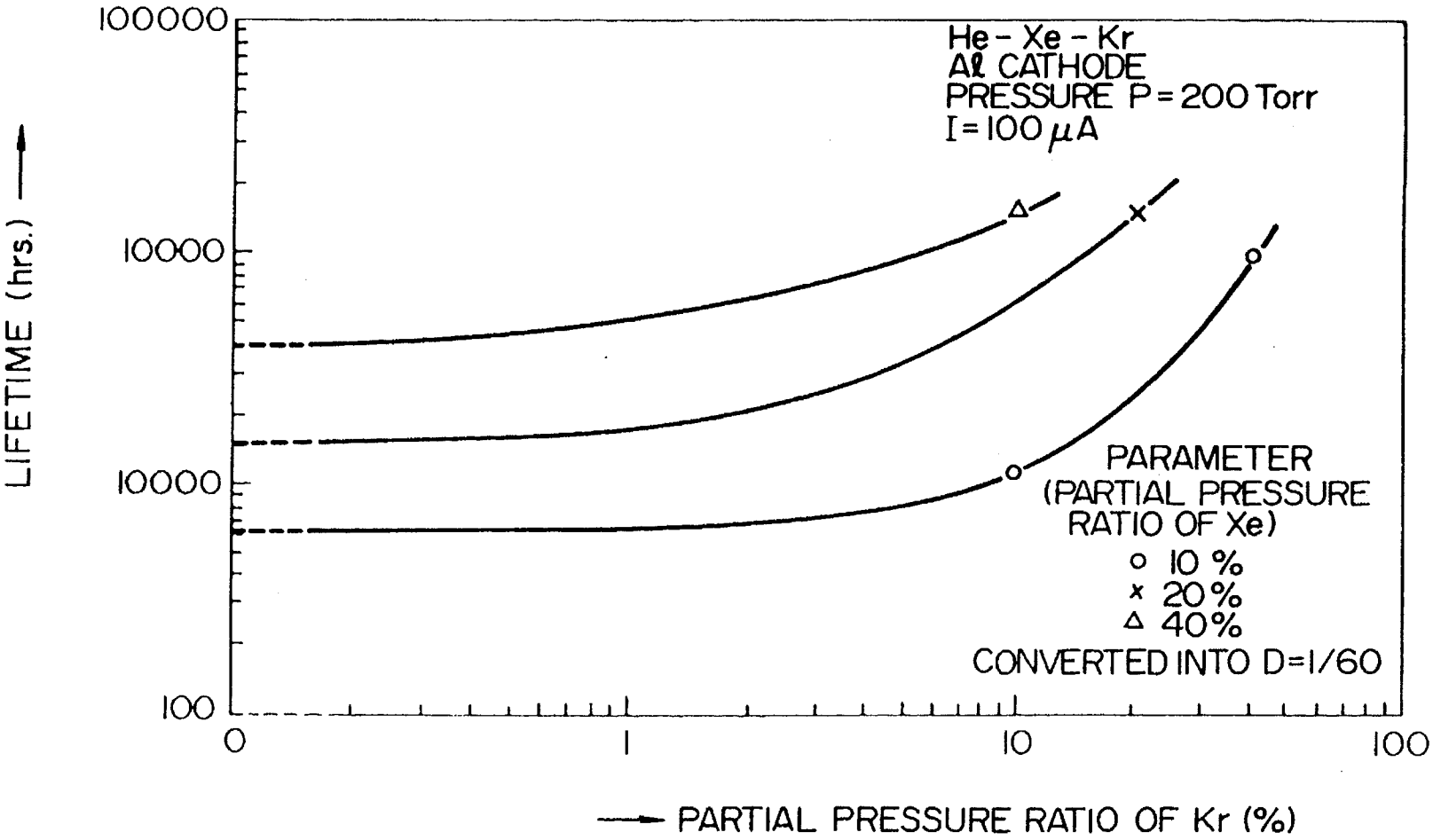
FIG. 19 represents a lifetime-to-Kr partial pressure ratio characteristic.

FIG. 19 shows a lifetime-to-Kr-partial pressure ratio characteristic measured when the display panel having the A1 cathode, He-Xe-Kr filing gas, and total pressure P=200 Torr, as shown in FIGS. 6A and 6B, is driven in the constant current mode under conditions of D=1 and I=100 μA. in FIG. 19, there are shown the characteristics measured under such conditions that the partial pressure ratio of the Xe gas is used as a parameter, and this partial pressure ratio is selected to be 10%, 20% and 40%. Note that the lifetimes shown in FIG. 19 have been converted into those of D=1/60.

Figure 20:
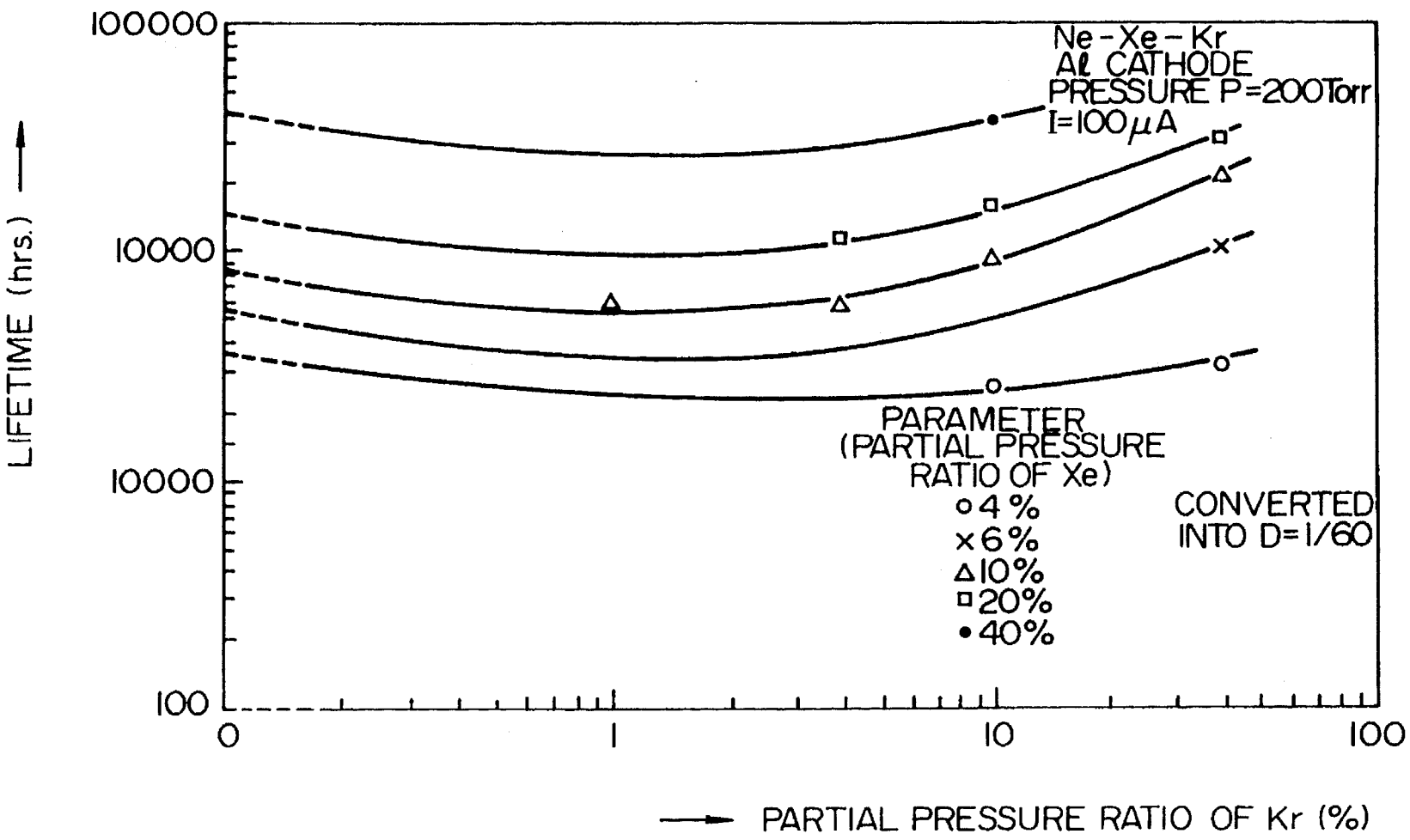
FIG. 20 represents a lifetime-to-Kr partial pressure ratio characteristic.

FIG. 20 indicates a lifetime-to-Kr-partial pressure ratio characteristic measured when the display panel having the Al cathode, Ne-Xe-Kr filling gas, and P=200 Torr, as shown in FIGS. 6A and 6B, is driven in the constant current mode under conditions of D=1 and I=100 μA. In FIG. 20, there are shown characteristics when the partial pressure ratio of the Xe gas is used as a parameter, and this partial pressure is selected to be 4%, 6%, 10%, 20% and 40%. It should be noted that the lifetimes of the display panel in FIG. 20 have been converted into the lifetimes under D=1/60.

Figure 21:
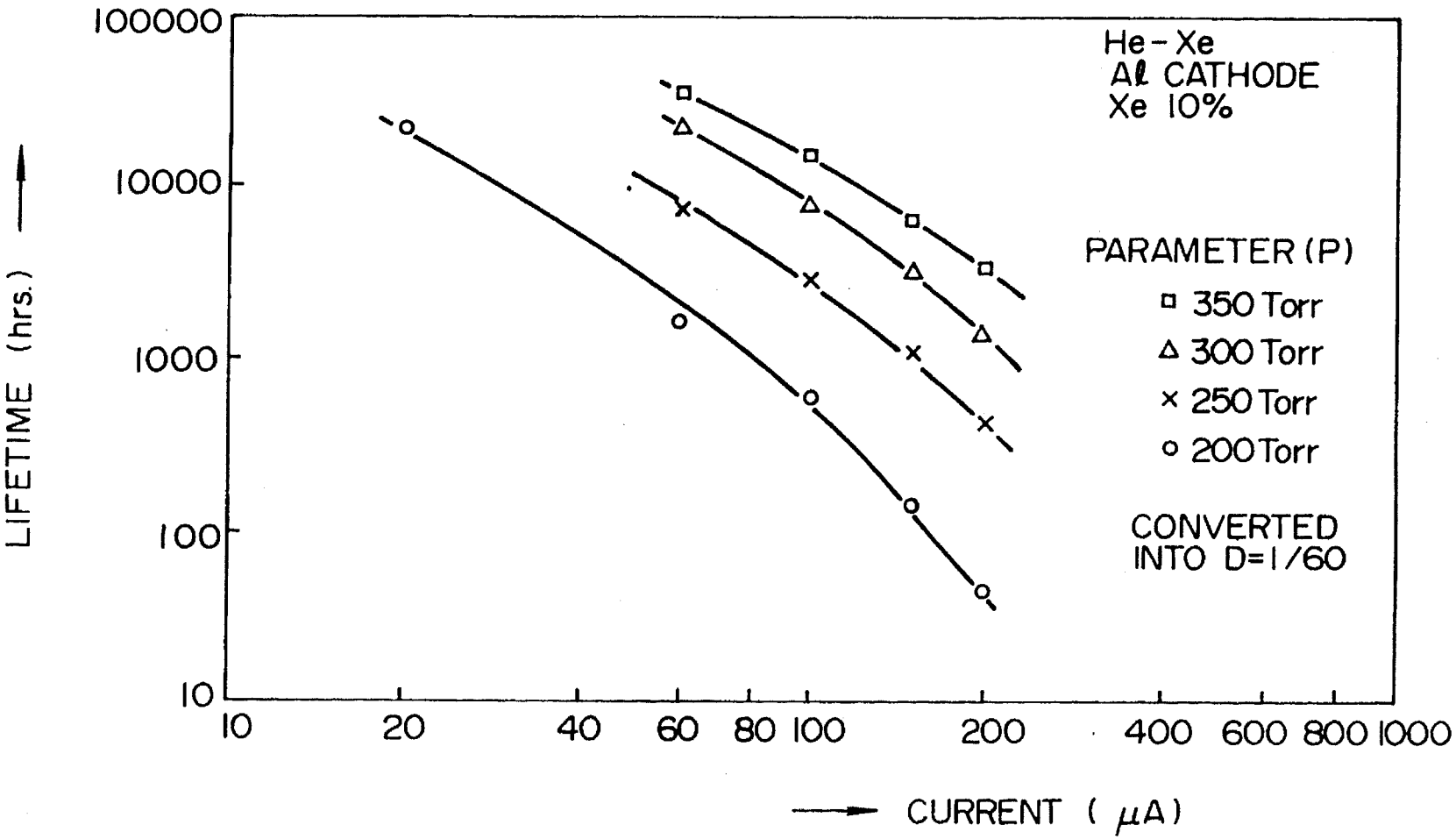
FIG. 21 shows a lifetime-to-current characteristic.

FIG. 21 indicates a lifetime-to-current characteristic measured when the display panel having the Al cathode and He-Xe (10%) filling gas, as shown in FIGS. 6A and 6B, is driven in the constant current mode under condition of D=1. In FIG. 21, there are shown the characteristics obtained under such conditions that the total pressure "p" of the filling gas is used as the parameter, and the total pressure "P" is selected to be 350 Torr, 300 Torr, 250 Torr and 200 Torr. It should be noted that the lifetimes of the display panel in FIG. 21 have been converted into the lifetimes under D=1/60.

Figure 22:
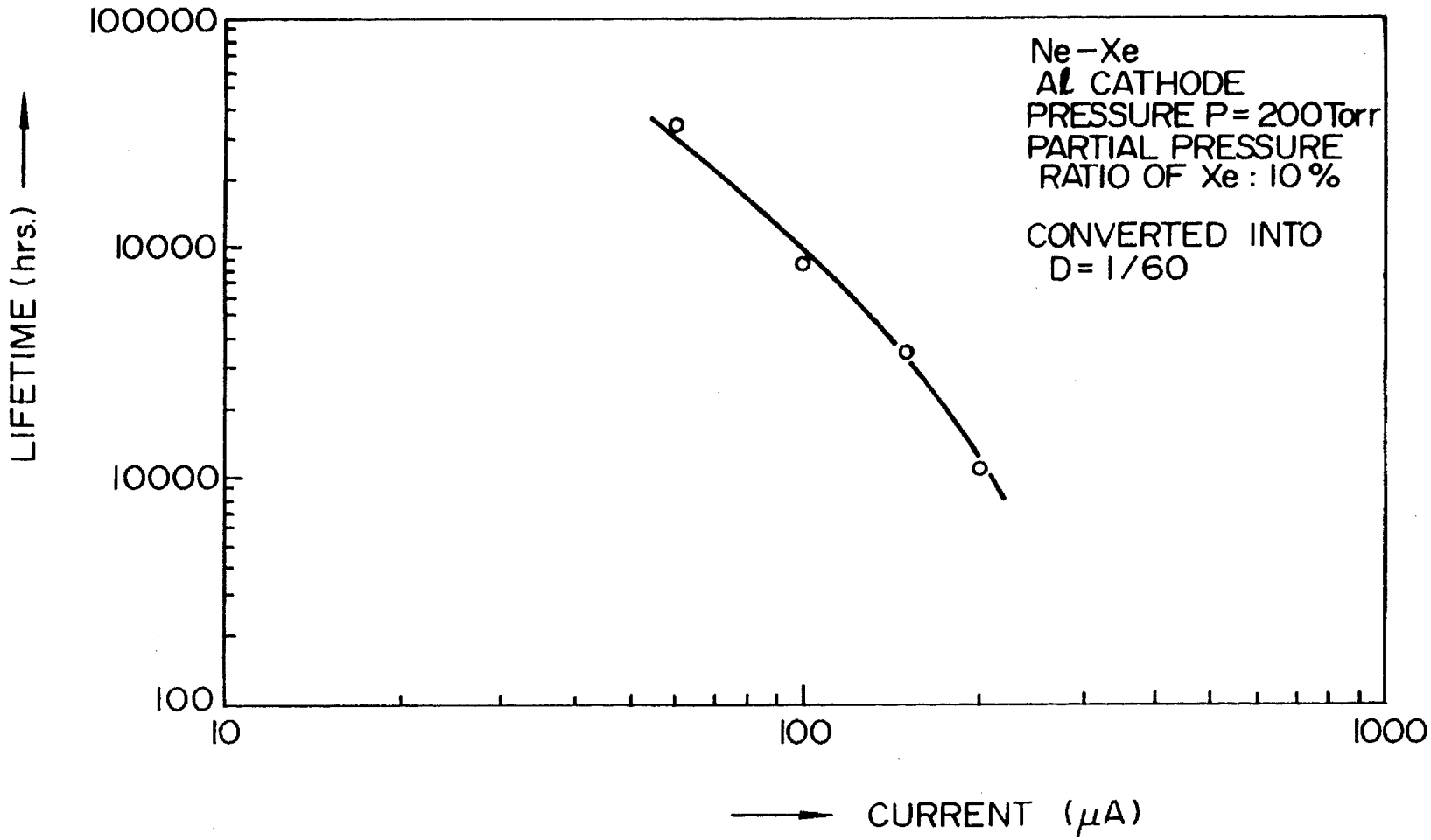
FIG. 22 shows a lifetime-to-current characteristic.

FIG. 22 shows a lifetime-to-current characteristic measured when the display panel having the Al cathode, Ne-Xe (10%) filing gas, and total pressure P=200 Torr, as shown in FIGS. 6A and 6B, is driven in the constant current mode under conditions of D=1. Note that the lifetimes shown in FIG. 22 have been converted into those of D=1/60.

Figure 23:
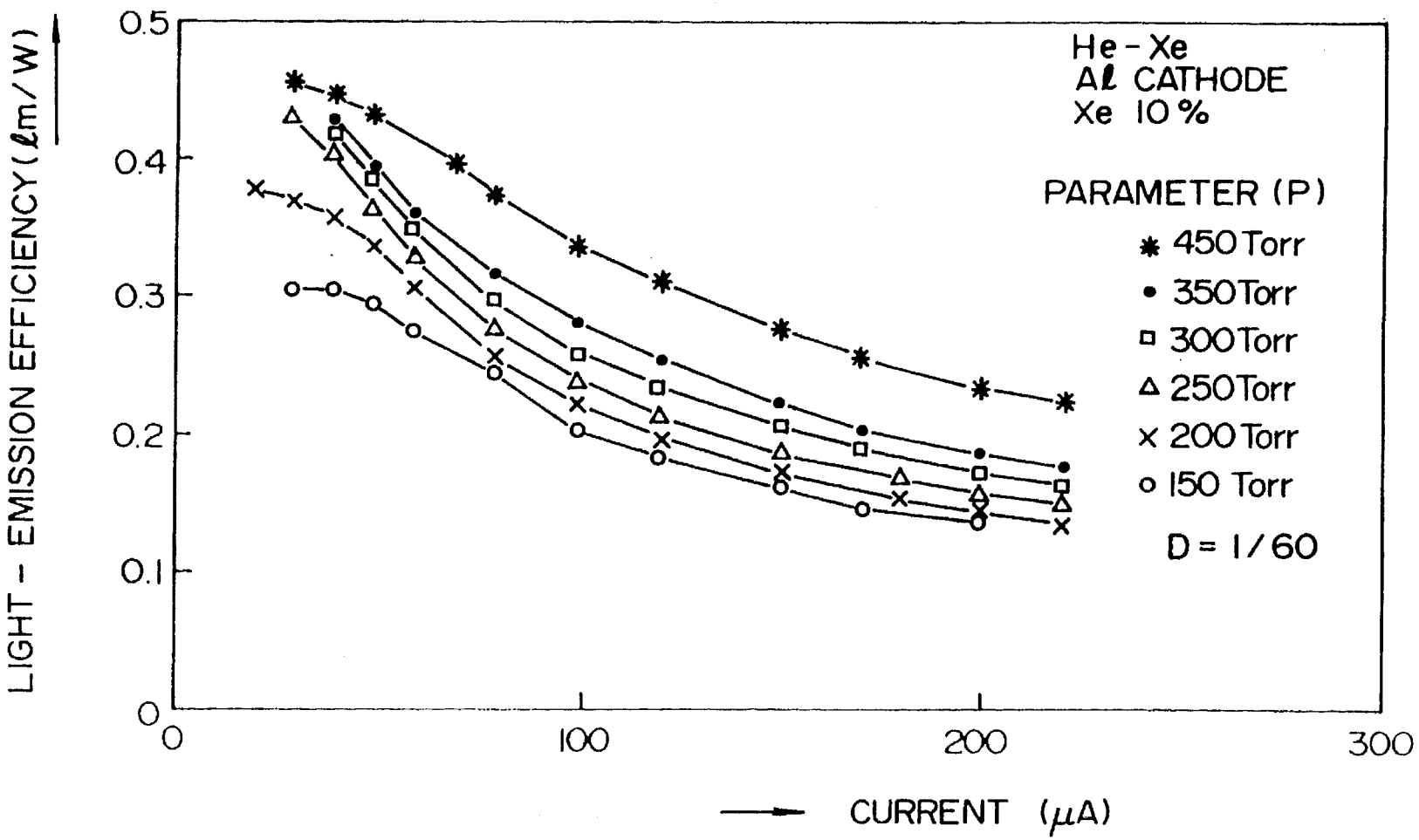
FIG. 23 indicates a light-emission efficiency-to-current characteristic.

FIG. 23 indicates light-emission efficiency-to-current a characteristic measured when the display panel having the A1 cathode and He-Xe (10%) filling gas, as shown in FIGS. 6A and 6B, is driven in the constant current mode under conditions of D=1/60. In FIG. 23, there are shown the characteristics obtained under such conditions that the total pressure "p" of the filling gas is used as the parameter, and the total pressure "P" is selected to be 450 Torr, 350 Torr, 300 Torr, 250 Torr, 200 Torr, and 150 Torr.

Figure 24:
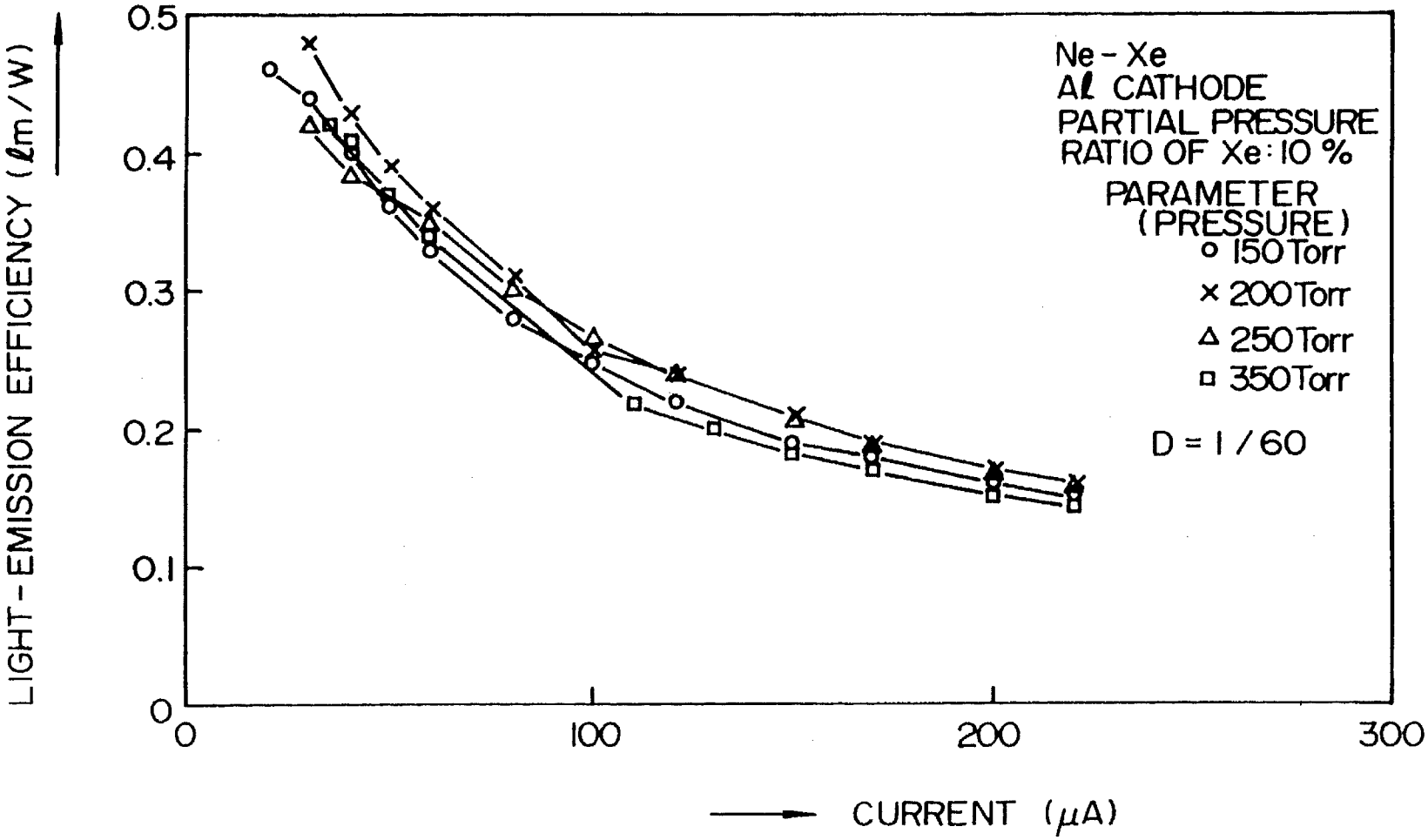
FIG. 24 indicates a light-emission efficiency-to-current characteristic.

FIG. 24 indicates light-emission efficiency-to current a characteristic measured when the display panel having the Al cathode and Ne-Xe (10%) filling gas, as shown in FIGS. 6A and 6B, is driven in the constant current mode under condition of D=1/60. In FIG. 24, there are shown the characteristics obtained under such conditions that the total pressure "p" of the filling gas is used as the parameter, and the total pressure "P" is selected to be 150 Torr, 200 Torr, 250 Torr, and 350 Torr.

Figure 25:
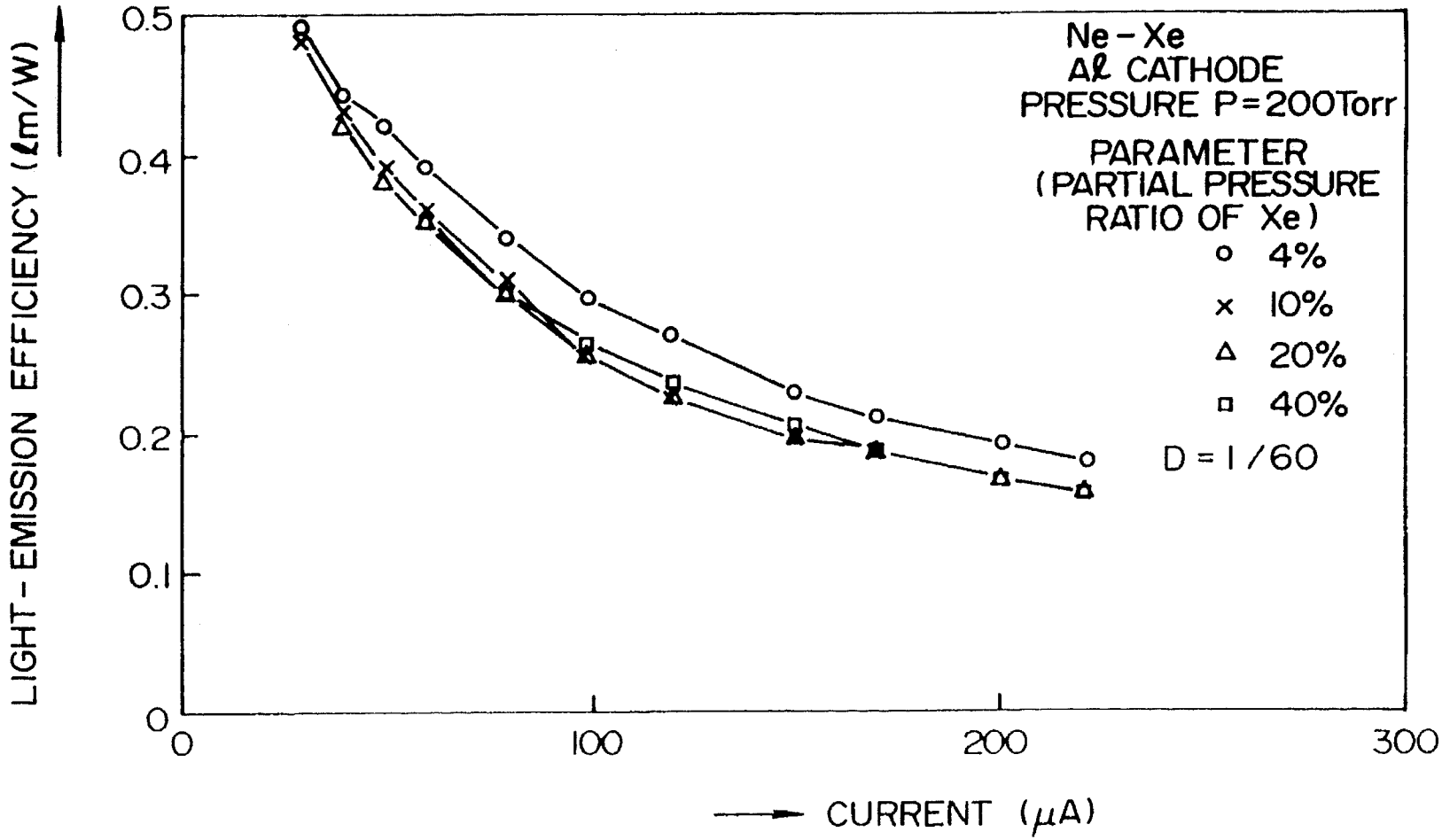
FIG. 25 indicates a light-emission efficiency-to-current characteristic.

FIG. 25 indicates a light-emission efficiency-to-current characteristic measured when the display panel having the Al cathode, Ne-Xe filling gas, and P=200 Torr, as shown in FIGS. 6A and 6B, is driven in the constant current mode under condition, of D=1/60. In FIG. 25, there are shown characteristics obtained when the partial pressure ratio of the Xe gas is used as the parameter, and this partial pressure ratio is selected to be 4%, 10%, 20% and 40%.

Figure 26:
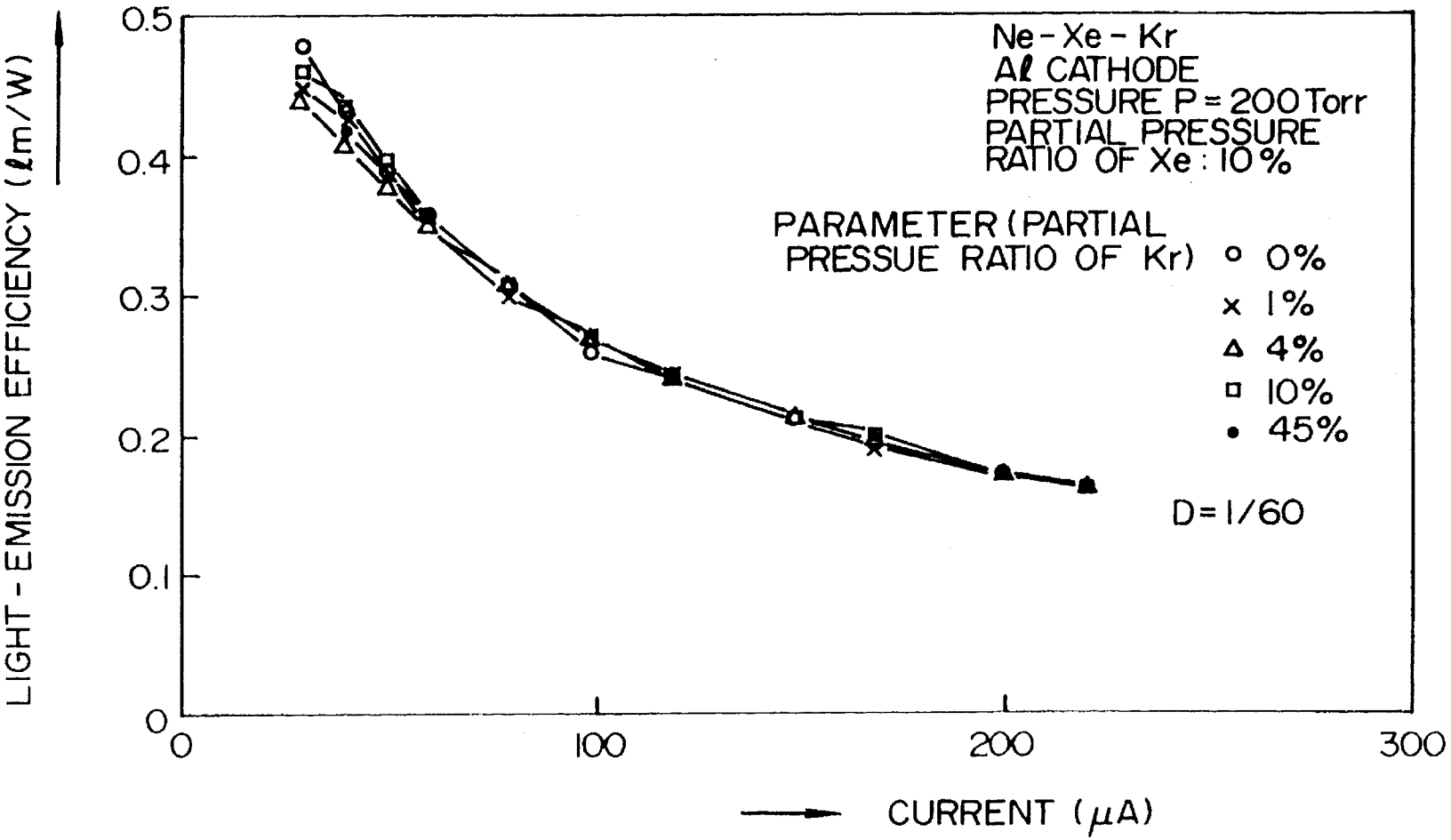
FIG. 26 indicates a light-emission efficiency-to-current characteristic.

FIG. 26 represents a light-emission efficiency-to-current characteristic measured when the display panel having the Al cathode, Ne-Xe (10%) - Kr filling gas, and p=200 Torr, as shown in FIGS. 6A and 6B, is driven in the constant current mode under condition of D=1/60. In FIG. 26, there are shown characteristic obtained when the partial pressure ratio of the kr gas is used as the parameter, and this partial pressure is selected to be 0%, 1%, 4% 10% and 45%.

Figure 27:
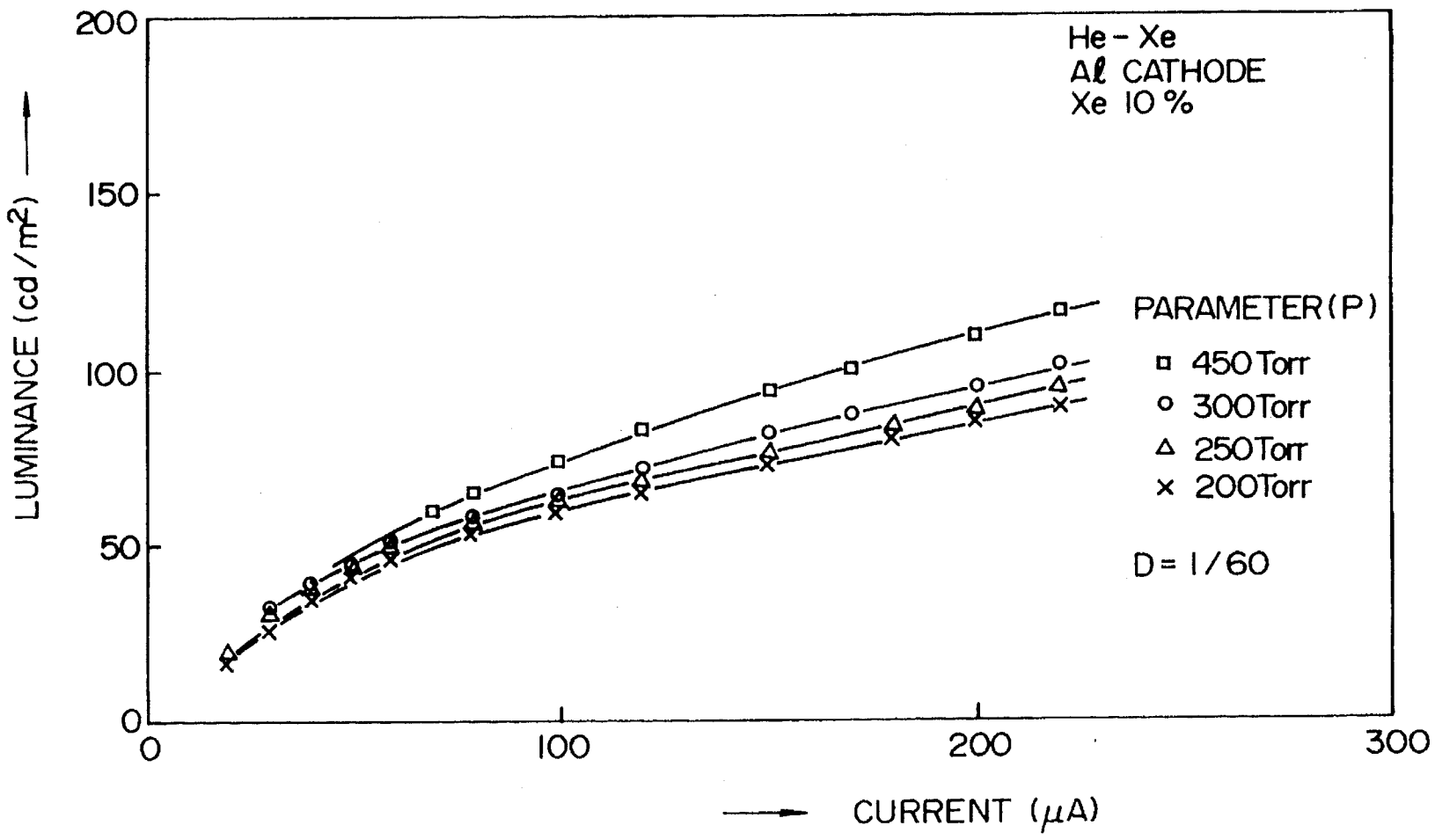
FIG. 27 indicates a luminance-to-current characteristic.

FIG. 27 represents a luminance-to-current characteristic measured when the display panel having the A1 cathode, and He-Xe (10%) filling gas, as shown in FIGS. 6A and 6B, is driven in the constant current mode under condition of D=1/60. In FIG. 27, there are shown the characteristics obtained under such conditions that the total pressure "p" of the filling gas is used as the parameter, and the total pressure "p" is selected to be 450 Torr, 300 Torr, 250 Torr, and 200 Torr.

Figure 28:
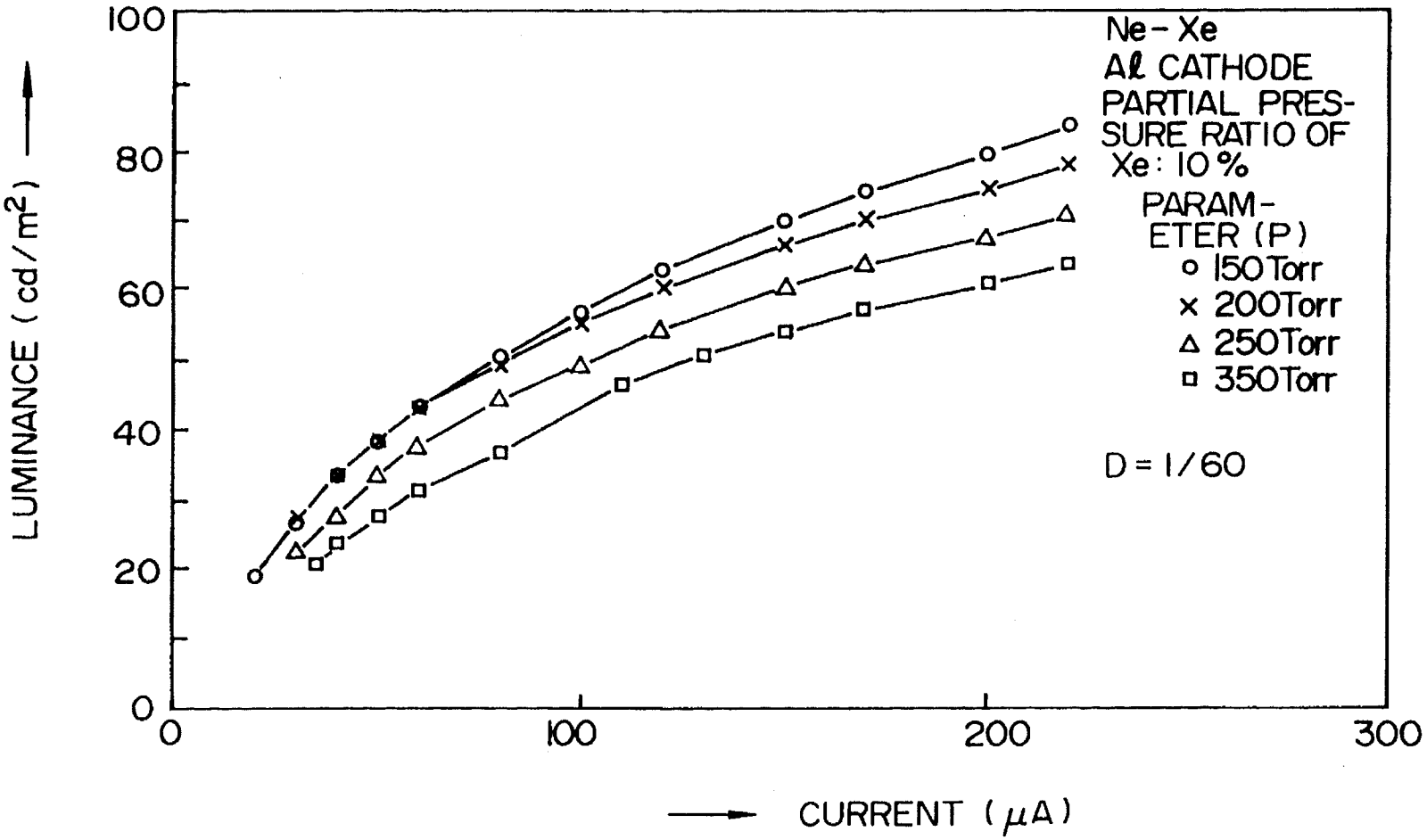
FIG. 28 indicates a luminance-to-current characteristic.

FIG. 28 represents a luminance-to-current characteristic measured when the display panel having the Al cathode, and Ne-Xe (10%) filling gas, as shown in FIGS. 6A and 6B, is driven in the constant current mode under condition of D=1/60. In FIG. 28, there are shown the characteristics obtained under such conditions that the total pressure "p" of the filling gas is used as the parameter, and the total pressure "p" is selected to be 150 Torr, 200 Torr, 250 Torr and 350 Torr.

Figure 29:
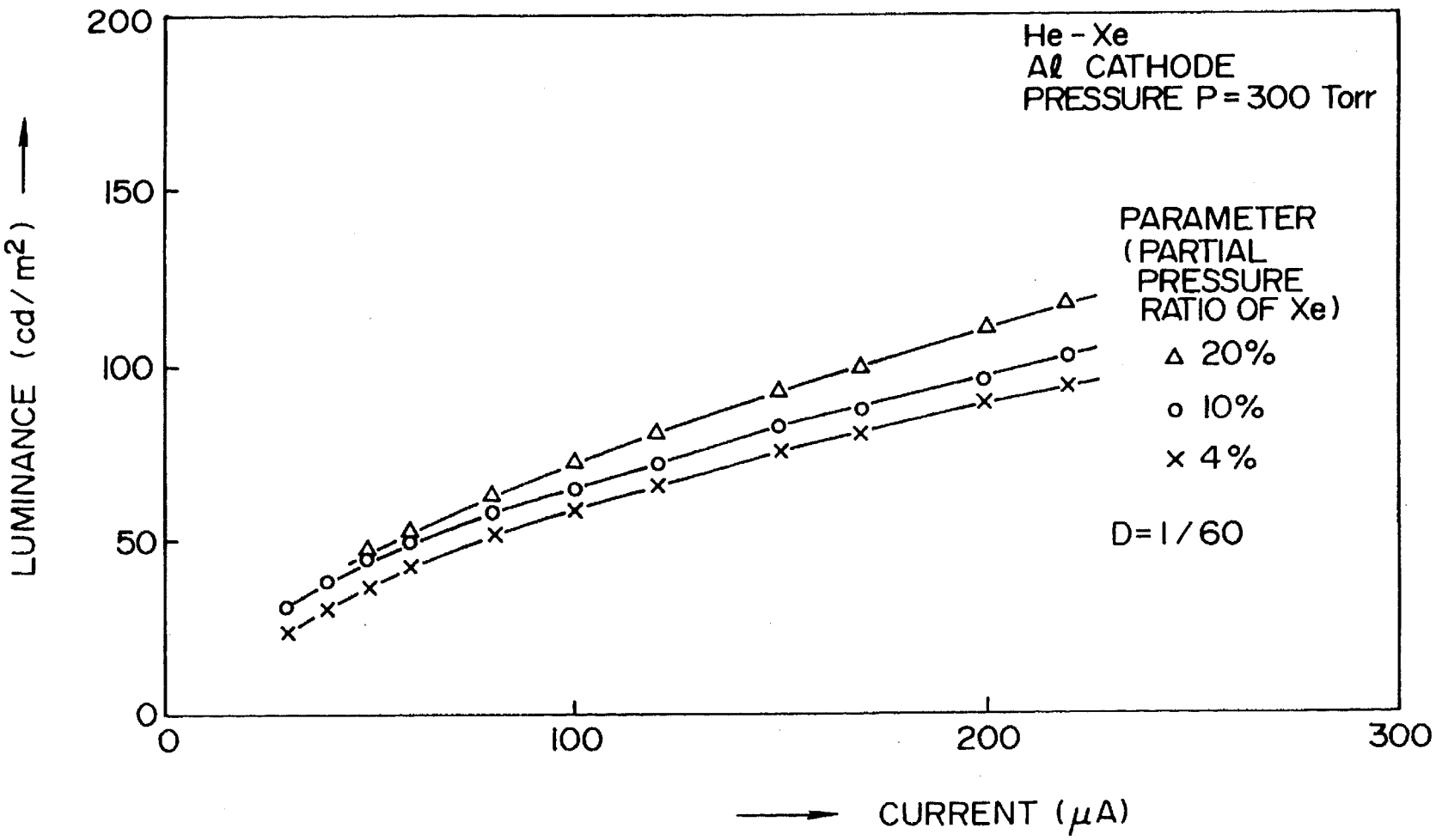
FIG. 29 indicates a luminance-to-current characteristic.

FIG. 29 indicates a luminance-to-current characteristic measured when the display panel having the Al cathode and He-Xe filling gas, and P=300 Torr, as shown in FIGS. 6A and 6B, is driven in the constant current mode under conditions of D=1/60. In FIG. 29, there are shown characteristics obtained when the partial pressure ratio of the Xe gas is used as the parameter, and this partial pressure is selected to be 20%, 10% and 4%.

Figure 30:
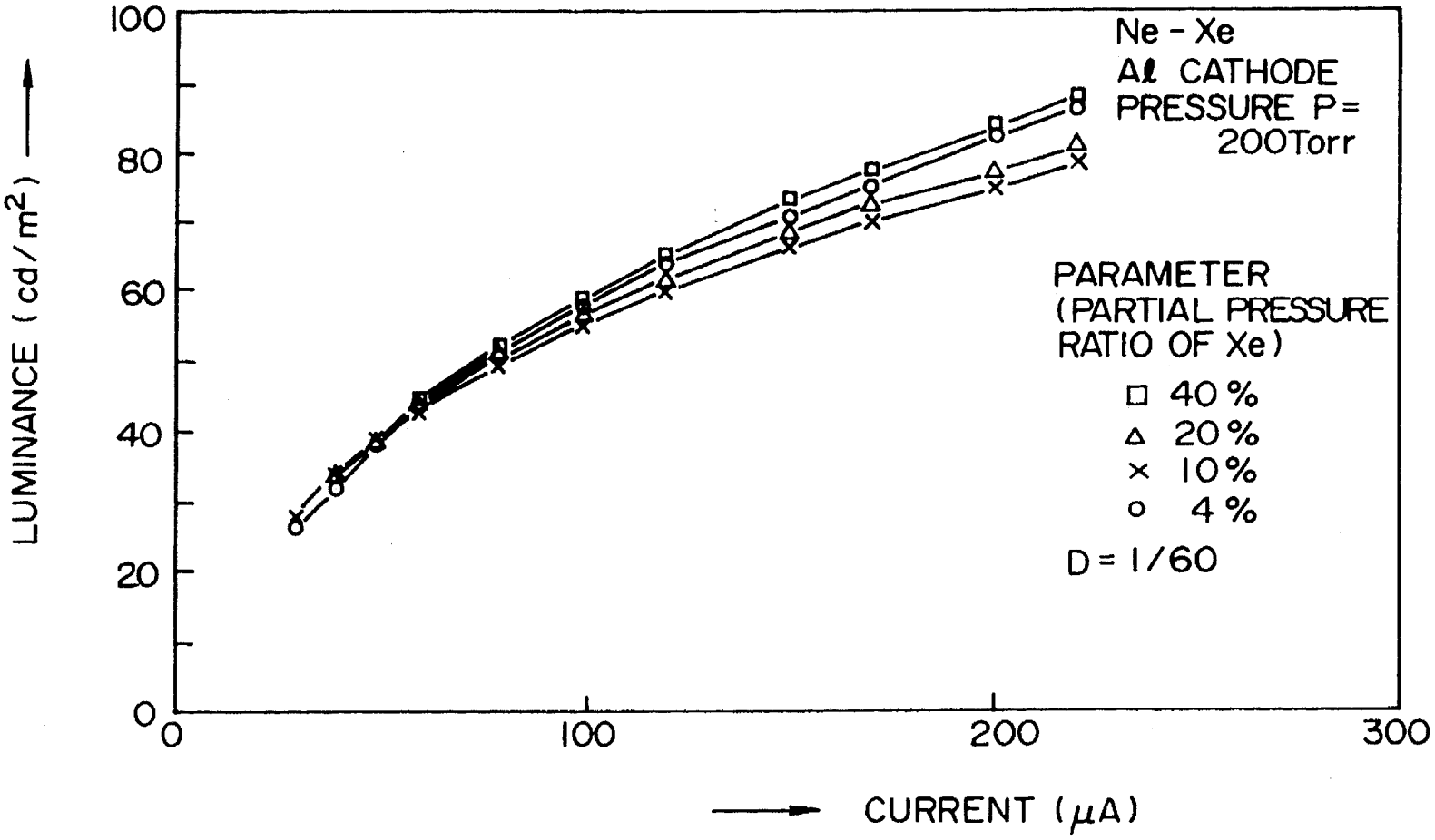
FIG. 30 indicates a luminance-to-current characteristic.

FIG. 30 represents a luminance-to-current characteristic measured when the display panel having the A1 cathode, Ne-Xe filling gas, and p=200 Torr, as shown in FIGS. 6A and 6B, is driven in the constant current mode under condition of D=1/60. In FIG. 30, there are shown characteristics obtained when the partial pressure ratio of the Xe gas is used as the parameter, and this partial pressure is selected to be 40%, 20%, 10% and 4%.

Figure 31:
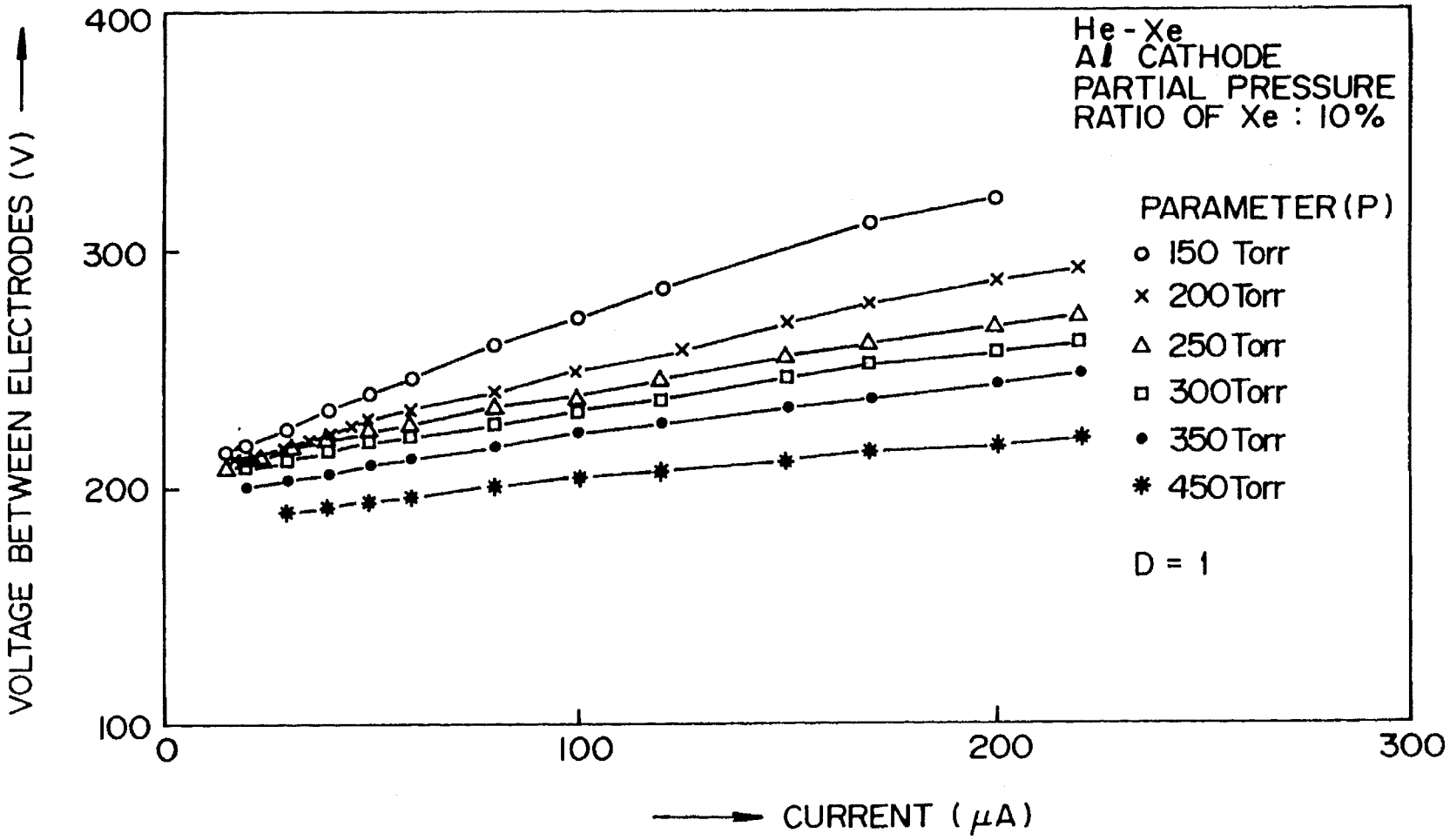
FIG. 31 shows an electrode voltage-to-current characteristic.

FIG. 31 indicates a voltage between electrodes (voltage between anode and cathode of discharge cell)-to-current characteristic measured when the display panel having the Al cathode and He-Xe (10%) filling gas, as shown in FIGS. 6A and 6B, is driven in the constant current mode under condition of D=1. In FIG. 31, there are shown the characteristics obtained under such conditions that the total pressure "p" of the filling gas is used as the parameter, and the total pressure "P" is selected to be 150, 200, 250, 300, 350 and 450 Torr.

Figure 32:
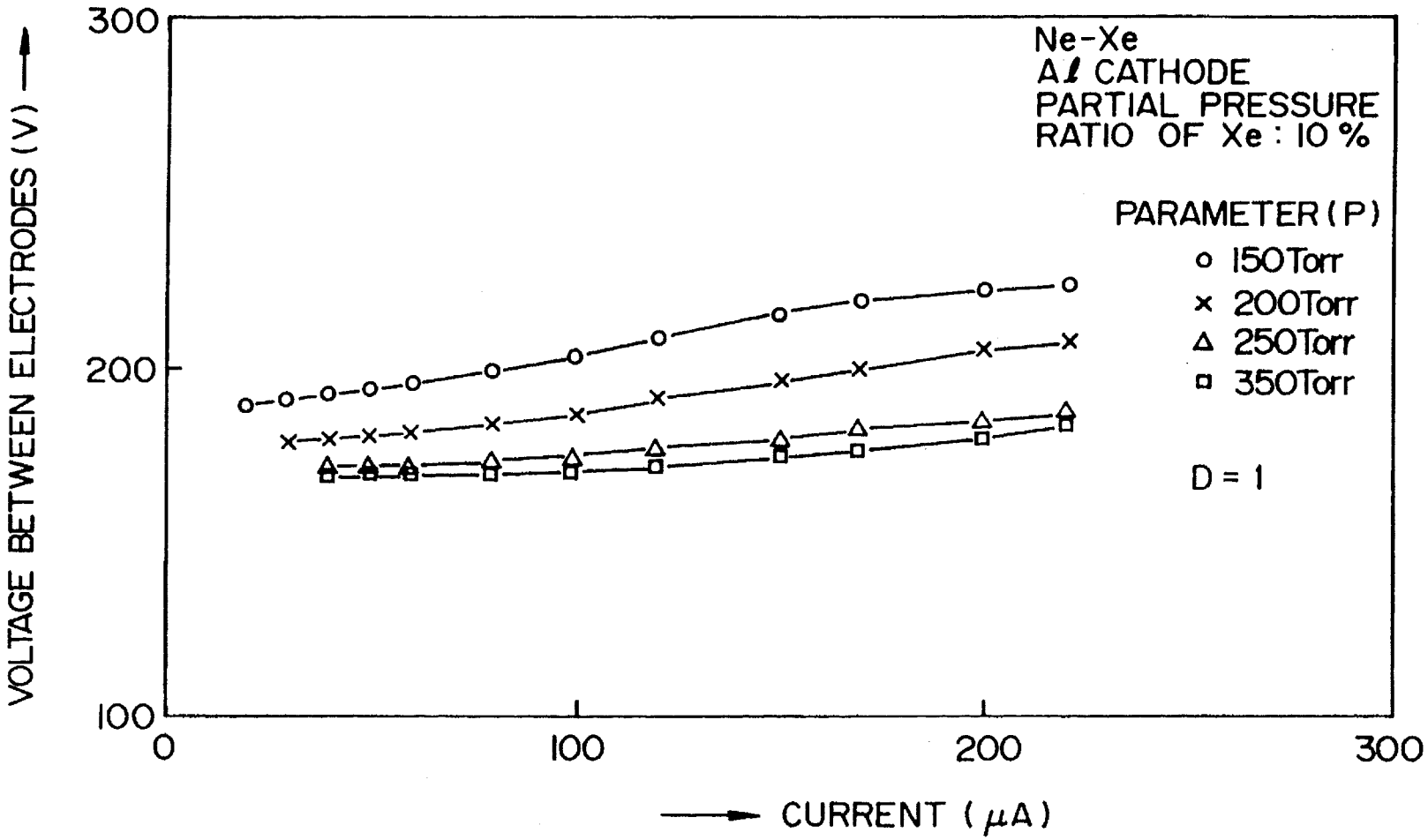
FIG. 32 shows an electrode voltage-to-current characteristic.

FIG. 32 indicates a voltage between electrodes-to-current characteristic measured when the display panel having the Al cathode and Ne-Xe (10%) filling gas, as shown in FIGS. 6A and 6B, is driven in the constant current mode under conditions of D=1. In FIG. 32, there are shown the characteristics obtained under such conditions that the total pressure "p" of the filling gas is used as the parameter, and the total pressure "P" is selected to be 150, 200, 250 and 350 Torr.

Figure 33:
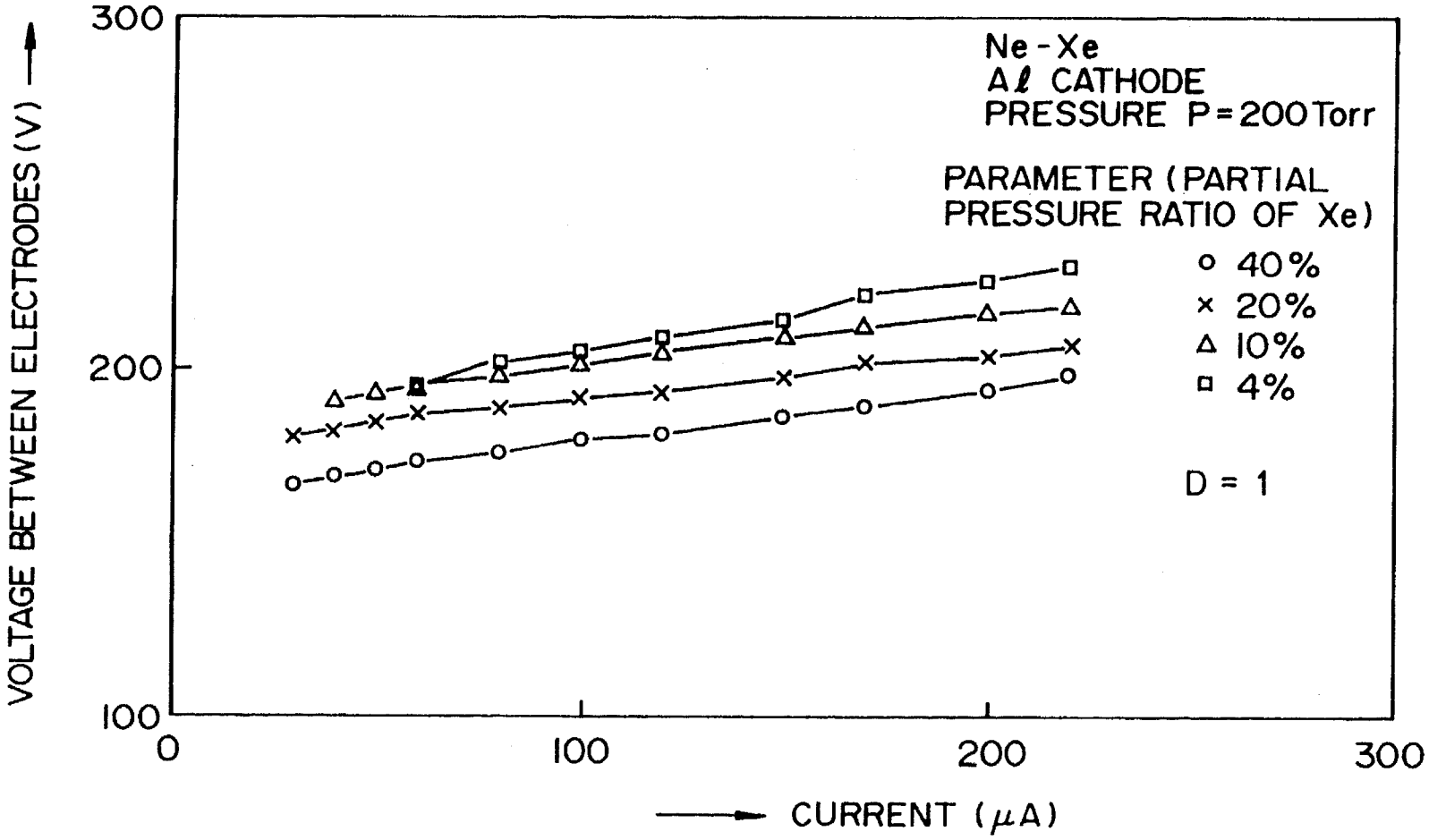
FIG. 33 shows an electrode voltage-to-current characteristic.

FIG. 33 represents a voltage across electrodes-to-current characteristic measured when the display panel having the A1 cathode, Ne-Xe filling gas, and p=200 Torr, as shown in the constant current mode under condition of D=1. In FIG. 33, there are shown characteristic obtained when the partial pressure ratio of the Xe gas is used as the parameter, and this partial pressure ratio is selected to be 40%, 20%, 10% and 4%.

Figure 34:
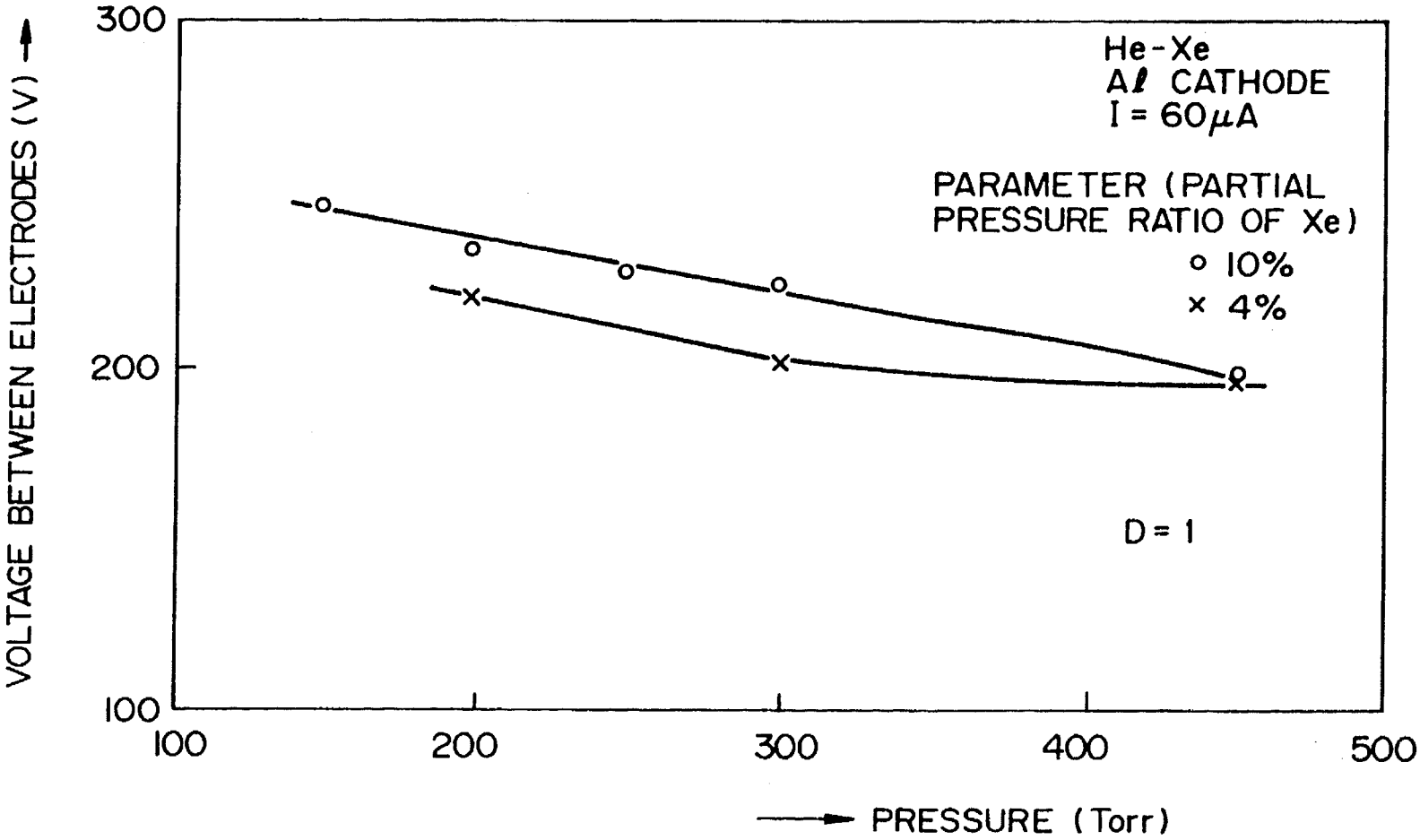
FIG. 34 shows an electrode voltage-to-current characteristic.

FIG. 34 indicates a voltage between electrodes-to-pressure (total pressure of filling gas) characteristic measured when the display panel having the Al cathode and He-Xe filling gas, as shown in FIGS. 6A and 6B, is driven in the constant current mode under conditions of D=1and I=60 μA. In FIG. 34, there are shown characteristics obtained when the partial pressure ratio of the Xe gas is used as the parameter, and this partial pressure ratio is selected to be 10% and 4%.

Figure 35:
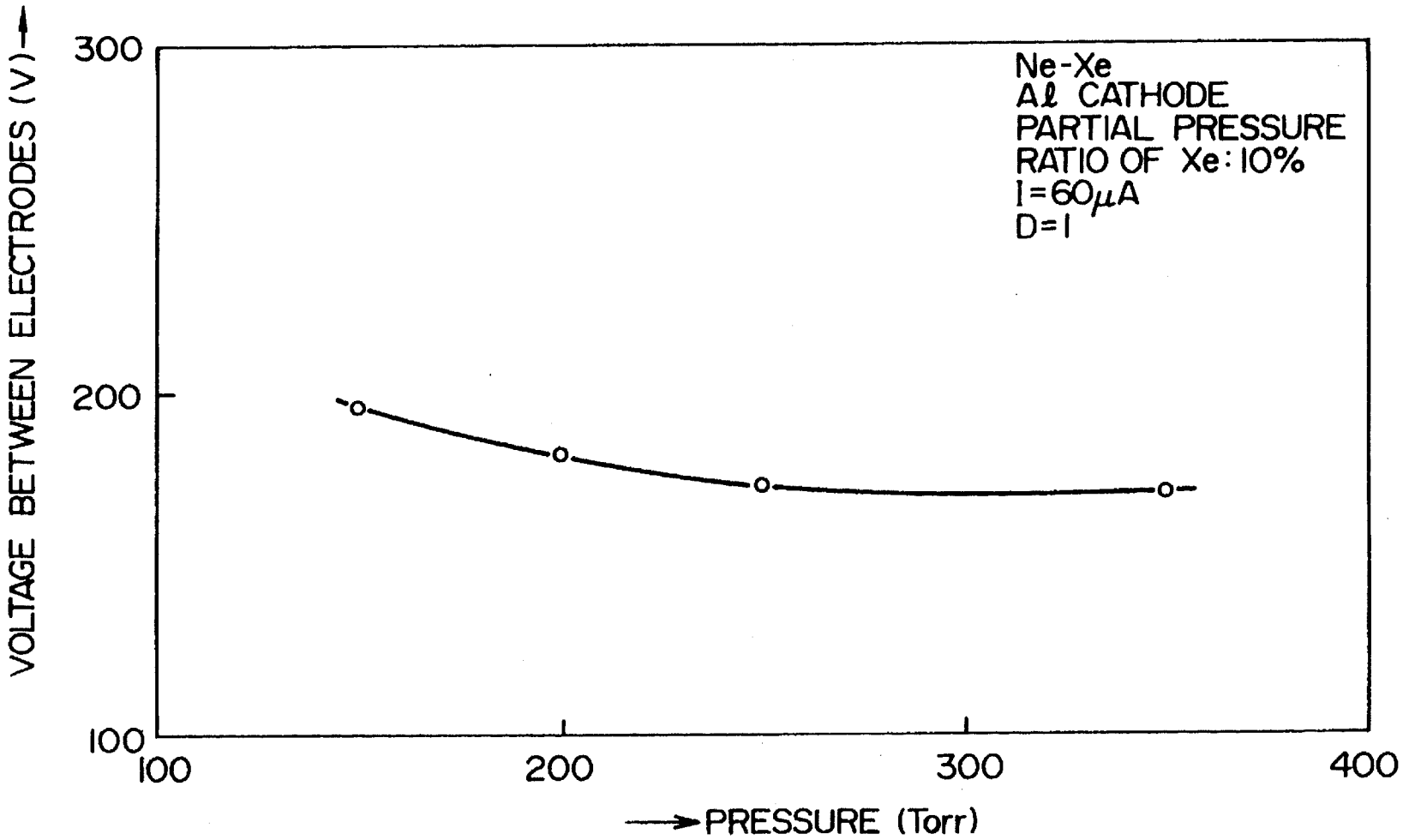
FIG. 35 shows an electrode voltage-to-current characteristic.

FIG. 35 indicates a voltage between electrodes-to-pressure characteristic measured when the display panel having the A1 cathode and Ne-Xe (10%) filling gas, as shown in FIGS. 6A and 6B, is driven in the constant current mode under conditions of D=1 and I=60 μA.

Figure 36:
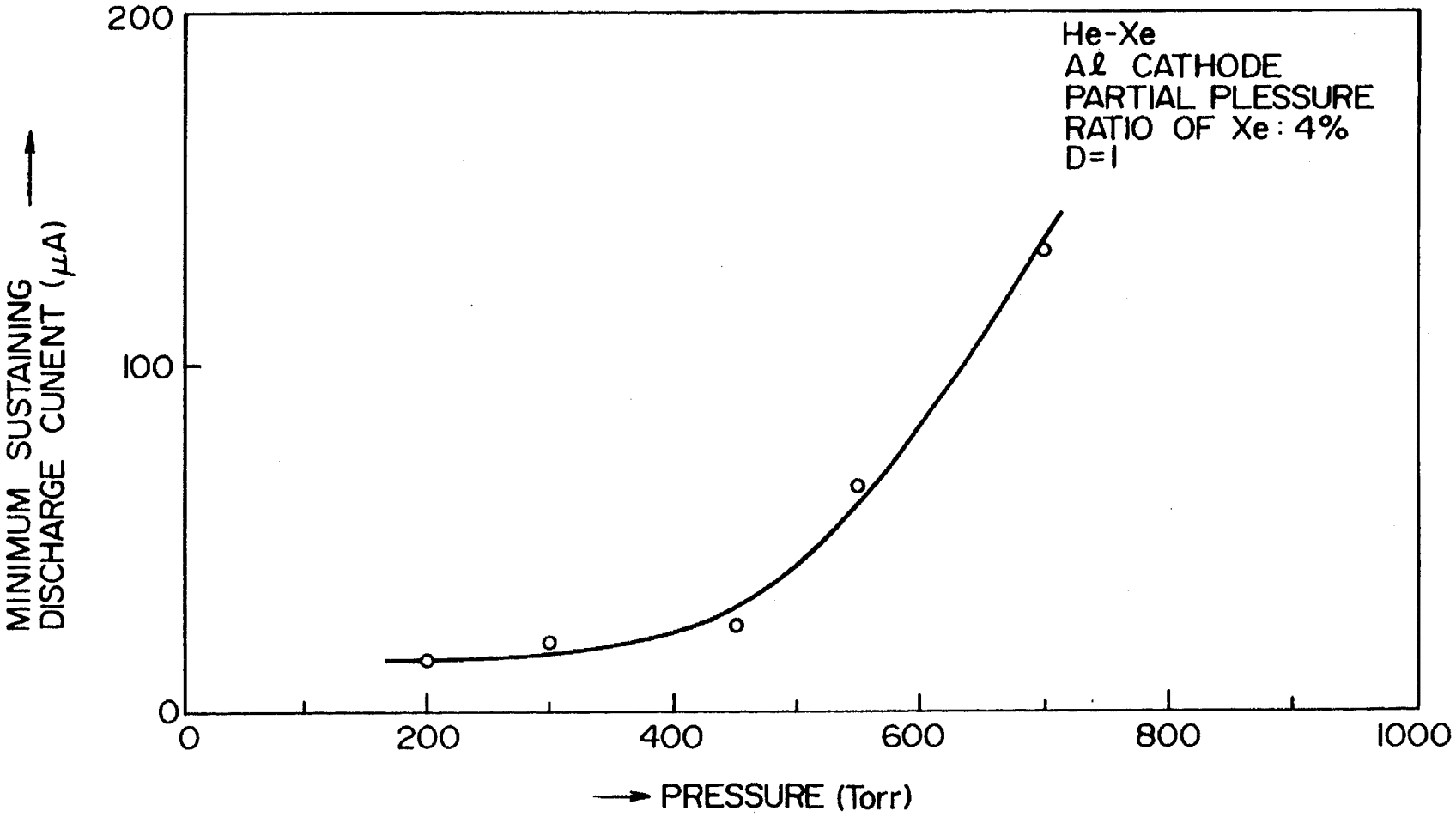
FIG. 36 indicates a minimum sustaining discharge current-to-pressure characteristic.

FIG. 36 indicates a minimum sustaining discharge current-to-pressure characteristic measured when the display panel having the Al cathode and He-Xe (4%) filling gas, as shown in FIGS. 6A and 6B, is driven in the constant current mode under condition of D=1.

Figure 37:
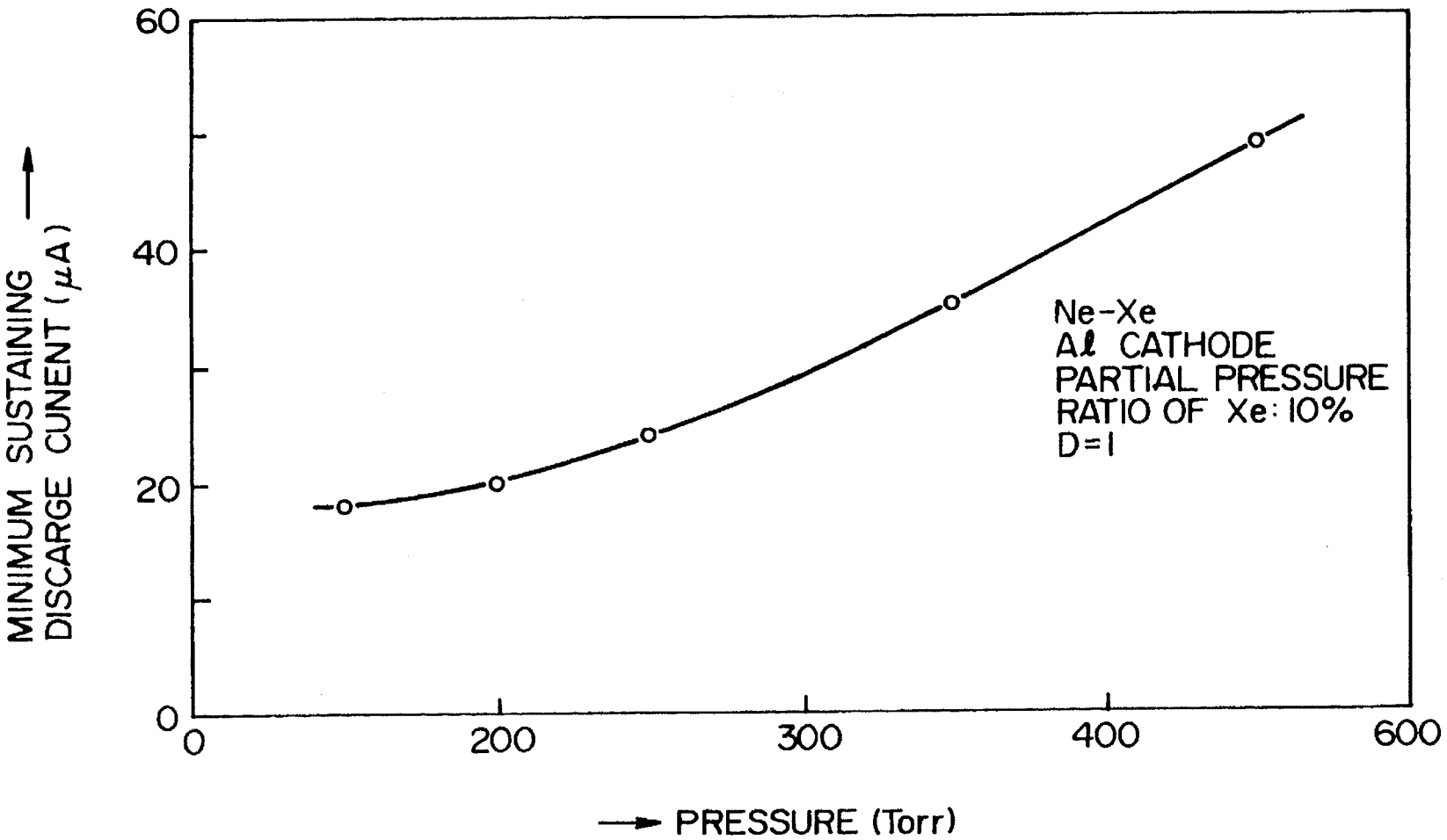
FIG. 37 indicates a minimum sustaining discharge current-to-pressure characteristic.

FIG. 37 indicates a minimum sustain discharge current-to-pressure characteristic measured when the display panel having the A1 cathode and Ne-Xe (10%) filling gas, as shown in FIGS. 6A and 6B, is driven in the constant current mode under condition of D=1.

Figure 38:
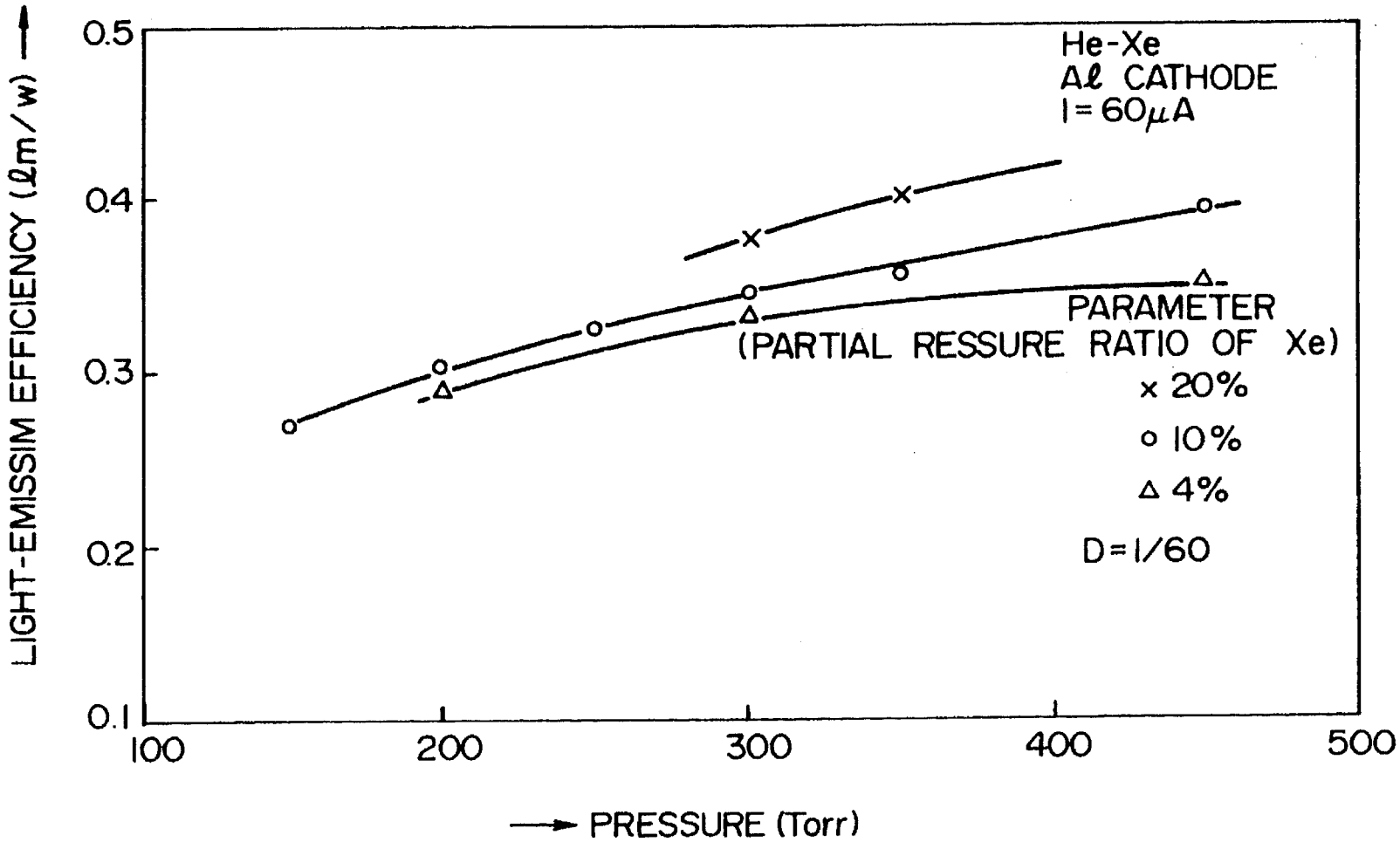
FIG. 38 shows a light-emission efficiency-to-pressure characteristic.

FIG. 38 indicates a light-emission efficiency-to-pressure characteristic measured when the display panel having the Al cathode and He-Xe filling gas, as shown in FIGS. 6A and 6B, is driven in the constant current mode under conditions of D=1/60 and I=60 μA. In FIG. 38, there are shown characteristic obtained when the partial pressure ratio of the Xe gas is used as the parameter, and this partial pressure ratio is selected to be 20%, 10% and 4%.

Figure 39:
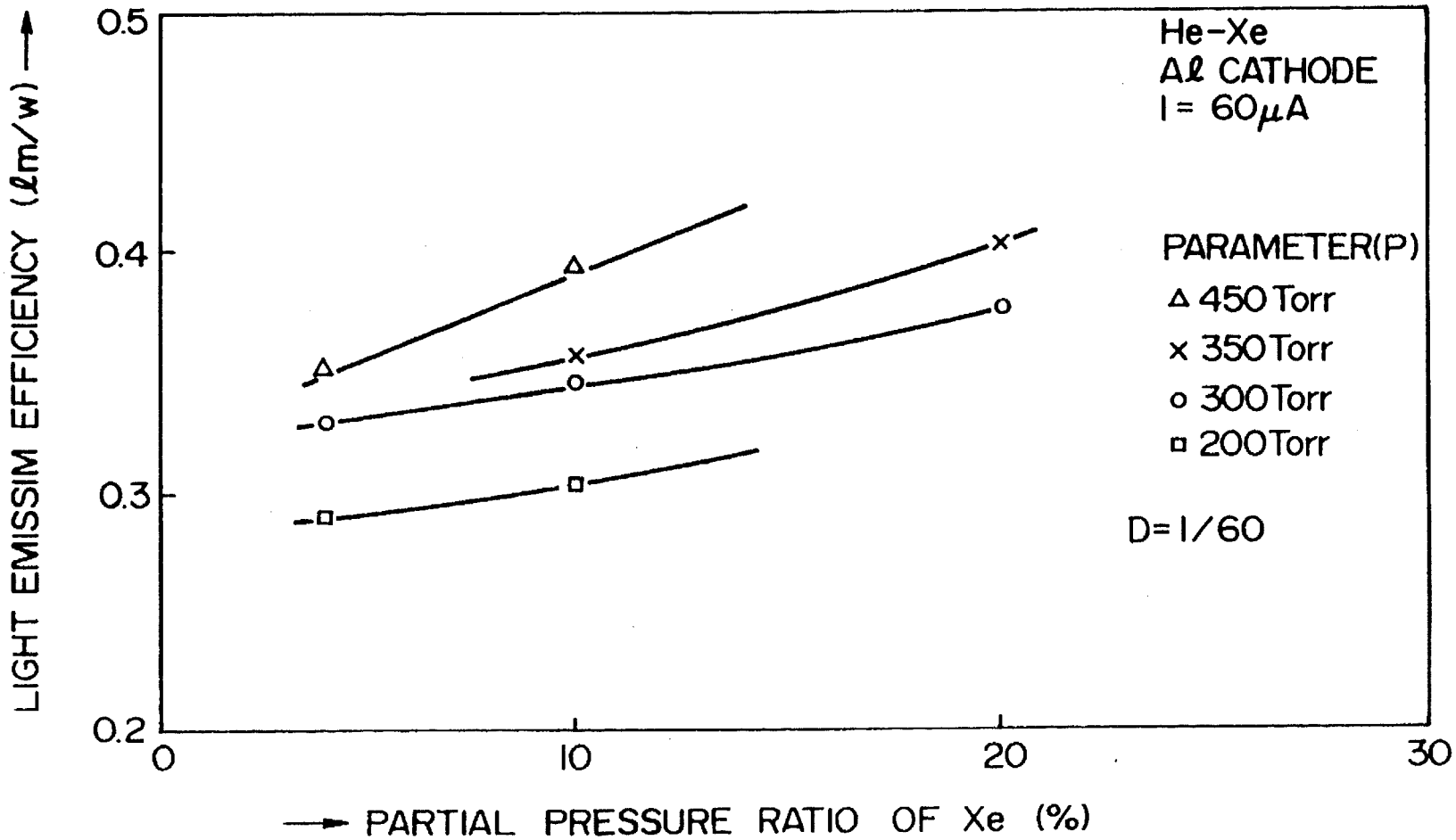
FIG. 39 indicates a light-emission efficiency-to-Xe partial pressure ratio characteristic.

FIG. 39 indicates a light-emission efficiency-to-Xe-partial pressure ratio characteristic measured when the display panel having the Al cathode and He-Xe filling gas, as shown in FIGS. 6A and 6B, is driven in the constant current mode under conditions of D=1/60 and I=60 μA. In FIG. 39, there are shown the characteristics obtained under such conditions that the total pressure "p" of the filling gas is used as the parameter, and the total pressure "P" is selected to be 450 Torr, 350 Torr, 300 Torr and 200 Torr.

Figure 40:
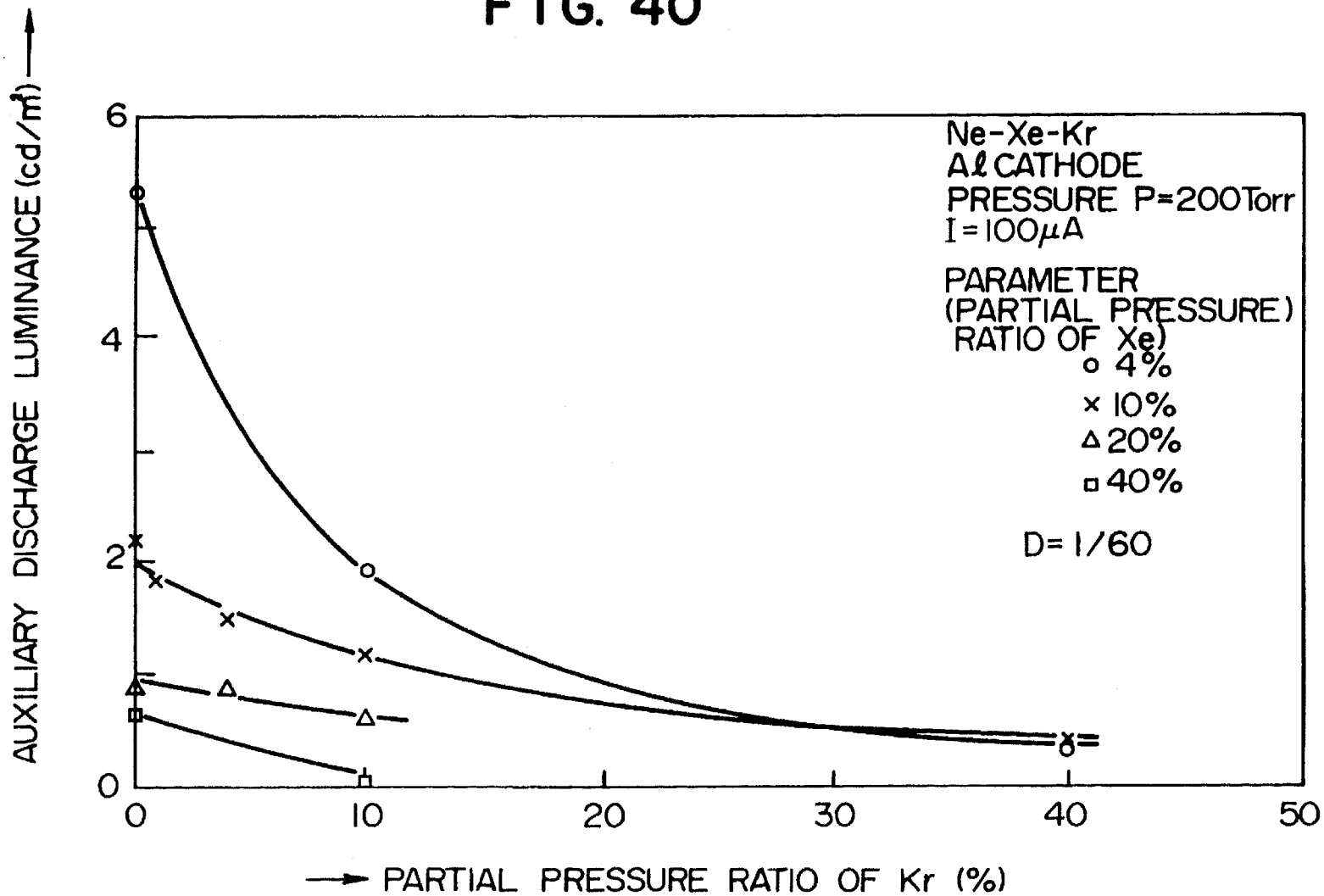
FIG. 40 shows a characteristic related to a luminance of auxiliary cells-to-kr partial pressure ratio.

FIG. 40 indicates a luminance-to-Kr-partial pressure ratio characteristic of the auxiliary discharge cell measured when only this .auxiliary discharge cell of the display panel having the A1 cathode, Ne-Xe-Kr filling gas and P=200 Torr, as shown in FIGS. 6A and 6B, is driven in the constant current mode under conditions of D=1/60 and I=100 μA. In FIG. 40, there are shown characteristics obtained when the partial pressure ratio of the Xe gas is used as the parameter, and this partial pressure ratio is selected to be 4%, 10%, 20% and 40%. In other words, FIG. 40 represents how to change luminance of visible Ne light in response to variations in the Kr partial pressure when only the auxiliary discharge cell of the display panel is discharged.

Figure 41:
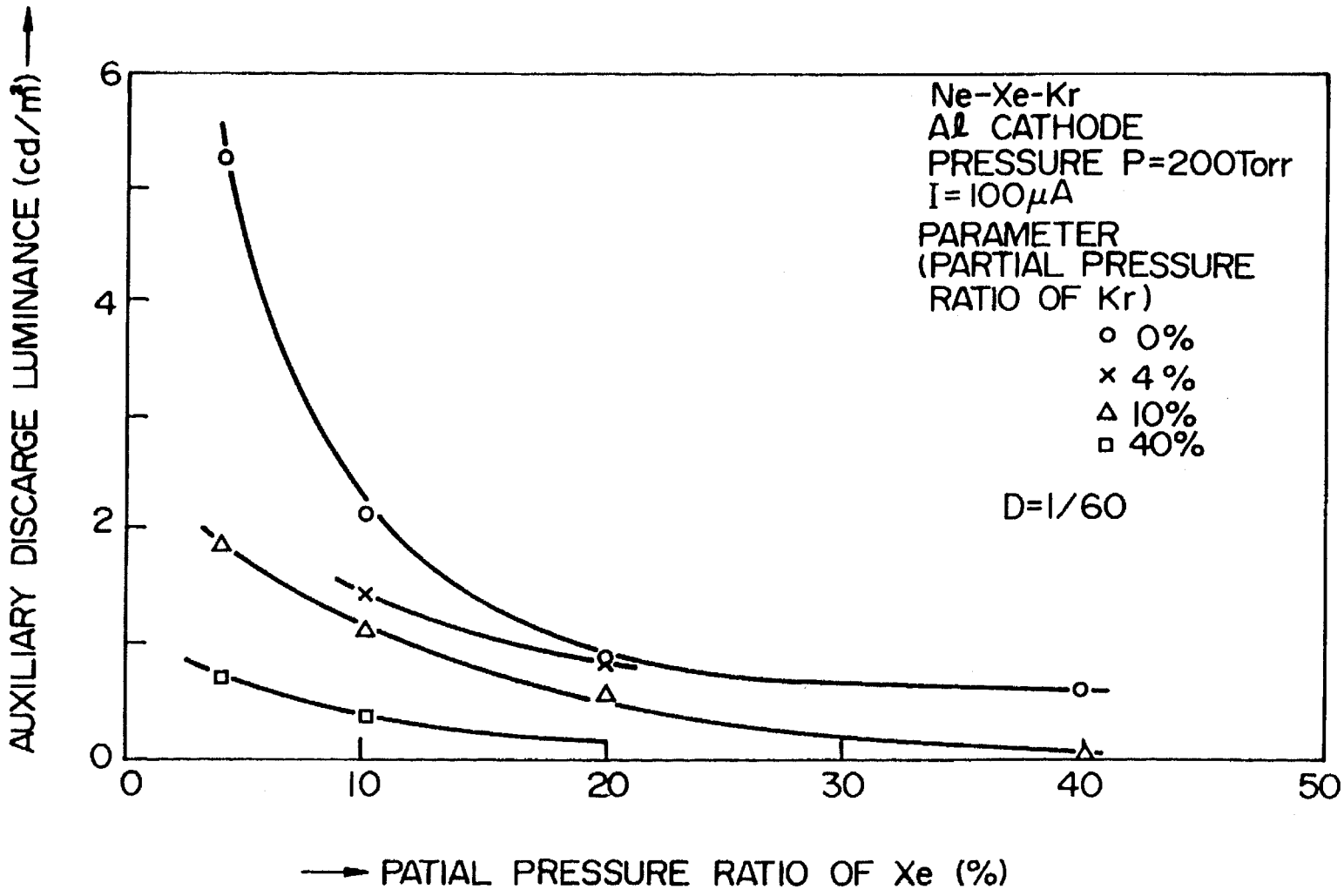
FIG. 41 indicates a characteristic related to a luminance of auxiliary cells-to-Xe partial pressure ratio.

FIG. 41 represents a luminance-to-Xe-partial pressure ratio characteristic of the auxiliary discharge cell measured when only the auxiliary discharge cell of the display panel having the A1 cathode, Ne-Xe-Kr filling gas, and p=200 Torr, as shown in FIGS. 6A and 6B, is driven in the constant current mode under condition of D=1/60 and I=100 μA. In FIG. 41, there are shown characteristics obtained when the partial pressure ratio of the Kr gas is used as the parameter, and this partial pressure is selected to be 0%, 4%, 10% and 40%. In other words, FIG. 41 indicates how to change luminance of visible Ne light in response to the Kr-partial pressure ratio when only the auxiliary discharge cell of the above-described display panel is discharged.

It is understandable from FIGS. 40 and 41 that if the partial pressure ratio of the Ne gas is less than 80%, the light emission of the visible Ne light is lowered.

Figure 42:
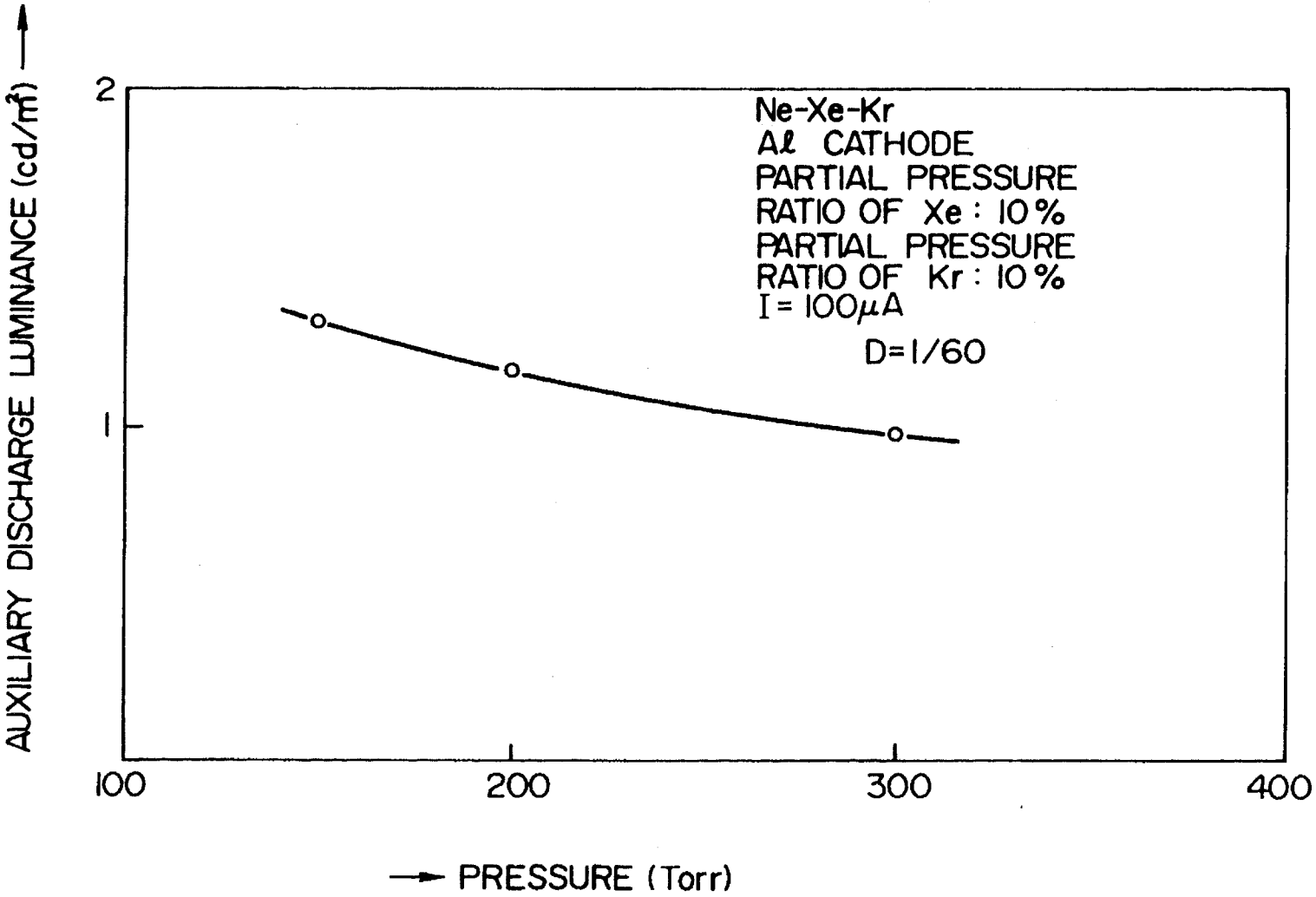
FIG. 42 denotes a characteristic related to a luminance of auxiliary cells-to-pressure.

FIG. 42 represents a luminance-to-pressure characteristic of the auxiliary discharge cell measured when only the auxiliary discharge cells of the display panel having the A1 cathode and Ne-Xe (10%) - Kr (10%) filling gas, as shown in FIGS. 6A and 6B, is driven in the constant current mode under conditions of D=1/60 and I=100 μA. That is to say, FIG. 42, represents how to change luminance of visible Ne light in response to variations in the total pressure "p" when only the auxiliary discharge cell of the display panel is discharged.

It should be noted that the visible Ne light is contained in the above-described measurements of the luminance and the light-emission efficiency when Ne gas is contained in the filling gas.

It could be understood from FIGS. 10, 13, 15, 7, 19 and 21 that the lifetime "T" of the display panel, shown in FIGS. 6A and 6B, into which either He-Xe gas, or He-Xe-Kr gas has been filled, may be approximated by the following equation in case of D=1/60:

$$T=\{1+700xk^2/(p/200)^4\}\ 7.10^{-8}\ xp^5(60/I)^2\ \text{[hour]} \quad (1)$$

where symbol "x" indicates a partial pressure ratio of Xe gas, symbol "k" denotes a partial pressure ratio of Kr gas, symbol "p" shows total pressure (Torr) of filling gas, and symbol "I" is a current value (μA).

It should be noted that when He-Xe gas is filled, the following equation is obtained by substituting k=0 into the above-described equation (1):

$$T=7.10^{-8}xp^5\ (60/I)^2\ \text{[hour]} \quad (2)$$

Comparisons, between the lifetime values calculated by these approximate expressions and the actually measured lifetime values are shown in tables 1 and 2. It could be seen from the tables 1 and 2 that the above-described equations (1) and (2) constitute a relatively better evaluating method. Note that the table 1 indicates the comparison results under I=60 μA, whereas the table 2 shows the comparison results under I=100 μA.

TABLE 1

| | He—Xe | | | |
|---|---|---|---|---|
| | x (partial | k (partial | Lifetime [hrs.] | |
| p [Torr] | pressure ratio) | pressure ratio) | Experiment value | Calculated value |
| 250 | 0.1 | 0 | 7000 | 6800 |
| 300 | 0.04 | 0 | 5500 | 6800 |
| 300 | 0.1 | 0 | 22000 | 17000 |
| 300 | 0.2 | 0 | 42500 | 34000 |
| 350 | 0.1 | 0 | 34000 | 36800 |
| 450 | 0.04 | 0 | 31200 | 51700 |

I = 60 [μA]

TABLE 2

| | He—Xe, He—Xe—Kr | | | |
|---|---|---|---|---|
| | x (partial | k (partial | Lifetime [hrs.] | |
| p [Torr] | pressure ratio) | pressure ratio) | Experiment value | Calculated value |
| 200 | 0.1 | 0.1 | 1100 | 1370 |
| | | 0.4 | 9400 | 9840 |
| | 0.2 | 0.2 | 14400 | 10600 |
| | 0.4 | 0.1 | 15000 | 12300 |
| 250 | 0.1 | 0 | 7000 | 6800 |
| 300 | 0.04 | 0 | 5500 | 6800 |
| | 0.1 | 0 | 22000 | 17000 |
| | 0.2 | 0 | 42500 | 34000 |
| 350 | 0.1 | 0 | 34000 | 36800 |
| | | 0.1 | 17300 | 13300 |
| 450 | 0.04 | 0 | 31200 | 51700 |
| | 0.1 | 0.1 | 44000 | 46600 |

I = 100 [μA]

To achieve that the lifetime "T" of the display panel, shown in FIGS. 6A and 6B, into which either He-Xe gas, or He-Xe-Kr gas has been filled, becomes at least 10,000 hours based on the above-described equation (1), taking account of such a fact that when this display panel is normally operated under I=60 μA, this panel becomes stable, the following formula's condition should be satisfied:

$$\{1+700xk^2/(p/200)^4\}\ xp^5 \geqq 1.4.10^{11} \quad (3)$$

When He-Xe gas is filled, the following formula is obtained by giving k=0 into the above-described formula (3):

$$xp^5 \geqq 1.4.10^{11} \quad (4)$$

It could also be recognized from FIGS. 12, 14, 16, 18, 20 and 22 that the lifetime "T" of the display panel into which either Ne-Xe gas or Ne-Xe-Kr gas has been filled, as shown in FIGS. 6A and 6B, is approximated by the following formula in case of D=1/60:

$$T=max\{80xk(1-3.3x),\ 1\}2.7.10^{-7}\ xp^5(\ 100/I)^3\ \text{[hour]} \quad (5)$$

where symbol "x" indicates a partial pressure ratio of Xe gas, symbol "k" denotes a partial pressure ratio of Kr gas, symbol "p" shows total pressure (Torr), and symbol "I" is a current value (μA).

Furthermore, when Ne-Xe filling gas is filled, the following formula is obtained by giving k=0 into the above-described formula (5):

$$T=2.7.10^{-17}\ xp^5(100/I)^3\ \text{[hour]} \quad (6)$$

Comparison results between the lifetime values calculated by these approximate expressions and the actually measured lifetime values are shown in a Table 3. It could be recognized that the above-described formulae (5) and (6) constitute a relatively better evaluating method.

TABLE 3

| | | Ne—Xe, Ne—Xe—Kr | | | |
|---|---|---|---|---|---|
| | x (partial | k (partial | | Lifetime [hrs.] | |
| p [Torr] | pressure ratio) | pressure ratio) | I [μA] | Experiment value | Calculated value |
| 150 | 0.1 | 0 | 100 | 1450 | 2050 |
| | | 0 | 150 | 620 | 610 |
| 200 | 0.04 | 0 | 100 | 3500 | 3460 |
| | | 0.1 | 100 | 2500 | 3460 |
| | | 0.4 | 100 | 3000 | 3840 |
| | 0.06 | 0.4 | 100 | 10000 | 7980 |
| | 0.1 | 0 | 60 | 34000 | 40000 |
| | | | 100 | 8400 | 8640 |
| | | | 150 | 3400 | 2560 |
| | | | 200 | 1050 | 1080 |
| | | 0.04 | 100 | 5600 | 8640 |
| | | 0.1 | 100 | 9000 | 8640 |
| | | 0.4 | 100 | 20000 | 18400 |
| | 0.2 | 0 | 100 | 14500 | 17300 |
| | | 0.1 | 100 | 15000 | 17300 |
| | | 0.4 | 100 | 30000 | 36800 |
| | 0.4 | 0 | 100 | 40000 | 34600 |
| | | 0.1 | 100 | 40500 | 34600 |
| 250 | 0.1 | 0 | 100 | 38000 | 26400 |
| 300 | 0.1 | 0.1 | 100 | 76000 | 65000 |
| 350 | 0.1 | 0 | 100 | 130000 | 142000 |

To achieve that the lifetime "T" of the display panel, shown in FIG. 6A and 63, into which either Ne-Xe gas, or Ne-Xe-Kr gas has been filled, becomes at least 10,000 hours based upon the above-described formula (5), considering such a fact that when this display panel is normally operated under I=60 μA, this panel's operation becomes stable, the conditions of the following formula should be satisfied:

$$\max\{80xk(1-3.3x),\ 1\}\ xp^5 \geqq 8.0.10^9 \tag{7}$$

When Ne-Xe gas is filled, the following formula is obtained by giving k=0 into the above-described formula (7):

$$xp^5 \geqq 8.0.10^9 \tag{8}$$

Figure 57:
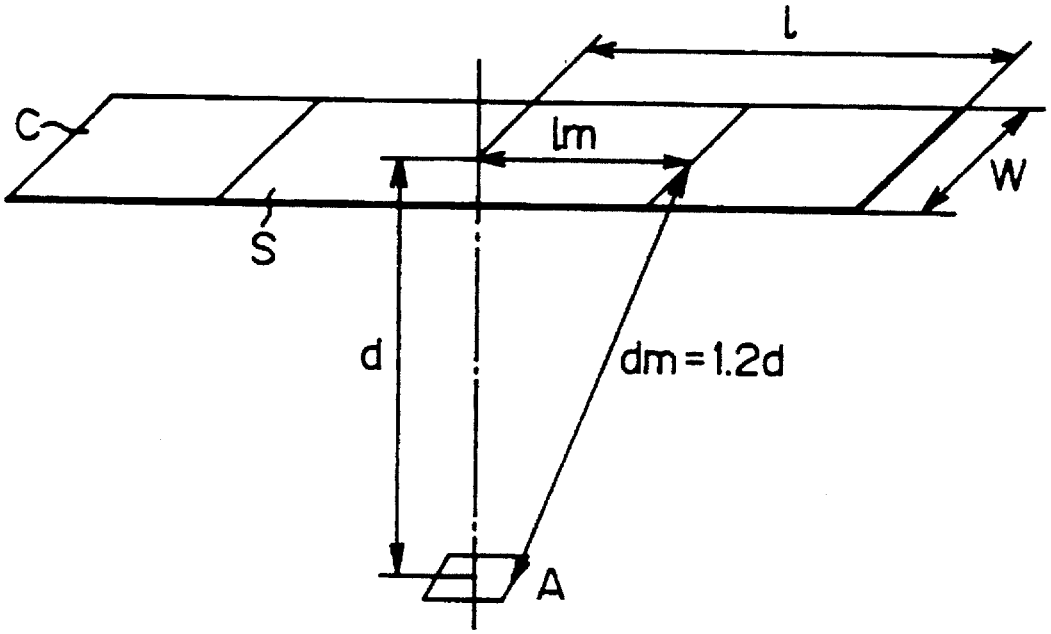
FIG. 57 is a diagram for explaining an active cathode area.

The value of the discharge current must be considered as discharge current density. To this end, an active cathode area must be considered. In case that an interval between the cathode and the anode of the display panel as shown in FIGS. 6A and 6B is not constant, places actually operated as the normal glow-discharge regions are generally different from each other, depending upon the pd-product. In this case, the interval is set to be 1.2 times longer than the minimum distance "d". This is because since a relatively high sustain voltage, e.g., 20 V is required so as to operate as the cathode the place 1.2 times longer than the minimum distance or more, the discharge occurring at the place of the minimum distance "d" becomes the abnormal glow discharge, and then a sputtering is rapidly increased. This may also be recognized from FIGS. 10, 12, 31 and 32. As shown in FIG. 57, in case of the display panel shown in FIGS. 6A and 6B, the abnormal glow-discharge occurs at about ⅔ area of the entire cathode area. In this drawing, assuming now that an anode is one point and dm=1.2d, an actual cathode area "S" is obtained by:

$$S = 2lm \times W = 2\sqrt{dm^2 - d^2} \times W = 2\sqrt{0.44}\ d \times W = 1.33\ dW = 1.33\ lW$$

Accordingly, an overall area "2lW" becomes approximately ⅔. In this display panel, the active cathode are "S" is equal to 0.04 mm$^2$.

Since the active anode are could be defined, current density is calculated, and then the following formula is obtained by modifying the formula (1) when He-Xe-Kr filling gas is filled:

$$T=\{1+700xk^2/(p/200)^4\}\ 0.16\ xp^5(S/I)^2 \tag{9}$$

where symbol "S" denotes an active cathode area (mm$^2$).

Similarly, when He-Xe filling gas is filled, the following formula is obtained by modifying the formula (2):

$$T=0.16xp^5(S/I)^2 \tag{10}$$

Similarly, when Ne-Xe-Kr filling gas is filled, the following formula is obtained by modifying the above-described formula (5):

$$T=max\{80xk(1-3.3x),\ 1\}4.2.10^3\ xp^5(S/I)^3 \tag{11}$$

Similarly, when Ne-Xe filling gas is filled into the display panel, the following formula is obtained by modifying the above-explained formula (6):

$$T=4.2.10^3\ xp^5(S/I)^3 \tag{12}$$

With regard to an upper limit value of total pressure, there exists a limitation that this upper limit pressure value does not exceed atmospheric pressure (760 Torr). Considering now that a lower limit pressure value is preferable if a sufficient lifetime could be obtained in view of characteristics of a display panel, and also when pressure "p" is increased, the stable minimum sustain current is increased, as represented in FIGS. 36 and 37, resulting in lowering of the efficiency, the maximum pressure values of the display panel are preferably selected to be 600 Torr in case of He-Xe and He-Xe-Kr filling gases, and 500 Torr in case of Ne-Xe and Ne-Xe-Kr filling gases. Also, due to the stable discharge, it is preferable to set: $x \leqq 0.5$ and $k \leqq 0.5$. As to the discharge distances "d", the pd-product may be preferably selected to be 1 to 10 (Torr. cm) when He-Xe and He-Xe-Kr filling gases are filled, and 0.5 to 10 (Torr. cm) when Ne-Xe and Ne-Xe-Kr filling gases are filled. Also, taking account of the light-emission efficiency, it is preferable to set: $0.01 \leqq x$.

Figure 1A:
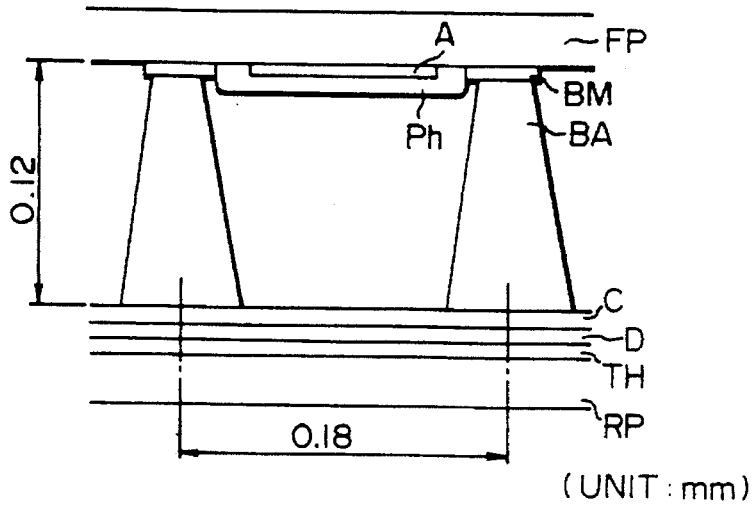
FIG. 1A PRIOR ART
FIG. 1A is a sectional view of the conventional DC type gas-discharge display panel.
Figure 1B:
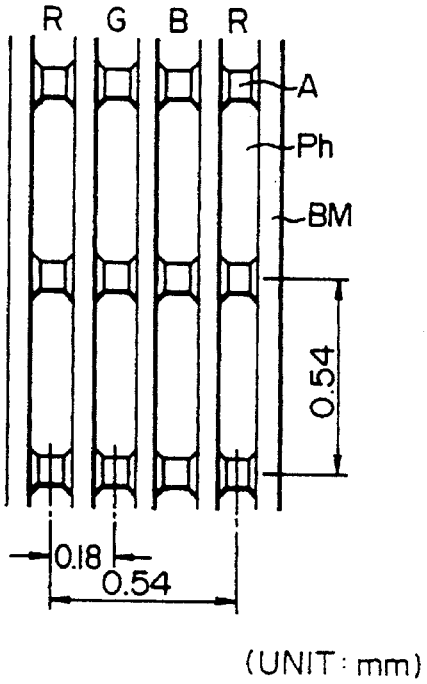
FIG. 1B PRIOR ART
FIG. 1B is a plan view thereof.
Figure 2:
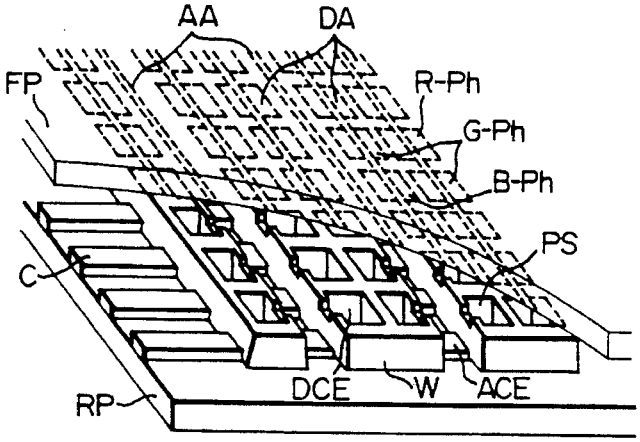
FIG. 2 PRIOR ART
FIG. 2 is a perspective view of another conventional DC type gas-discharge display panel, partially cut away.
Figure 3:
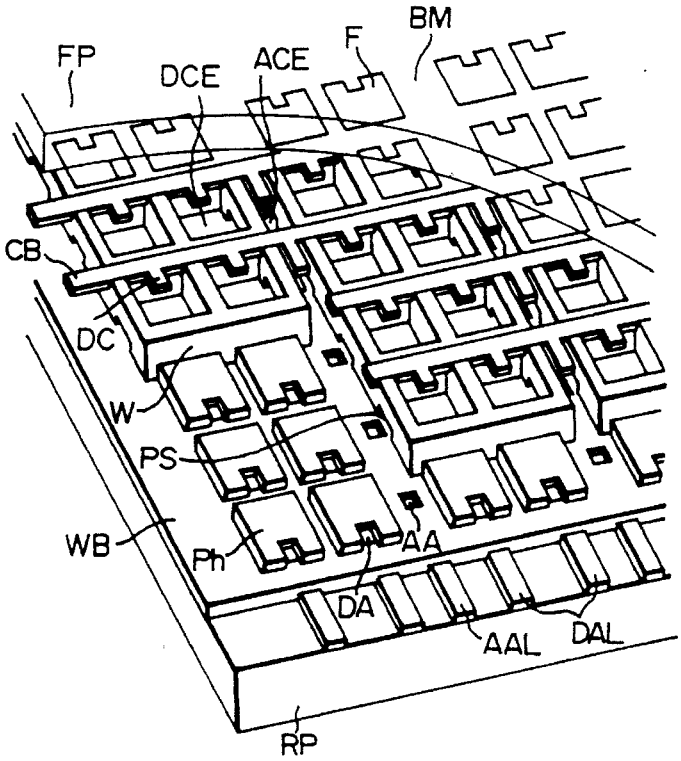
FIG. 3 PRIOR ART
FIG. 3 is a perspective view of another conventional DC type gas-discharge display panel, partially cut away.
Figure 4A:
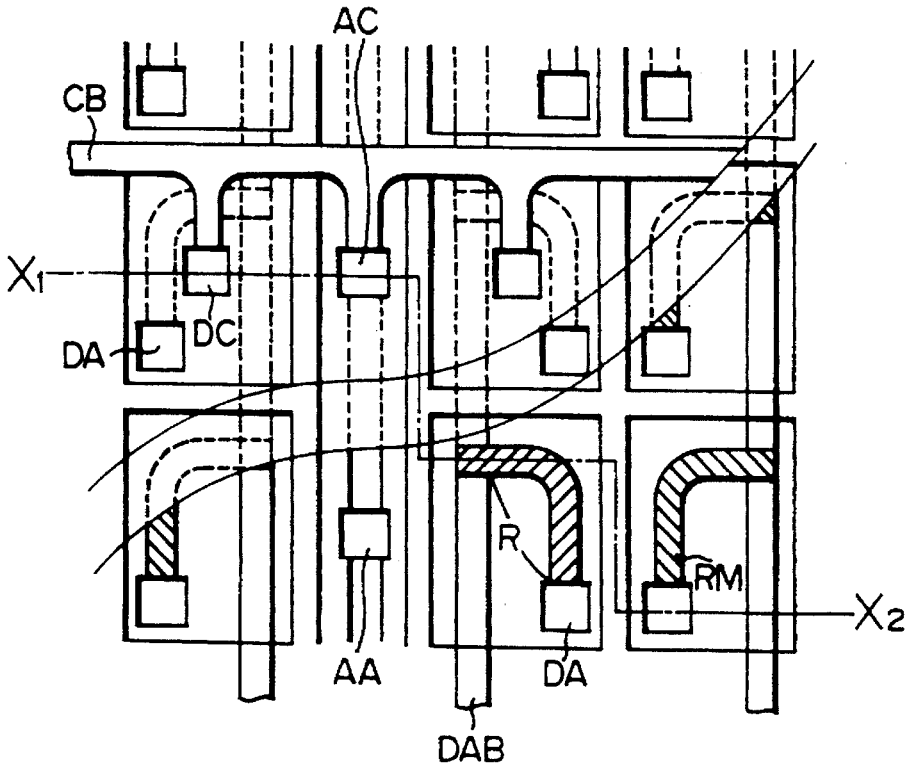
FIG. 4A PRIOR ART
FIG. 4A is a plan view of a further conventional DC type gas-discharge display panel.
Figure 4B:
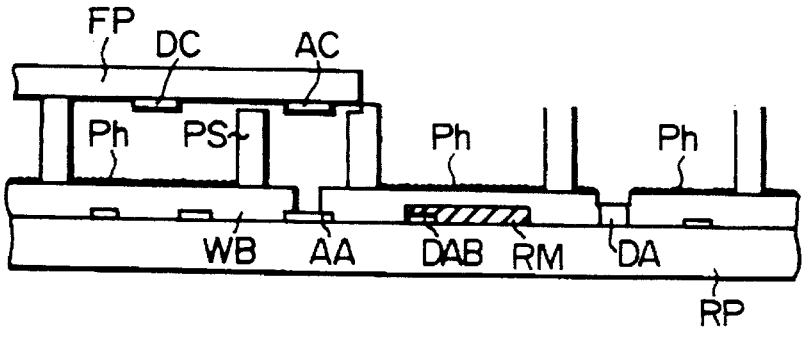
FIG. 4B PRIOR ART
FIG. 4B is a sectional view thereof, taken along a line $X_1$–$X_2$ shown in FIG. 4A.

Although a write voltage for a memory drive of a display panel must be selects to be higher than a sustain voltage by several tens voltages, for example, 50 V, such a write voltage may cause a large current be flown in this display panel, as apparent from FIGS. 31 and 32, resulting in shortening of a lifetime thereof. Therefore, a certain type of current limiting element must be connected series to a display panel. Normally, since a resistor is employed, this resistor may be connected as shown in FIGS. 4A and 4B.

As apparent from the forgoing descriptions, the following conditions should be satisfied so as to provide a long-life DC type gas-discharge display panel with high luminance.

First, when He-Xe filling gas is filled into the DC type gas-discharge display panel, a condition of $0.01 \leqq x \leqq 0.5$, a condition of $P \leqq 600$, and either a condition of $xp^5 \geqq 1.4.10^{11}$ or a condition of $xp^5\ (S/I)^2 \geqq 6.3.10^4$ are required to be preferably satisfied.

Secondly, when He-Xe-Kr filling gas is filled into the display panel, a condition of $0.01 \leqq x \leqq 0.5$, another condition of $P \leqq 600$, and either a condition of $\{1+700xK^2/(p/200)^4\}$ x $p^5 \geqq 1.4.10^{11}$ or a condition of $\{1+700xK^2/(p/200)^4\}$ $xP^5(S/I)^2 \geqq 6.3.10^4$ are required to be preferably satisfied.

Thirdly, when Ne-Xe filling gas is filled into the display panel, a condition of $0.01 \leqq x \leqq 0.5$, a condition of $p \leqq 500$, and either a condition of $xp^5 \geqq 8.0.10^9$ or a condition of $xp^5(S/I)^3 \geqq 2.4$ are required to be preferably satisfied.

Fourthly, when Ne-Xe-Kr filling gas is filled into the display pane, a condition of 0.01x0.5, a condition of $0<k \leqq 0.5$, another condition of $p \leqq 500$, and either a condition of $\max\{80xk(1-3.3x),1\}xp^5 \geqq 8.0.10^9$ or a condition of $\max\{80xk(1-3.3x),1\}xp^5(S/I)^3 \geqq 2.4$ are required to be preferably satisfied.

Figure 43:
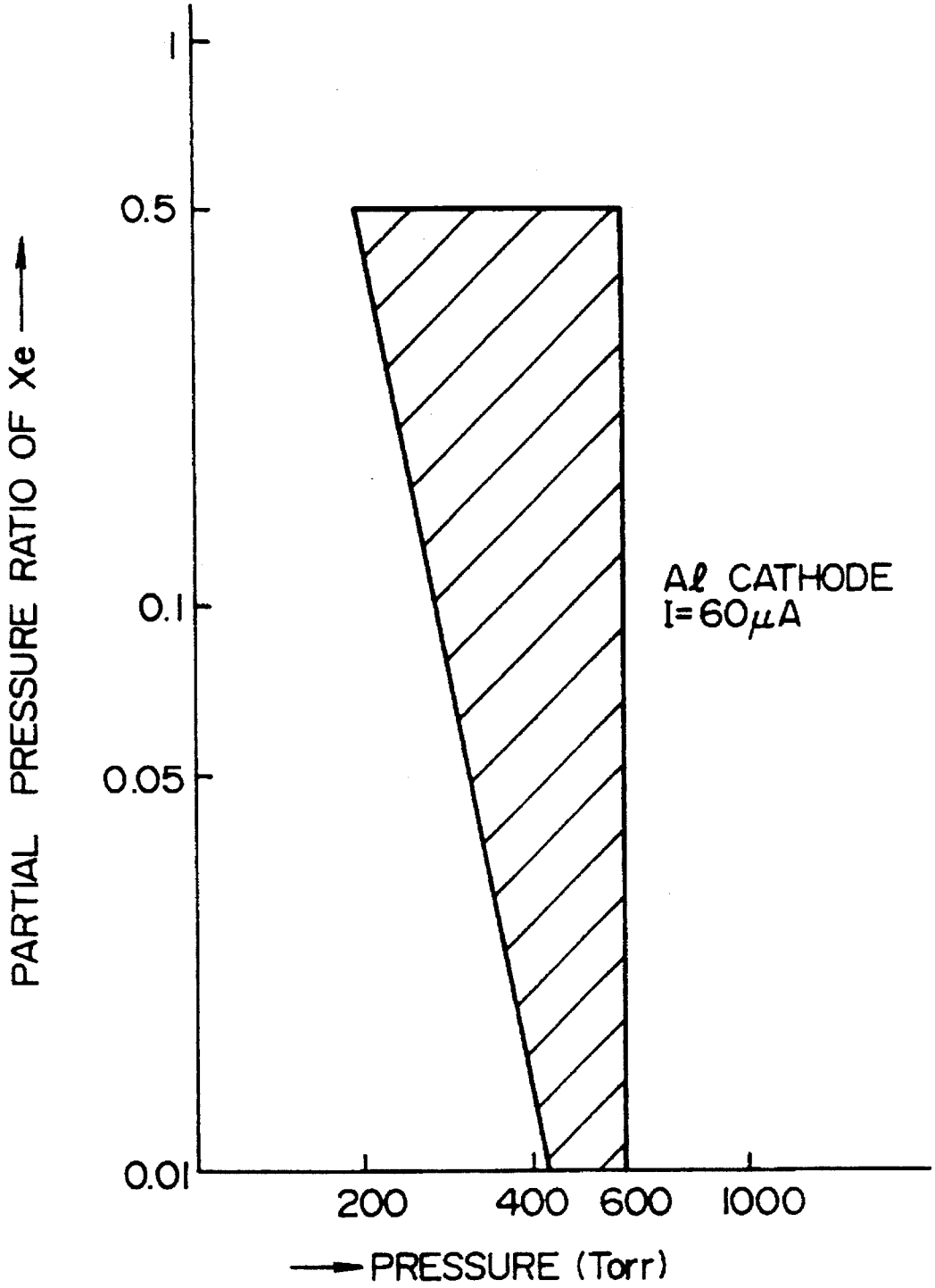
FIG. 43 represents a range for satisfying a predetermined condition.

When He-Xe filling gas is filled into the display panel under I=60 μA and S=0.04 $mm^2$, a range for satisfying a condition of $xp^5 \geqq 1.4.10^{11}$ $^{l}$ is shown in FIG. 43. Even when a rare gas below than 5%, Ne, Ar and Kr gases other than He-Xe gas are filled into the display panel, the substantially same characteristics as that of He-Xe gas could be obtained.

Figure 44:
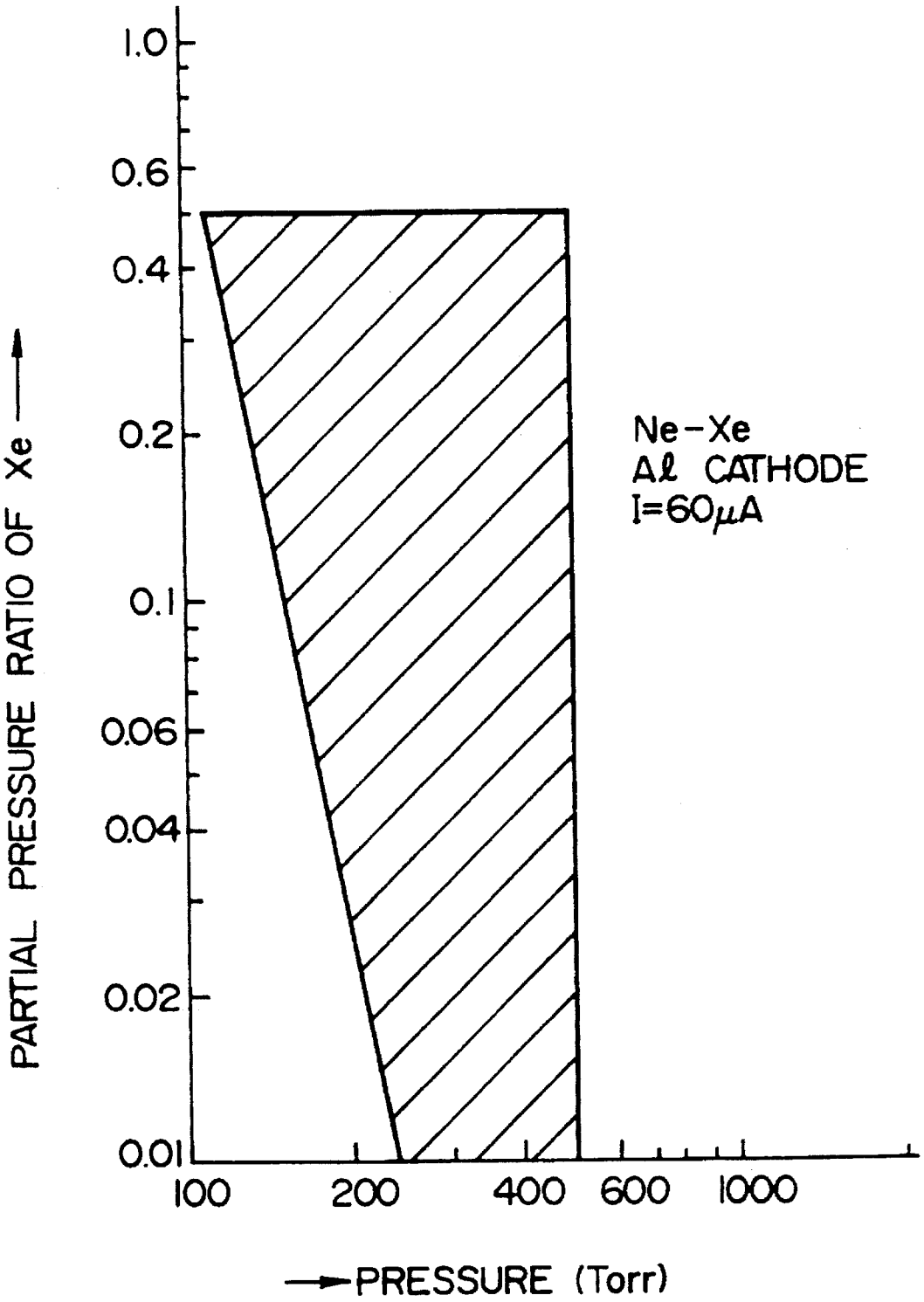
FIG. 44 represents a range for satisfying a predetermined condition.

When Ne-Xe filling gas is filled into the display panel under I=60 μA and S=0.04 $mm^2$, a range for satisfying a condition of $\max\{80xk(1-3.3x),1\}xp^5 \geqq 8.0.10^9$ is shown in FIG. 44. Even if a rare gas below 5%, He and Ar gases are filled other than Ne-Xe filling gas, the substantially same characteristics as that of Ne-Xe filling gas could be obtained.

Although the above explanation was made of such a case that aluminum (Al) was employed as the cathode material, it could be recognized that a similar effect to that of the aluminum cathode could be achieved even when other materials were employed as the cathode material. In case that Ni is employed as the cathode material, a lifetime-to-pressure characteristic thereof is represented in FIG. 45.

Figure 45:
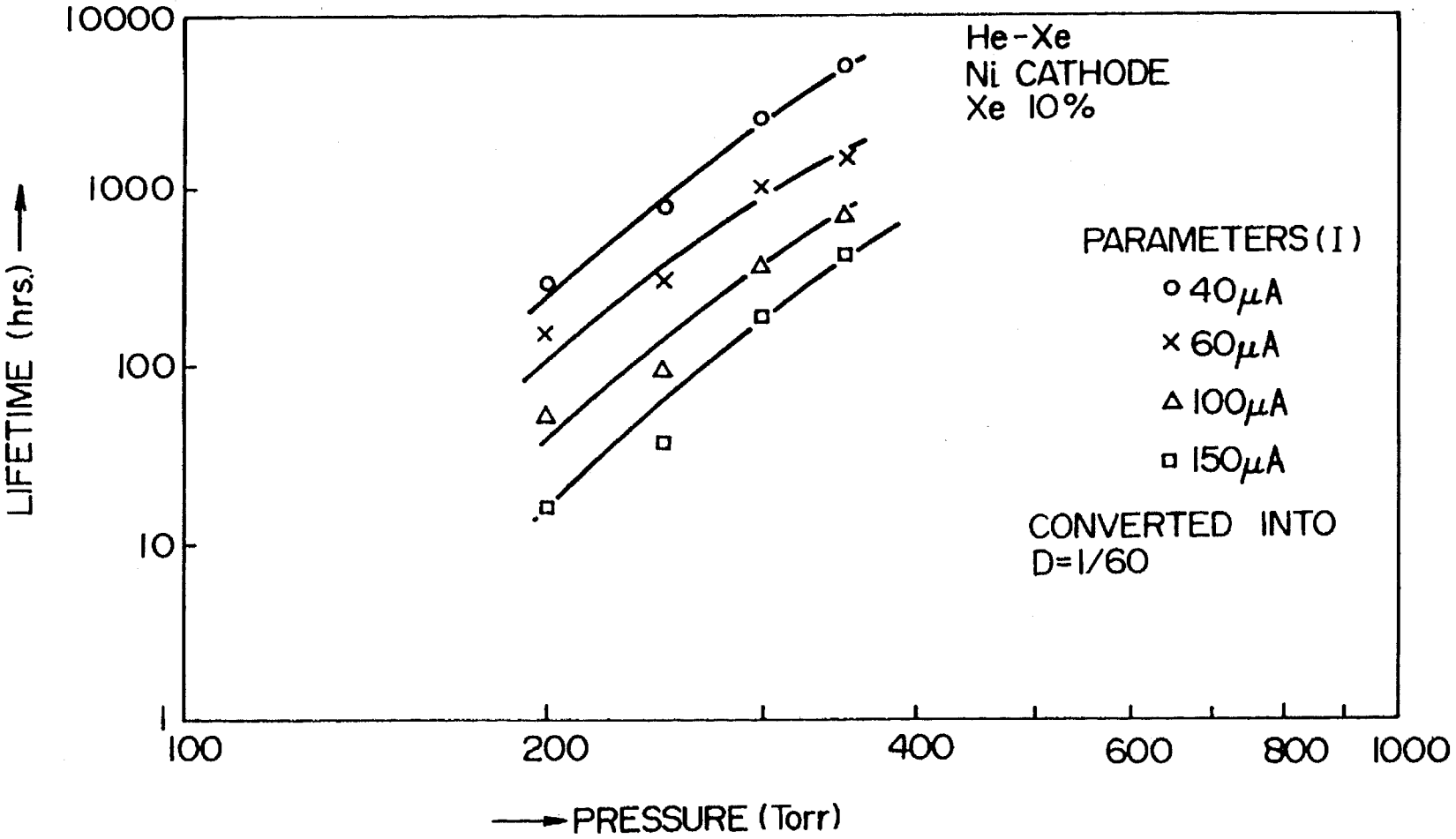
FIG. 45 shows a lifetime-to-pressure characteristic.

FIG. 45 represents a lifetime-to-pressure characteristic measured when the display panel having the Ni cathode, and He-Xe (10%) filling gas, as shown in FIGS. 6A and 6B, is driven in the constant current mode under condition of D=1. In FIG. 45, there are shown characteristics when the current I is used as the parameter and is selected to be 40 μA, 60 μA, 100 μA and 150 μA. Note that the lifetimes shown in FIG. 45 have been converted into those of D=1/60.

When the cathode material is Ni, the lifetime of the display panel having such a Ni cathode is shorter than that having an Al cathode. However, if mercury (Hg) is filled into this display panel, a lifetime of this display panel may be prolonged approximately 100 times longer than that of a display panel without mercury, which therefore is longer than that of the display panel with the Al cathode. As other cathodes materials, there are such as $BaAl_4$, $LAB_6$, $BaB_6$, $Ba(N_3)_2$, an alkali metal, $Y_2O_3$, ZnO, $RuO_2$, Cr, Co, graphite, $Ca_{0.2}La_{0.8}CrO_3$, Mg, $BaLa_2O_4$, $BaAl_2O_4$, and $LaCrO_3$, and there are substantially similar effects. The adhesive methods used for the above-described cathode materials are printing, plasma melt-injection, vapor deposition and sputtering methods etc.

Usually, as red phosphor, there are employed $Y_2O_3$: Eu, $YVO_3$: Eu, $YP_{0.65}V_{0.35}O_4$: Eu, $YBO_3$: Eu, $(YGa)BO_3$: Eu. Then, as green phosphor, there are employed $Zn_2SiO_4$: Mn, $BaMg_2Al_{14}O_{24}$: Eu, Mn, $BaAl_{12}O_{19}$: Mn. Also, as blue phosphor, there are provided $Y_2SiO_4$: Ce, $YP_{0.85}V_{0.15}O_4$: Eu, $BaMg_2Al_{14}O_{24}$: Eu, $BaMgAl_{14}O_{23}$: Eu. The adhesive methods used for the above-described phosphor materials, are printing, photo-etching, photo-tacking, and spray methods etc. Depending upon places to which the phosphor adheres, there are called as a reflection type display panel (back plate or cell wall plate), or a transmission type display panel (front plate). The positioning of the resistor is varied in accordance with the type of display panel. When the phosphor is attached to the front plate, since there is a limitation in a place to which the resistor is connected, the reflection type display panel owns a larger freedom than that of the transmission type display panel.

A filter to achieve high contrast may be entered into a panel as described more in detail in the above-described publication (3).

Figure 46A:
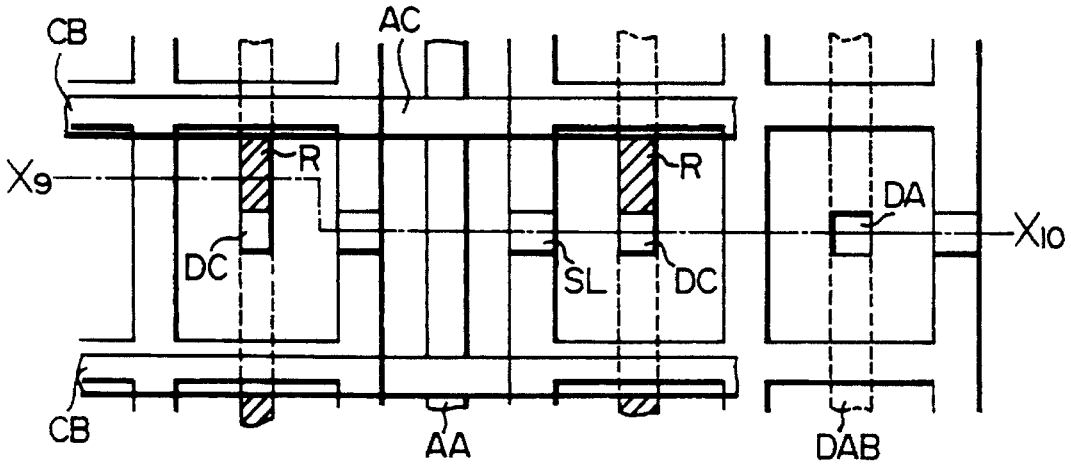
FIG. 46A is a plan view of a DC type gas-discharge display panel according to an embodiment of the present invention.
Figure 46B:
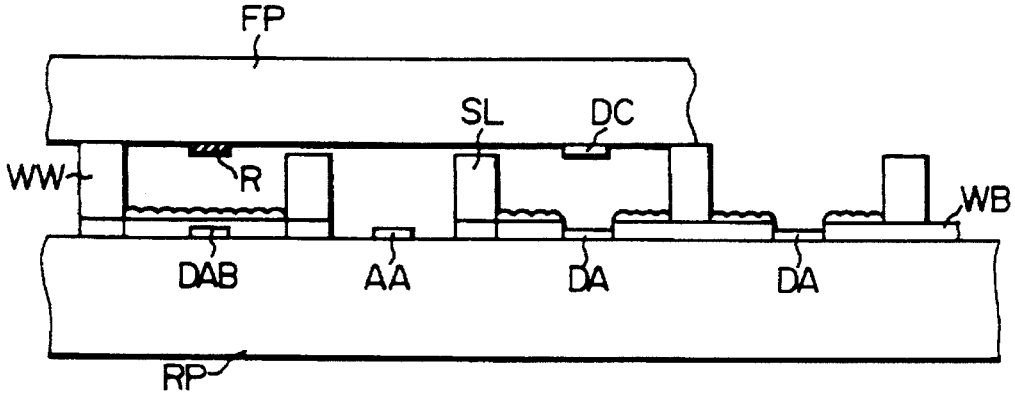
FIG. 46B is a sectional view thereof, taken along a line $X_9$–$X_{10}$ shown in FIG. 46A.

The structures of the display panels may be realized as shown in the above-described publications (4) and (5). There are shown other structure examples in FIGS. 46A and 46B. In FIGS. 46A and 46B, the same reference numerals shown in FIGS. 1A to 4B are employed as those for denoting the same elements. This cell structure has such a feature that a resistor "R" is connected to a front plate "FG", and the remaining structures are substantially identical to those of FIGS. 4A and 4B.

Figure 47A:
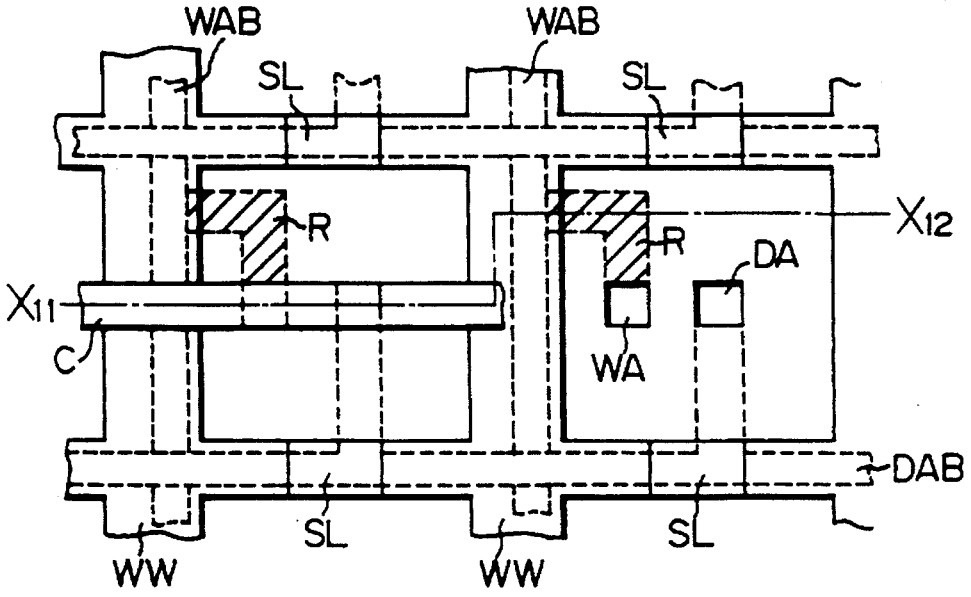
FIG. 47A is a plan view of a DC type gas-discharge display panel according to another embodiment of the present invention.
Figure 47B:
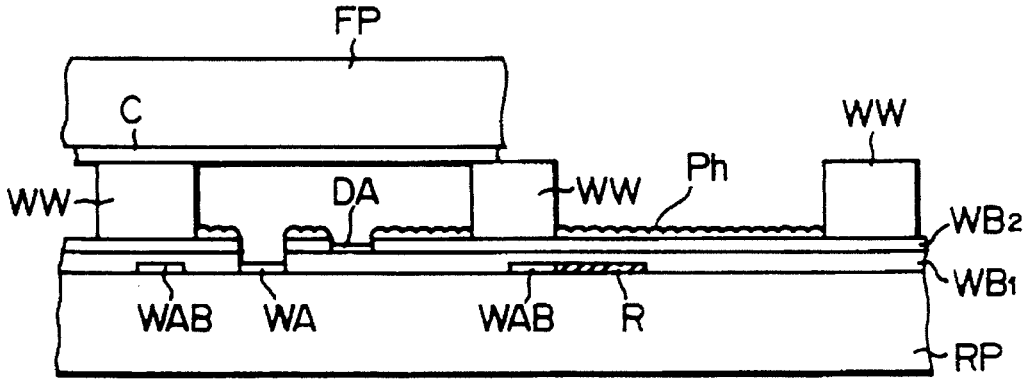
FIG. 47B is a sectional view thereof, taken along a line $X_{11}$–$X_{12}$ shown in FIG. 47A.

In FIGS. 47A and 47B, there is shown as another example where a resistor is connected only to a write electrode. It should be noted that the same reference numerals are employed as those for denoting the same elements shown in FIGS. 47A and 47B. In FIGS. 47A and 47B, a cathode is provided at a front plate, and a write anode bus line (WAB) is extended over a back plate along a vertical direction, which is connected via a resistor (R) to a write anode (WA). On the other hand, a display anode (DA) is projected from a bus line (DAB) thereof toward a cell center unit. This bus line "DAB" is positioned in parallel to "C", or may be located in parallel to the write anode bus line (WAB). Since a sustain discharge operation is carried out between the bus line (DAB) and "C", it may be freely. In this case, the display panel is driven only in the pulse memory mode.

A display panel will be classified based upon a combination of (1) whether a place to which a resistor is connected corresponds to a front plate, or a back plate; (2) an electrode to which a resistor is connected corresponds to an anode side, a cathode side, or only a write electrode; and (3) whether or not an auxiliary discharge is present. These combinations may be conceived as the above-described two examples, or as other examples. If these display panels are combined with other display panels as shown in FIGS. 48A to 51B (will be discussed later), display panels with conspicuous characteristics may be obtained.

There are two panel driving methods, i.e., a DC memory drive mode and a pulse memory drive mode. In a normal condition, the display panels according to the present invention may be driven by both of the drive modes.

It should be noted that power consumption of a sustain pulse becomes small in such a structure that a cathode is positioned in parallel to a display anode bus line.

Referring now to FIGS. 48A to 56B, DC type gas-discharge display panels according to other preferred embodiments of the present invention will be described.

Figure 48A:
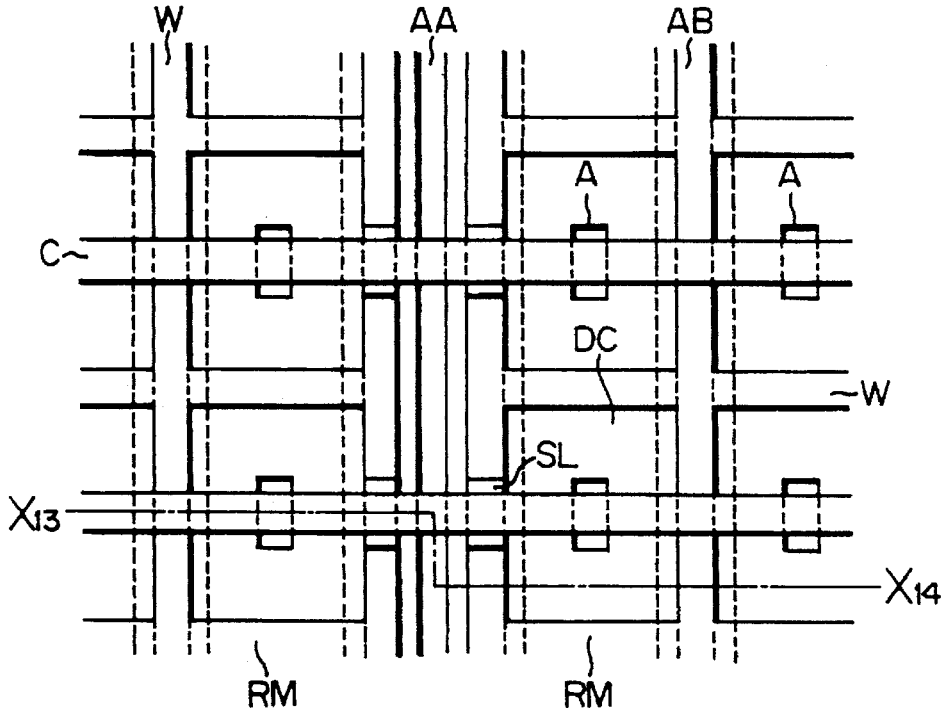
FIG. 48A is a plan view of a DC type gas-discharge display panel according to another embodiment of the present invention.
Figure 48B:
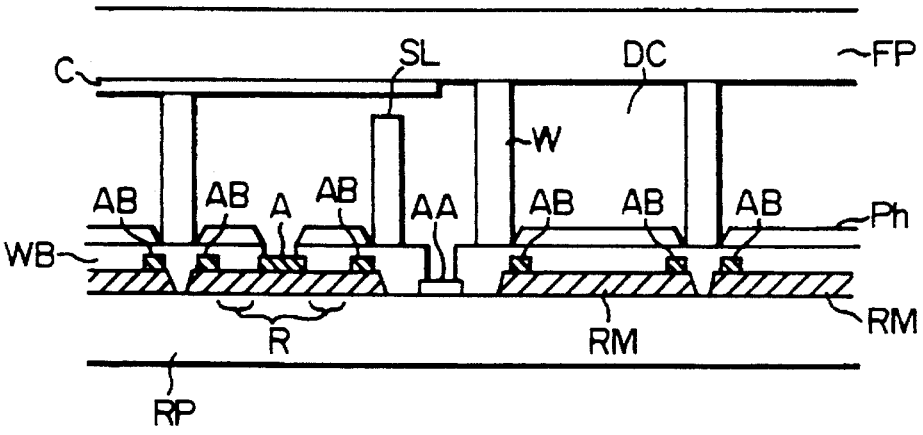
FIG. 48B is a sectional view thereof, taken along a line $X_{13}$–$X_{14}$ shown in FIG. 48A.

FIG. 48A is a plan view for showing a portion of a DC type gas-discharge display panel according to another preferred embodiment of the present invention, and FIG. 48B is a sectional view of this display panel, taken along a line $X_{13}$ to $X_{14}$ shown in FIG. 48A.

Figure 5A:
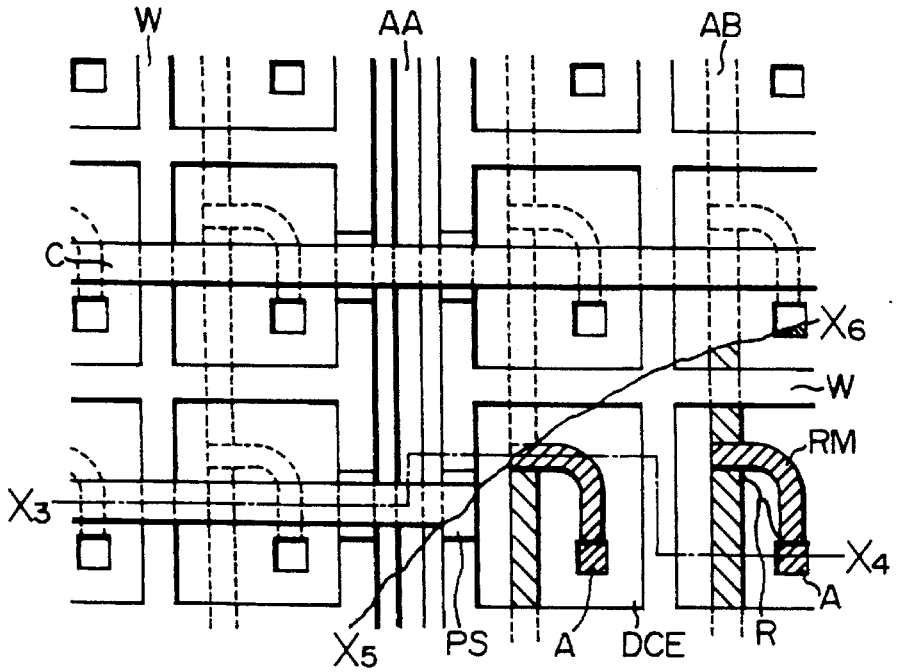
FIG. 5A PRIOR ART
FIG. 5A is a plan view of a still further conventional DC type gas-discharge display panel.
Figure 5B:
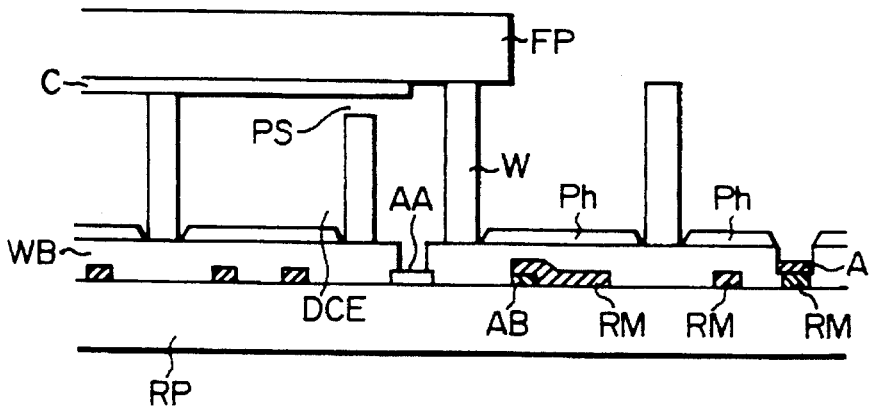
FIG. 5B PRIOR ART
FIG. 5B is a sectional view thereof, taken along a line $X_3$–$X_4$ shown in FIG. 5A.

In FIGS. 48A and 48B, since the portions indicated by the same symbols as shown in FIGS. 5A and 5B own the same functions as those of the panel portions shown in FIGS. 5A and 5B, and also the operations thereof are similar to those of the panel portions shown in FIGS. 5A and 5B, explanations thereof are omitted. A description will now be made of a shape of a resistor constituting the feature of this preferred embodiment. It should be understood that an anode bus line "AB" corresponds to a second conductive line, a cathode "C" corresponds to a first conductive line, and also an anode "A" corresponds to a second discharge electrode in this preferred embodiment.

In FIGS. 48A and 48B, a resistive material "RM" is formed in a band shape in such a manner that under one pair of parallel anode bus lines "AB", a size of this resistive material is larger than a size of the anode bus line "AB", and the band-shaped resistive material is positioned over a plurality of discharge cells "DCE" in common to the anode bus line "AB". An anode "A" is formed at a substantially center of two anode bus lines "AB", and a resistor "R" is terminated by this anode together with the anode bus line "AB".

Figure 52A:
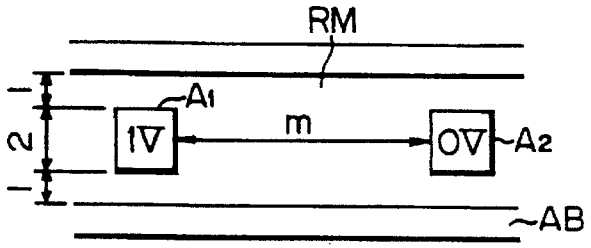
FIG. 52A represents a positional relationship between an anode bus line and an anode, and a distance between adjoining anodes and also a potential relationship between them.
Figure 52B:
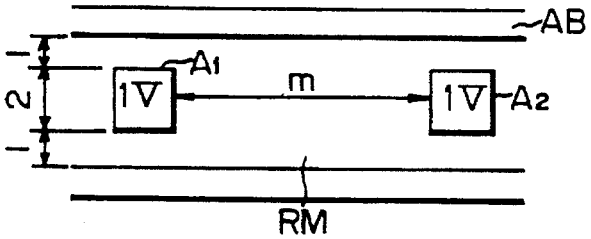
FIG. 52B shows another positional relationship between an anode bus line and an anode, and also a potential relationship.
Figure 52C:
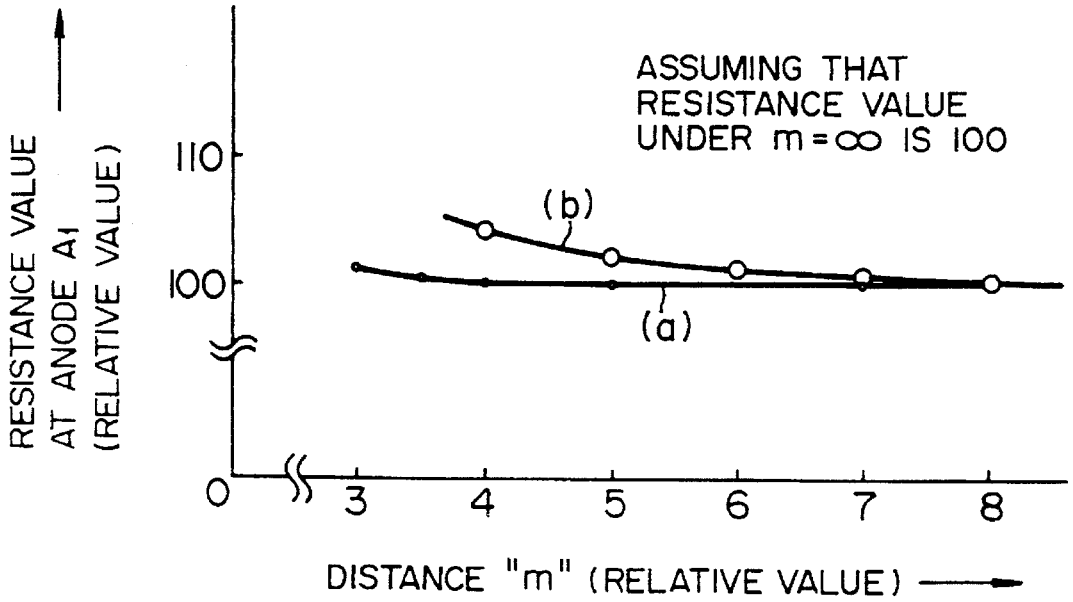
FIG. 52C indicates a relationship between a resistance value and a distance between adjoining anodes positioned along the anode bus line.

Referring now to FIGS. 52A to 52C, a description will be made of conditions with respect to distances between the adjoining anodes "A" positioned along a direction of the anode bus line "AB". As shown in FIGS. 52A and 52B, under conditions that sizes of the anodes A1 and A2 are 2×2, a distance between the anodes A1 and A2, and the anode bus line "AB" is 1, and a distance between the adjoining anodes A1 and A2 is "m", resistance values of a resistor terminated by the anode A1 and the anode bus line "AB" are calculated of the potential of the adjoining anode A2 is the same as that of the anode bus line "AB" (OV), and (b) the potential of the adjoining anode A2 is equal to that of the anode A1 (lV). The calculated resistance values are shown in FIG. 52C. As a consequence, if the distance "m" is selected to be greater than, or equal to 6, it could be recognized that an influence caused between the adjoining anodes A1 and A2 may be reduced below 1%.

The resistance value of thus formed resistor "R" is not adversely influenced by fluctuation appearing in the shape sizes of the resistive material "RM". Also, this resistance value is not adversely influenced by the edges or end portions of the resistive material where the thickness of the resistive material RM is fluctuated in the highest degree. As a consequence, a lack of luminous uniformity, or luminous fluctuation of each gas-discharge cell can be lowered without requiring high precision during a production stage.

Furthermore, the adverse influences caused by both of the position and dimension of the anode "A" for terminating the resistive material "RM" and given to the resistance values will now be described more in detail with reference to FIGS. 53A to 55B.

Figure 53A:
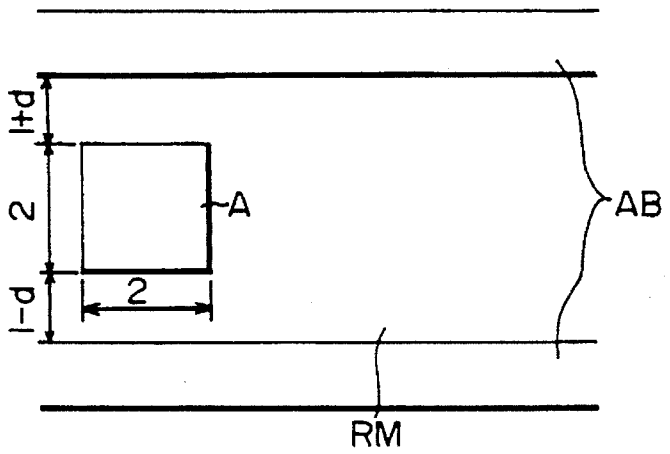
FIG. 53A shows a relationship between the anode bus line and the anode.
Figure 53B:
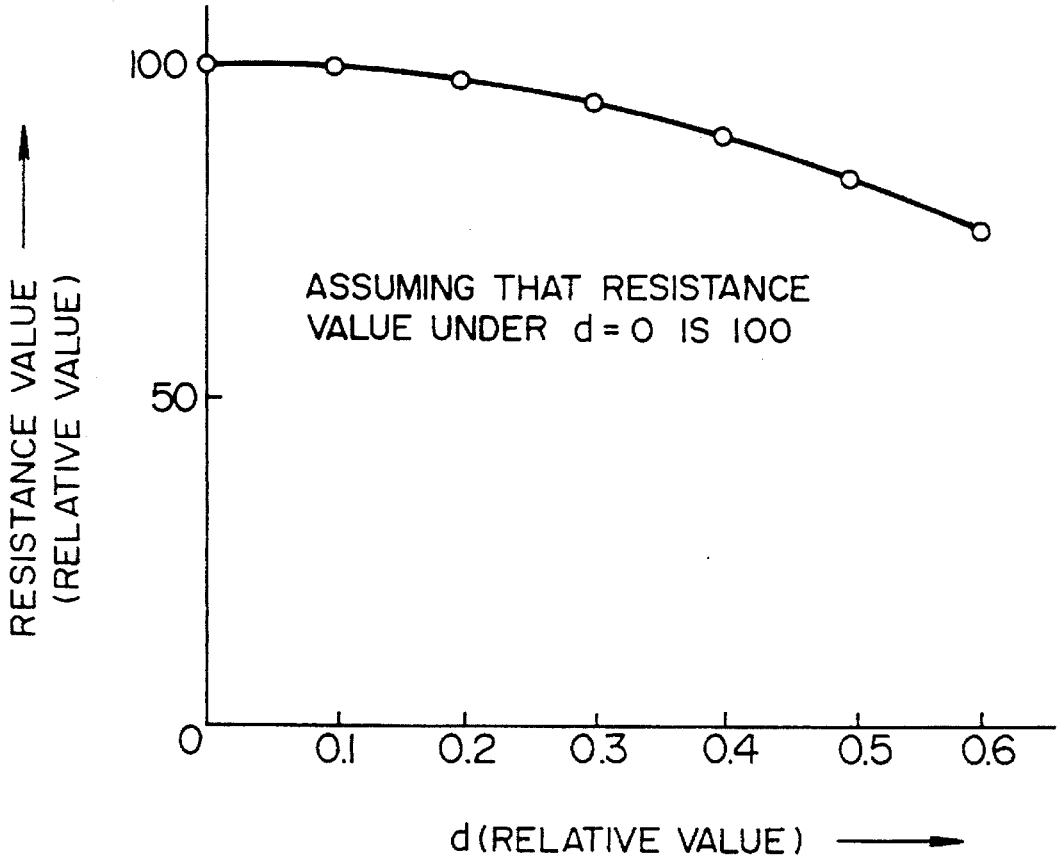
FIG. 53B indicates a variation in resistance values when the anode is positionally shifted to the anode bus line.
Figure 54A:
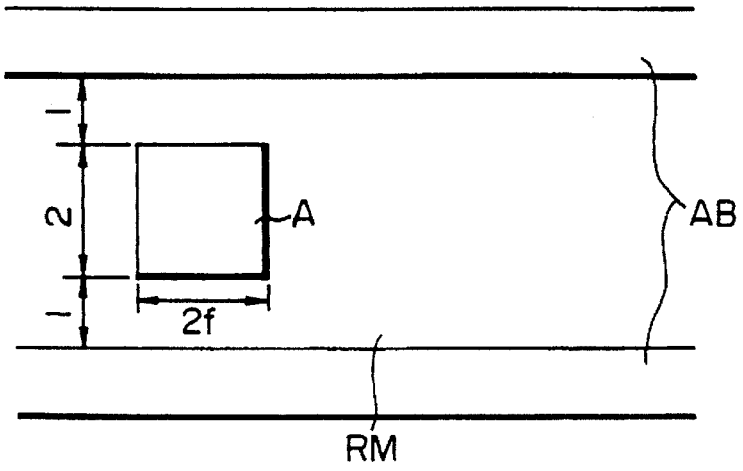
FIG. 54A shows a positional relationship between an anode bus line and an anode and a size of the anode.
Figure 54B:
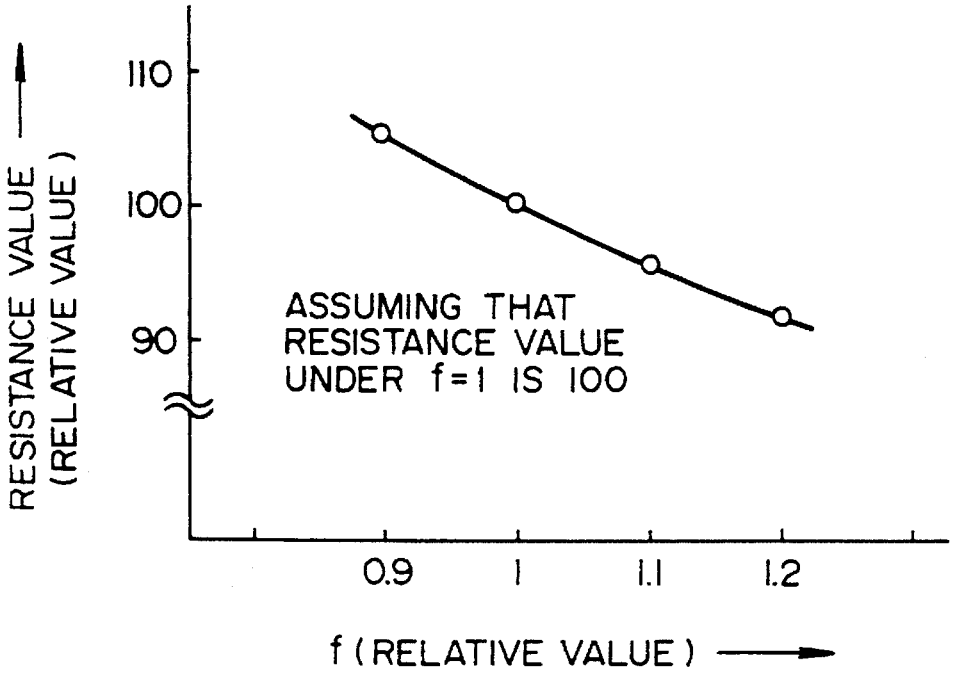
FIG. 54B indicates a variation in resistance values when a size of the anode is changed along a direction parallel to the anode bus line.
Figure 55A:
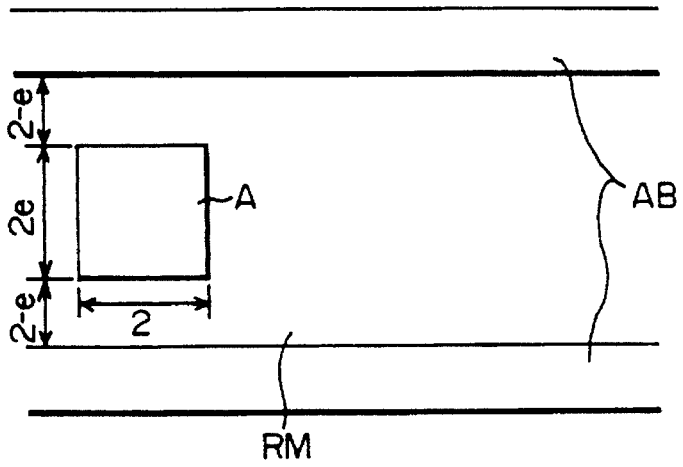
FIG. 55A indicates a positional relationship between an anode bus line and an anode and a size of the anode.
Figure 55B:
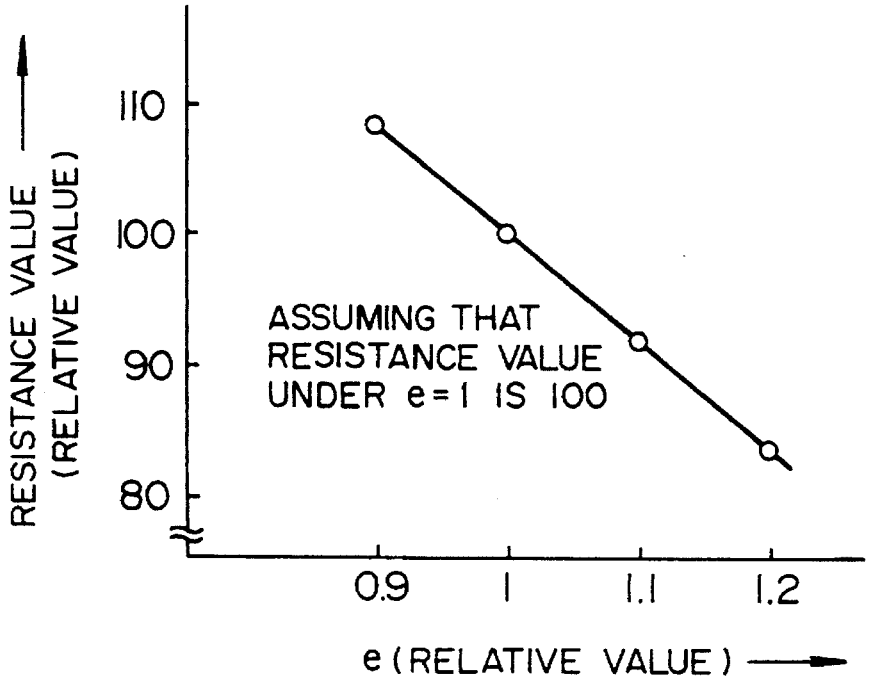
FIG. 55B shows a variation in resistance values when a size of the anode is changed along a direction perpendicular to the anode bus line.

In FIGS. 53A and 53B, there are shown the resistance values of the resistor "R" terminated by the anode "A" and the anode bus line "AB" when the anode "A" is vertically shifted toward the anode bus line "AB", which have been calculated. As shown in FIG. 53A, when the size of the anode A is 2×2, the distance between the anode "A" and the anode bus line "AB" is 1, and the positional shift thereof is "d" (relative value), variations in the resistance values of the resistor R are shown in FIG. 53B. As a consequence, when the positional shift is 0.1 (corresponding to 10%), the variations in the resistance values are below 1%. Also, as apparent from FIGS. 52A to 52C, the positional shift parallel to the anode bus line "AB" gives no adverse influence to the resistance values at all.

FIGS. 54A to 55B represent calculation results with respect to the adverse influences by the sizes of the anode "A" to the resistance values, variations parallel to the anode bus line "AB", and variation vertical thereto. As a result, to reduce the variations in the resistance values within, for instance, 1%, precision along the parallel direction to the anode bus line AB may be set below 2%, and precision along the vertical direction to the anode bus line may be set below 1.3%.

Figure 49A:
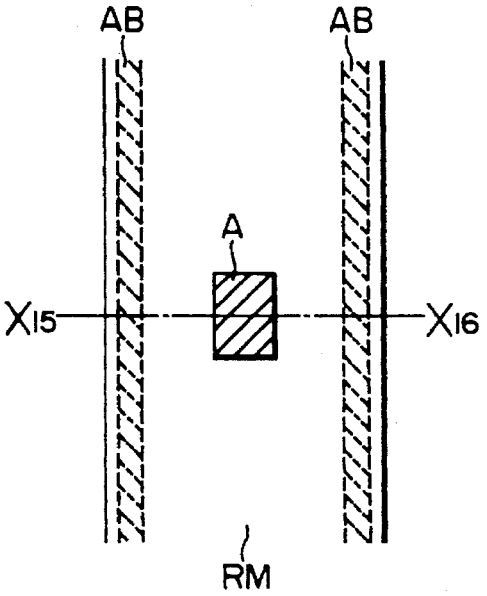
FIG. 49A is a plan view of an essential part of DC type gas-discharge display panel according to another embodiment of the present invention.
Figure 49B:
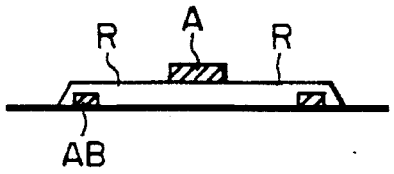
FIG. 49B is a sectional view thereof, taken along a line $X_{15}$–$X_{16}$ shown in FIG. 49A.

The shape of the resistor employed in the discharge display panel according to the present invention is not limited to that shown in FIGS. 48A and 48B, but may be such a shape-that, for instance, the anode bus line AB is located under the resistive material RM as shown in FIGS. 49A and 49B. In this case, as represented in FIGS. 49A and 49B, the resistive material RM may be formed in such a manner that this resistive material "RM" extends outside of the anode bus line "AB". However, for example, the resistive material "RM" may extend only to the outer edge or the central portion of the anode bus line "AB" thereon.

Figure 50A:
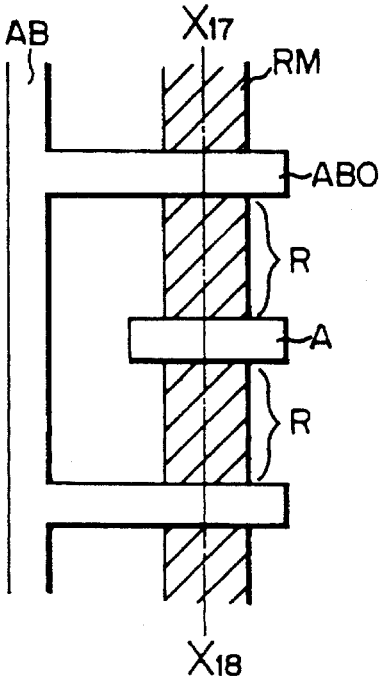
FIG. 50A is a plan view of an essential part of DC type gas-discharge display panel according to another embodiment of the present invention.
Figure 50B:
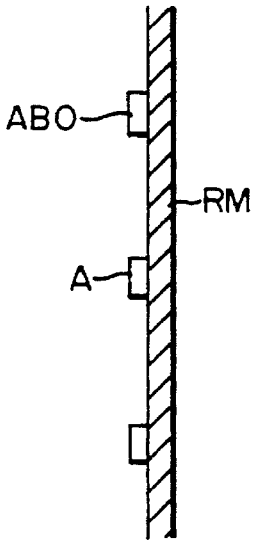
FIG. 50B is a sectional view thereof, taken along a line $X_{17}$– $X_{18}$ shown in FIG. 50A.

Also, a shown in FIGS. 50A and 50B, a resistor "R" may be formed by being terminated by a comb-shaped branch anode bus line ABO branched from the anode bus line AB and an anode formed at a near center thereof. When a resistive material "RM" is printed in a band shape along a longitudinal direction thereof by way of the thick-film printing operation, this resistive material can be easily made uniform except for the starting and ending portions of the printing operation. There is a particular advantage that there is no specific problem in precision of dimension for a formation of an electrode when widths of the comb-shaped branch anode bus line ABO and of the anode "A" for terminating the resistive material RM are made wider than the width of this resistive material "RM".

Figure 56A:
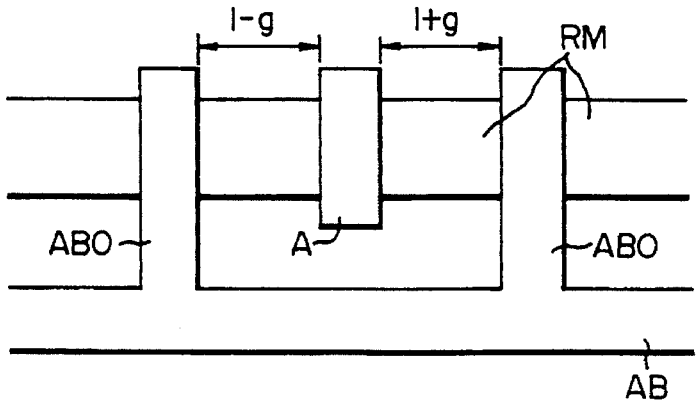
FIG. 56A denotes a positional relationship between a branch line from anode bus and an anode.
Figure 56B:
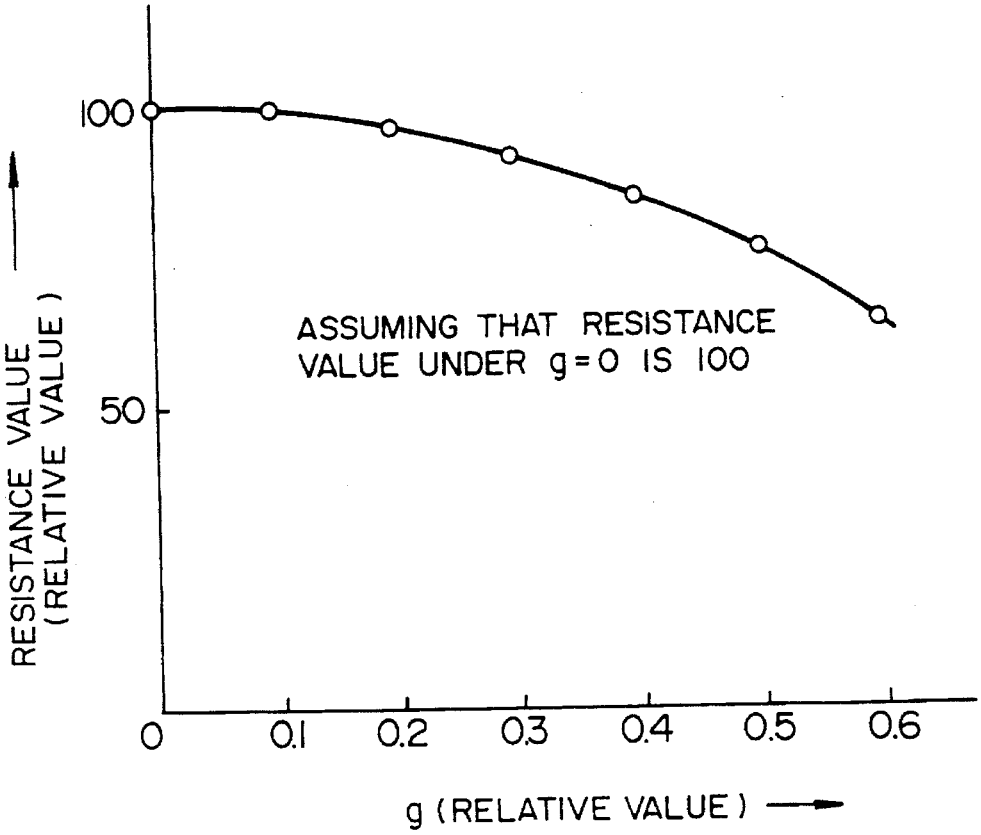
FIG. 56B shows a relationship between a position of the anode with respect to a branch anode, and a resistance value.

Referring now to FIGS. 56A and 56B, the positional precision with respect to the branch anode bus line ABO of the anode A will be explained in the preferred embodiment shown in FIGS. 50A and 50B. As shown in FIG. 56A, when a distance between the anode "A" and the branch anode bus line ABO is equal to 1, and also a positional shift is "g", variations in the resistance values of the resistor R caused by the positional shift "g" are represented in FIG. 56B. As a result, when the positional shift is 0.1 (equivalent to 10%), the variations in the resistance values are below 1%.

In the preferred embodiment shown in FIGS. 50A and 50B, the anode bus line "AB" may be formed under the resistive material "RM", which is similar to the previous embodiment of FIGS. 49A and 49B.

Figure 51A:
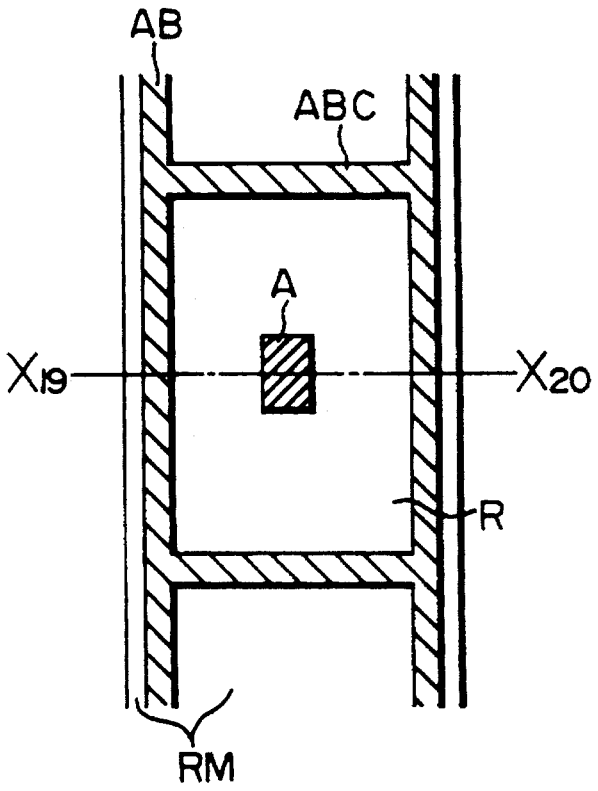
FIG. 51A is a plane view of an essential part of DC type gas-discharge display panel according to a further embodiment of the present invention.
Figure 51B:
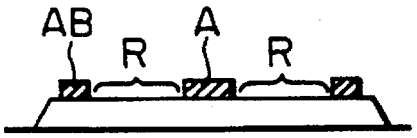
FIG. 51B is a sectional view thereof, taken along a line $X_{19}$–$X_{20}$ shown in FIG. 51A.

Furthermore, as illustrated in FIGS. 51A and 51B, a branch anode bus line ABC may be formed in a ladder shape, and an anode "A" positioned adjacent to the bus line may be separated therefrom. In this case, it is assured that the positional precision among the anode "A", anode bus line "AB" and branch anode bus line ABC is changed within 10% in any directions, and then the variations in the resistance values are below 1%. Also, the distance between the adjoining anodes "A" may be shortened, as compared with that of the preferred embodiment shown in FIGS. 48A and 48B. In this case, the anode bus line AB may be formed under the resistive material "RM".

Although the resistors are formed at the sides of the anodes of the discharge cells in all of the above-described preferred embodiments, these resistors may be, of course, formed at sides of the cathodes. At this time, the cathode may be formed on the electrode for terminating the resistor. This may be applied to the anode, and the material such as Ni may be stacked which owns high resistance against mercury usually employed to prolong a lifetime of a gas-discharge display panel.

Also, according to the present invention, the above-described inventive idea may be applied not only to the gas-discharge display panel as shown in FIGS. 48A and 48B, but also a display panel from which luminous color of a gas discharge such as a Ne gas is directly derived to an outside of this display panel, and such a display panel without an auxiliary anode.

The present invention is not limited to the display panel having such a structure as shown in FIGS. 48A and 48B, but may be applied to such a display panel that, for instance, an anode is arranged in an offset relationship with a cathode, namely the anode is not positioned correctly opposite to the cathode.

While the above-described descriptions have been made that the thick-film printing method is employed to manufacture the resistive materials, the bus lines for terminating the resistive materials, and the electrodes, these manufacturing methods may be realized by various patterning methods, for example, vapor deposition/photolithography, and chemical etching or lift off.

As the resistive material, there are $RuO_2$, a nichrome alloy, tin oxide, $Ta_2N$, Cr-SiO, ITO, carbon and the like. It is a best way at this stage to employ a thick film paste made of $RuO_2$.

As the electrode material to terminate the resistive material, there are employed Au, Pd, Ag, Al, Ni, Cu, or alloys thereof. Au was the best thick-film printing.

The filling gas utilized in the present embodiment may be the filling gas as employed in the above-mentioned embodiment.

As the cathode material, Al and Ni and the like may be readily utilized.

If a Ni cathode is sorely employed in a display panel a lifetime of this display panel is shorter than that with an Al cathode. However, if mercury "Hg" is filled into the first-mentioned cathode, the lifetime thereof may be prolonged approximately 100 times longer than the lifetime of the display panel with only the Ni cathode, which becomes longer than that of the display panel with the Al cathode.

All of cathode materials, phosphor materials and filters described regarding the above-mentioned embodiment may be utilized in the present embodiment.

There are two panel driving methods, i.e., the DC memory drive mode and pulse memory drive mode used for the display panel with the resistor. Both of the drive modes may be utilized in the present invention.

While the present invention has been described with respect to the respective preferred embodiments in detail, the present invention is not restricted to only these preferred embodiments, but may be changed, substituted and modified within the technical scope and spirit of the present invention as defined in the following claims.

We claim:

1. A DC (direct current) type gas-discharge display panel comprising:

a plurality of discharge cells;

discharge current limiting means provided for each of the discharge cells, for limiting a discharge current of each of said discharge cells; and a filling gas filled into each of said discharge cells, and having an inert gas mixture, wherein a partial pressure ratio of said inert gas mixture to total pressure of said filling gas is at least 0.95;

said inert gas mixture is selected from the group consisting of (1) a first gas mixture consisting of a He gas and a Xe gas, (2), a second gas mixture consisting of a He gas, a Xe gas, and a Kr gas, (3) a third gas mixture consisting of a Ne gas and a Xe gas, and (4) a fourth gas mixture consisting of a Ne gas, a Xe gas and a Kr gas;

wherein assuming that the total pressure of said filling gas is "p" Torr, a partial pressure ratio of said Xe gas to the total pressure of said filling gas is "x" and also a partial pressure ratio of said Kr gas to the total pressure of said filling gas is "k";

when said inert gas mixture corresponds to said first gas mixture, a condition of $0.01 \leqq x \leqq 0.5$, a condition of $p \leqq 600$, and another condition of $xp^5 \geqq 1.4.10^{11}$ are satisfied;

when said inert gas mixture corresponds to said second gas mixture, a condition of $0.01 \leqq x \leqq 0.5$, a condition of $0 < k \leqq 0.5$, a condition of $p \leqq 600$, and also another condition of $\{1+700xk^2/(p/200)^4\}\ xp^5 \geqq 1.4.10^{11}$ are satisfied;

when said inert gas mixture corresponds to said third gas mixture, a condition of $0.01 \leqq x \leqq 0.5$, a condition of $p \leqq 500$, and another condition of $xp^5 \geqq 8.0.10^9$; and also when said inert gas mixture corresponds to said fourth gas mixture, a condition of $0.01 \leqq x \leqq 0.5$, a condition of $0 < k \leqq 0.5$, a condition of $p \leqq 500$, and a condition of $\max\{80xk(1-3.3x),\ 1\}xp^5 \geqq 8.0.10^9$ are satisfied wherein said discharge current limiting means is a resistor;

said plurality of discharge cells are arranged in a matrix form along a line direction and a column direction;

said DC type gas-discharge display panel further comprises:

a plurality of first conductive lines elongated along the line direction, to which one of a desirable discharge controlling potential is applied, each of said first conductive line being commonly arranged in each of said discharge cells in the respective lines to constitute a first discharge electrode;

a plurality of second conductive lines elongated along said column direction, to which the other desirable discharge controlling potential is applied, two adjoining lines of said second conductive lines being commonly arranged with the respective discharge cells;

a plurality of second discharge electrodes provided at a substantially central position between said two adjoining lines of said second conductive lines, which corresponds to each of said discharge cells, for producing a discharge between said first discharge electrodes corresponding to said discharge cells; and a plurality of resistive materials elongated along said column direction, each of said resistive materials being arranged in such a manner that said discharge cells at said column are bridged by each of said resistive materials, and being in contact with both of said two adjoining lines of said second conductive lines and said second electrode corresponding to said discharge cells at each column; and, each of said resistors is formed by being terminated by said two adjoining lines of said second conductive lines and said second electrodes corresponding to said respective discharge cells.

2. A DC type gas-discharge display panel as claimed in claim 1, wherein said first discharge electrode is a cathode, and said second discharge electrode is an anode.

3. A DC type gas-discharge display panel as claimed in claim 1, wherein said first discharge electrode is an anode, and said second discharge electrode is a cathode.

4. A DC type gas-discharge display panel as claimed in claim 1, wherein said DC type gas-discharge display panel further comprises:

plural pairs of branch conductive lines for bridging said two adjoining lines of said second conductive lines, each pair of said branch conductive lines being arranged at both sides of the respective second discharge electrodes along the column direction in relation to said discharge cells;

each of said resistive materials is also in contact with each of said branch conductive lines corresponding to said discharge cells at the respective columns; and each of said resistors is also terminated by said pair of branch conductive lines corresponding to the respective discharge cells.

5. A DC (direct current) type gas-discharge display panel comprising:

a plurality of discharge cells;

discharge current limiting means provided for each of the discharge cells, for limiting a discharge current of each of said discharge cell; and a filling gas filled into each of said discharge cells, and having an inert gas mixture, wherein a partial pressure ratio of said inert gas mixture to total pressure of said filling gas is at least 0.95;

said inert gas mixture is selected from the group consisting of (1) a first gas mixture consisting of a He gas and a Xe gas, (2), a second gas mixture consisting of a He gas, a Xe gas, and a Kr gas, (3) a third gas mixture consisting of a Ne gas and a Xe gas, and (4) a fourth gas mixture consisting of a Ne gas, a Xe gas and a Kr gas;

wherein assuming that the total pressure of said filling gas is "p" Torr, a partial pressure ratio of said Xe gas to the total pressure of said filling gas is "x" and also a partial pressure ratio of said Kr gas to the total pressure of said filling gas is "k";

when said inert gas mixture corresponds to said first gas mixture, a condition of $0.01 \leqq x \leqq 0.5$, a condition of $p \leqq 600$, and another condition of $xp^5 \geqq 1.4.10^{11}$ are satisfied;

when said inert gas mixture corresponds to said second gas mixture, a condition of $0.01 \leqq x \leqq 0.5$, a condition of $0 < k \leqq 0.5$, a condition of $p \leqq 600$, and also another condition of $\{1+700xk^2/(p/200)^4\}\ xp^5 \geqq 1.4.10^{11}$ are satisfied;

when said inert gas mixture corresponds to said third gas mixture, ..a condition of $0.01 \leqq x \leqq 0.5$, a condition of $p \leqq 500$, and another condition of $xp^5 \geqq 8.0.10^9$; and also when said inert gas mixture corresponds to said fourth gas mixture, a condition of $0.01 \leqq x \leqq 0.5$, a condition of $0 < k \leqq 0.5$, a condition of $p \leqq 500$, and a condition of $\max\{80xk(1-3.3x),1\}\ xp^5 \geqq 8.0.10^9$ are satisfied; wherein said discharge current limiting means is a resistor;

said plurality of discharge cells are arranged in a matrix form along a line direction and a column direction;

said DC type gas-discharge display panel further comprises:

a plurality of first conductive lines elongated along the line direction, to which one of a desirable discharge controlling potential is applied, each of said first conductive lines being commonly arranged in each of said discharge cells in the respective lines to constitute a first discharge electrode;

a plurality of second conductive lines elongated along said column direction, to which the other desirable discharge controlling potential is applied, each of said second conductive lines being commonly arranged with the respective discharge cells positioned at the respective columns;

plural pairs of branch conductive lines branched from each of said second conductive lines along said line direction in a comb shape, each of said pair of branch conductive lines being arranged at a position corresponding to each of said discharge cells;

a plurality of second discharge electrodes provided at a substantially central position between said pairs of branch conductive lines for producing a discharge between said first discharge electrodes corresponding to said discharge cells; and a plurality of resistive materials elongated along said column direction, each of said resistive materials being arranged in such a manner that said discharge cells at said column are bridged by each of said resistive materials, and being in contact with both of said pair of branch conductive lines and said second electrode corresponding to said discharge cells at each column; and, each of said resistors is formed by being terminated by said pair of branch conductive lines and said second electrodes corresponding to said respective discharge cells.

6. A gas-discharge display apparatus including a DC type gas-discharge display panel, and a drive device for driving said DC type gas-discharge display panel in a memory drive scheme, Wherein said DC type gas-discharge display panel comprises:

a plurality of discharge cells;

discharge current limiting means provided for each of the discharge cells, for limiting a discharge current of each of said discharge cell; and a filling gas filled into each of said discharge cells, and having an inert gas mixture, wherein a partial pressure ratio of said inert gas mixture to total pressure of said filling as is at least 0.95;

said inert gas mixture is selected from the group consisting of (1) a first gas mixture consisting of a He gas and a Xe gas, (2) a second gas mixture consisting of a He gas, a Xe gas, and a Kr gas, (3) a third gas mixture consisting of a Ne gas and a Xe gas, and (4) a fourth gas mixture consisting of a Ne gas, a Xe gas and a Kr gas;

assuming now that the total pressure of said filling gas is "p" Torr, a partial pressure ratio of said Xe gas to the total pressure of said filling gas is "x", and a partial pressure ratio of said Kr gas to the total pressure of said filling gas is "k", an active cathode area of each of said discharge cells is S $mm^2$, and also a sustaining discharge current based on the drive of said drive device is I μA;

when said inert gas mixture corresponds to said first gas mixture, a condition of $0.01 \leqq x \leqq 0.5$, a condition of $p \leqq 600$, and another condition of $xp^5(S/I)^2 \geqq 6.3.10^4$ are satisfied;

when said inert gas mixture corresponds to said second gas mixture, a condition of $0.01 \leqq x \leqq 0.5$, a condition of $0 < k \leqq 0.5$, a condition of $p \leqq 600$, and also another condition of $\{1+700xk^2/(p/200)^4\}\ xp^5(S/I)^2 \geqq 6.3.10^4$ are satisfied;

when said inert gas mixture corresponds to said third gas mixture, a condition of $0.01 \leqq x \leqq 0.5$, a condition of $p \leqq 500$, and another condition of $xp^5(S/I)^3 \geqq 2.4$; and also when said inert gas mixture corresponds to said fourth gas mixture, a condition of $0.01 \leqq x \leqq 0.5$, a condition of $0 < k \leqq 0.5$, a condition of $p \leqq 500$, and a condition of $\max\ \{80xk(1-3.3x),1\}\ xp^5(S/I)^3 \geqq 2.4$ are satisfied; wherein said discharge current limiting means is a resistor;

said plurality of discharge cells are arranged in a matrix form along a line direction and a column direction;

said DC type gas-discharge display panel further comprises:

a plurality of first conductive lines elongated along the line direction, to which one of a desirable discharge controlling potential is applied, each of said first conductive lines being commonly arranged in each of said discharge cells in the respective lines to constitute a first discharge electrode;

a plurality of second conductive lines elongated along said column direction, to which the other desirable discharge controlling potential is applied, two adjoining lines of said second conductive lines being commonly arranged with the respective discharge cells;

a plurality of second discharge electrodes provided at a substantially central position between said two adjoining lines of said second conductive lines, which corresponds to each of said discharge cells, for producing a discharge between said first discharge electrodes corresponding to said discharge cells; and a plurality of resistive materials elongated along said column direction, each of said resistive materials being arranged in such a manner that said discharge cells at said column are bridged by each of said resistive materials, and being in contact with both of said two adjoining lines of said second conductive lines and said second electrode corresponding to said discharge cells at each column; and, each of said resistors is formed by being terminated by said two adjoining lines of said second conductive lines and said second electrodes corresponding to said respective discharge cells.

7. A gas-discharge display apparatus as claimed in claim 6, wherein said DC type gas-discharge display panel further comprises:

plural pair of branch conductive lines for bridging said two adjoining lines of said second conductive lines, each pair of said branch conductive lines being arranged at both sides of the respective second discharge electrodes along the column direction in relation to said discharge cells;

each of said resistive materials is in contact with each of said branch conductive lines corresponding to said discharge cells at the respective columns; and each of said resistors is also terminated by said pair of branch conductive lines corresponding to the respective discharge cells.

8. A gas-discharge display apparatus including a DC type gas-discharge display panel, and a drive device for driving said DC type gas discharge display panel in a memory drive scheme, wherein said DC type gas-discharge display panel comprises:

a plurality of discharge cells;

discharge current limiting means provided for each of the discharge cells, for limiting a discharge current of each of said discharge cell; and a filling gas filled into each of said discharge cells, and having an inert gas mixture, wherein a partial pressure ratio of said inert gas mixture to total pressure of said filling gas is at least 0.95;

said inert gas mixture is selected from the group consisting of (1) a first gas mixture consisting of a He gas and a Xe gas, (2) a second gas mixture consisting of a He gas, a Xe gas, and a Kr gas, (3) a third gas mixture consisting of a Ne gas and a Xe gas, and (4) a fourth gas mixture consisting of a Ne gas, a Xe gas and a Kr gas;

assuming now that the total pressure of said filling gas is "p" Torr, a partial pressure ratio Of said Xe gas to the total pressure of said filling gas is "x", and a partial pressure ratio of said Kr gas to the total pressure Of said filling gas is "k", an active cathode area of each of said discharge cells is S $mm^2$, and also a sustaining discharge current based on the drive of said drive device is I μA;

when said inert gas mixture corresponds to said first gas mixture, a condition of $0.01 \leqq x \leqq 0.5$, a condition of $p \leqq 600$, and another condition of $xp^5(S/I)^2 \geqq 6.3.10^4$ are satisfied;

when said inert gas mixture corresponds to said second gas mixture, a condition of $0.01 \leqq x \leqq 0.5$, a condition of $0 < k \leqq 0.5$, a conduction of $p \leqq 600$, and also another condition of $\{1+700xk^2/(p/200)^4\}\ xp^5(S/I)^2 \geqq 6.3.10^4$ are satisfied:

when said inert gas mixture corresponds to said third gas mixture, a condition of $0.01 \leqq x \leqq 0.5$, a condition of $p \leqq 500$, and another condition of $xp^5(S/I)^3 \geqq 2.4$; and also when said inert gas mixture corresponds to said fourth gas mixture, a condition of $0.01 \leqq x \leqq 0.5$, a condition of $0 < k \leqq 0.5$, a condition of $p \leqq 500$, and a condition of max $\{80xk(1-3.3x),\ 1\}xp^5(S/I)^3 \leqq 2.4$ are satisfied; wherein said discharge current limiting means is a resistor;

said plurality of discharge cells are arranged in a matrix form along a line direction and a column direction;

said DC type gas-discharge display panel further comprises:

a plurality of first conductive lines elongated along the line direction, to which one of a desirable discharge controlling potential is applied, each of said first conductive lines being commonly arranged in each of said discharge cells in the respective lines to constitute a first discharge electrode;

a plurality of second conductive lines elongated along said column direction, to which the other desirable discharge controlling potential is applied, each of said second conductive lines being commonly arranged with the respective discharge cells positioned at the respective columns;

plural pairs of branch conductive lines branched from each of said second conductive lines along said line direction in a comb shape, each of said pair of branch conductive lines being arranged at a position corresponding to each of said discharge cells;

a plurality of second discharge electrodes provided at a substantially central position between said pairs of branch conductive lines for producing a discharge between said first discharge electrodes corresponding to said discharge cells; and a plurality of resistive materials elongated along said column direction, each of said resistive materials being arranged in such a manner that said discharge cells at said column are bridged by each of said resistive materials, and being in contact with both of said pair of branch conductive lines and said second electrode corresponding to said discharge cells at each column, and, each of said resistors is formed by being terminated by said pair of branch conductive lines and said second electrodes corresponding to said respective discharge cells.

9. A DC type gas-discharge display panel comprising:

a plurality of discharge cells arranged in a matrix form along a line direction and a column direction;

a plurality of resistors provided for each of said discharge cells, for limiting a discharge current of each of said discharge cells;

a filling gas filled into each of said discharge cells;

a plurality of first conductive lines elongated along the line direction, to which one of a desirable discharge controlling potential is applied, each of said first conductive lines being commonly arranged in each of said discharge cells in the respective lines to constitute a first discharge electrode;

a plurality of second conductive lines elongated along said column direction, to which the other desirable discharge controlling potential is applied, two adjoining lines of said second conductive lines being commonly arranged with the respective discharge cells;

a plurality of second discharge electrodes provided at a substantially central position between said two adjoining lines of said second conductive lines, which corresponds to each of said discharge cells, for producing a discharge between said first discharge electrodes corresponding to said discharge cells; and a plurality of resistive materials elongated along said column direction, each of said resistive materials being arranged in such a manner that said discharge cells at said column are bridged by each of said resistive materials, and being in contact with both of said two adjoining lines of said second conductive lines and said second electrode corresponding to said discharge cells at each column, and, wherein each of said resistors is formed by being terminated by said two adjoining lines of said second conductive lines and said second electrodes corresponding to said respective discharge cells.

10. A DC type gas-discharge display panel as claimed in claim 9, wherein said filling gas contains an inert gas mixture, and said inert gas mixture is selected from the group consisting of (1) a first gas mixture consisting of a He gas and a Xe gas, (2) a second gas mixture consisting of a He gas, a Xe gas, and a Kr gas, (3) a third gas mixture consisting of a Ne gas and a Xe gas, (4) a fourth gas mixture consisting of a Ne gas, a Xe gas and a Kr gas, and (5) a fifth gas mixture consisting of a Ne gas and a Ar gas.

11. A DC type gas-discharge display panel as claimed in claim 9, further comprising:

plural pairs of branch conductive lines for bridging said two adjoining lines of said second conductive lines, each pair of said branch conductive lines being arranged at both sides of the respective second discharge electrodes along the column direction in relation to said discharge cells; and wherein each of said resistive materials is also in contact with each of said branch conductive lines corresponding to said discharge cells at the respective columns; and each of said resistors is also terminated by said pair of branch conductive lines corresponding to the respective discharge cells.

12. A DC type gas-discharge display panel as claimed in claim 11, wherein said filling gas contains an inert gas mixture, and also said inert gas mixture is selected from the group consisting of (1) a first gas mixture consisting of a He gas and a Xe gas, (2) a second gas mixture consisting of a He gas, a Xe gas and a Kr gas, (3) a third gas mixture consisting of a Ne gas and a Xe gas, (4) a fourth gas mixture consisting of a Ne gas, a Xe gas and a Kr gas, and (5) a fifth gas mixture consisting of a Ne gas and an Ar gas.

13. A DC type gas-discharge display panel comprising:

a plurality of discharge cells arranged in a matrix form along a line direction and a column direction;

a plurality of resistors provided at each of said discharge cells, for limiting a discharge current of each of said discharge cells;

a filling gas filled in each of said discharge cells;

a plurality of first conductive lines elongated along the line direction, to which one of a desirable discharge controlling potential is applied, each of said first conductive lines being commonly arranged in each of said discharge cells in the respective lines to constitute a first discharge electrode;

a plurality of second conductive lines elongated along said column direction, to which the other desirable discharge controlling potential is applied, each of said second conductive lines being commonly arranged with the respective discharge cells positioned at the respective columns;

plural pairs of branch conductive lines branched from each of said second conductive lines along said line direction in a conch shape, each of said pair of branch conductive lines being arranged at a position corresponding to each of said discharge cells;

a plurality of second discharge electrodes provided at a substantially central position between said pairs of branch conductive lines for producing a discharge between said first discharge electrodes corresponding to said discharge cells; and a plurality of resistive materials elongated along said column direction, each of said resistive materials being arranged in such a manner that said discharge cells at said column are bridged by each of said resistance materials, and being in contact with both of said pair of branch conductive lines and said second electrode corresponding to said discharge cells at each column;

each of said resistors being formed by being terminated by said pair of branch conductive lines and said second electrodes corresponding to said respective discharge cells.

14. A DC type gas-discharge display panel as claimed in claim 13, wherein said filling gas contains an inert gas mixture, and also said inert gas mixture is selected from the group consisting of (1) a first gas mixture consisting of a He gas and a Xe gas, (2) a second gas mixture consisting of a He gas, a Xe gas, and a Kr gas, (3) a third gas mixture consisting of a Ne gas and a Xe gas, (4) a fourth gas mixture consisting of a Ne gas, a Xe gas and a Kr gas; and (5) a fifth gas mixture consisting of a Ne gas and an Ar gas.

* * * * *

UNITED STATES PATENT AND TRADEMARK OFFICE

CERTIFICATE OF CORRECTION

PATENT NO. : 5,510,678
DATED : April 23, 1996
INVENTOR(S) : SAKAI et al.

It is certified that error appears in the above-indentified patent and that said Letters Patent is hereby corrected as shown below:

Col.25, Claim 5, line 6, change "cell" to --cells--.

Col.26, Claim 6, line 9, change "cell" to --cells-- and

Col.27, Claim 8, line 9, change "cell" to --cells--.

Signed and Sealed this

Twentieth Day of August, 1996

*Attest:*

BRUCE LEHMAN

*Attesting Officer*

*Commissioner of Patents and Trademarks*